US008955602B2

(12) United States Patent
Pilgrim

(10) Patent No.: US 8,955,602 B2
(45) Date of Patent: Feb. 17, 2015

(54) SYSTEM AND METHODS FOR CONTINUOUS AND NEAR CONTINUOUS DRILLING

(75) Inventor: Rick Pilgrim, Allen, TX (US)

(73) Assignee: LeTourneau Technologies, Inc., Houston, TX (US)

( * ) Notice: Subject to any disclaimer, the term of this patent is extended or adjusted under 35 U.S.C. 154(b) by 579 days.

(21) Appl. No.: 13/301,385

(22) Filed: Nov. 21, 2011

(65) Prior Publication Data

US 2012/0181084 A1 Jul. 19, 2012

Related U.S. Application Data

(60) Provisional application No. 61/458,240, filed on Nov. 19, 2010.

(51) Int. Cl.

| | |
|---|---|
| ***E21B 19/20*** | (2006.01) |
| ***E21B 44/00*** | (2006.01) |
| ***E21B 7/00*** | (2006.01) |
| ***E21B 19/00*** | (2006.01) |
| ***E21B 19/16*** | (2006.01) |
| ***E21B 21/01*** | (2006.01) |

(52) U.S. Cl.

CPC ..... *E21B 44/00* (2013.01); *E21B 19/20* (2013.01); *E21B 7/00* (2013.01); *E21B 19/00* (2013.01); *E21B 19/16* (2013.01); *E21B 21/01* (2013.01)

USPC ..... 166/377; 166/77.1; 166/77.51; 166/85.1; 175/52; 175/85

(58) Field of Classification Search

CPC ..... E21B 19/20; E21B 19/14

USPC ..... 175/52, 85; 166/377, 77.51, 77.1, 85.1

See application file for complete search history.

(56) References Cited

U.S. PATENT DOCUMENTS

| | | | | |
|---|---|---|---|---|
| 3,158,212 | A * | 11/1964 | Fanshawe et al. | 175/85 |
| 3,658,298 | A * | 4/1972 | Moore et al. | 254/286 |
| 4,423,994 | A * | 1/1984 | Schefers et al. | 414/22.68 |

(Continued)

FOREIGN PATENT DOCUMENTS

| | | |
|---|---|---|
| WO | 98/16716 | 4/1998 |
| WO | 00/23686 | 4/2000 |
| WO | 00/79092 | 12/2000 |

OTHER PUBLICATIONS

Schouten, International Search Report and Written Opinion for PCT/US2012/038648, mailed Oct. 24, 2013.

(Continued)

*Primary Examiner* — Giovanna Wright

(74) *Attorney, Agent, or Firm* — Eubanks PLLC

(57) ABSTRACT

The present disclosure provides a drilling and tripping equipment package and control scheme and methods using two or more systems that operate simultaneously and continuously in a synchronized manner such that the feeding of tubulars into or out of a well bore is achieved with continuous or near continuous movement, without the need for periodic interruptions. The drilling and tripping equipment package and control scheme is also able to rotate the tubulars in the well bore with continuous speed and torque sufficient for both drilling and back-reaming operations. The drilling and tripping equipment package and control scheme is additionally able to circulate drilling fluid into the internal bore of the tubulars with sufficient pressure and flow to facilitate both drilling and back-reaming operations, with minimal interruption to circulation.

10 Claims, 58 Drawing Sheets

(56) References Cited

U.S. PATENT DOCUMENTS

| | | | | |
|---|---|---|---|---|
| 4,643,259 | A | 2/1987 | Zeringue | |
| 5,762,279 | A * | 6/1998 | Horton, III | 254/285 |
| 6,629,572 | B2 | 10/2003 | Womer et al. | |
| 6,688,394 | B1 | 2/2004 | Ayling | |
| 2003/0075023 | A1 | 4/2003 | Robichaux | |
| 2003/0221519 | A1 | 12/2003 | Haugen | |
| 2003/0234101 | A1 | 12/2003 | Ayling | |
| 2010/0200299 | A1 | 8/2010 | Vatne | |
| 2013/0025937 | A1 * | 1/2013 | Pilgrim et al. | 175/24 |

OTHER PUBLICATIONS

Ratkay, Written Opinion from Intellectual Property Office of Singapore for Application No. 11201402434R (SG national stage entry of PCT/US12/38648), dated Sep. 18, 2014 (mailed by IPOS to Applicant on Oct. 20, 2014).

Wright, Office action mailed Dec. 11, 2014, for U.S. Appl. No. 13/475,631.

* cited by examiner

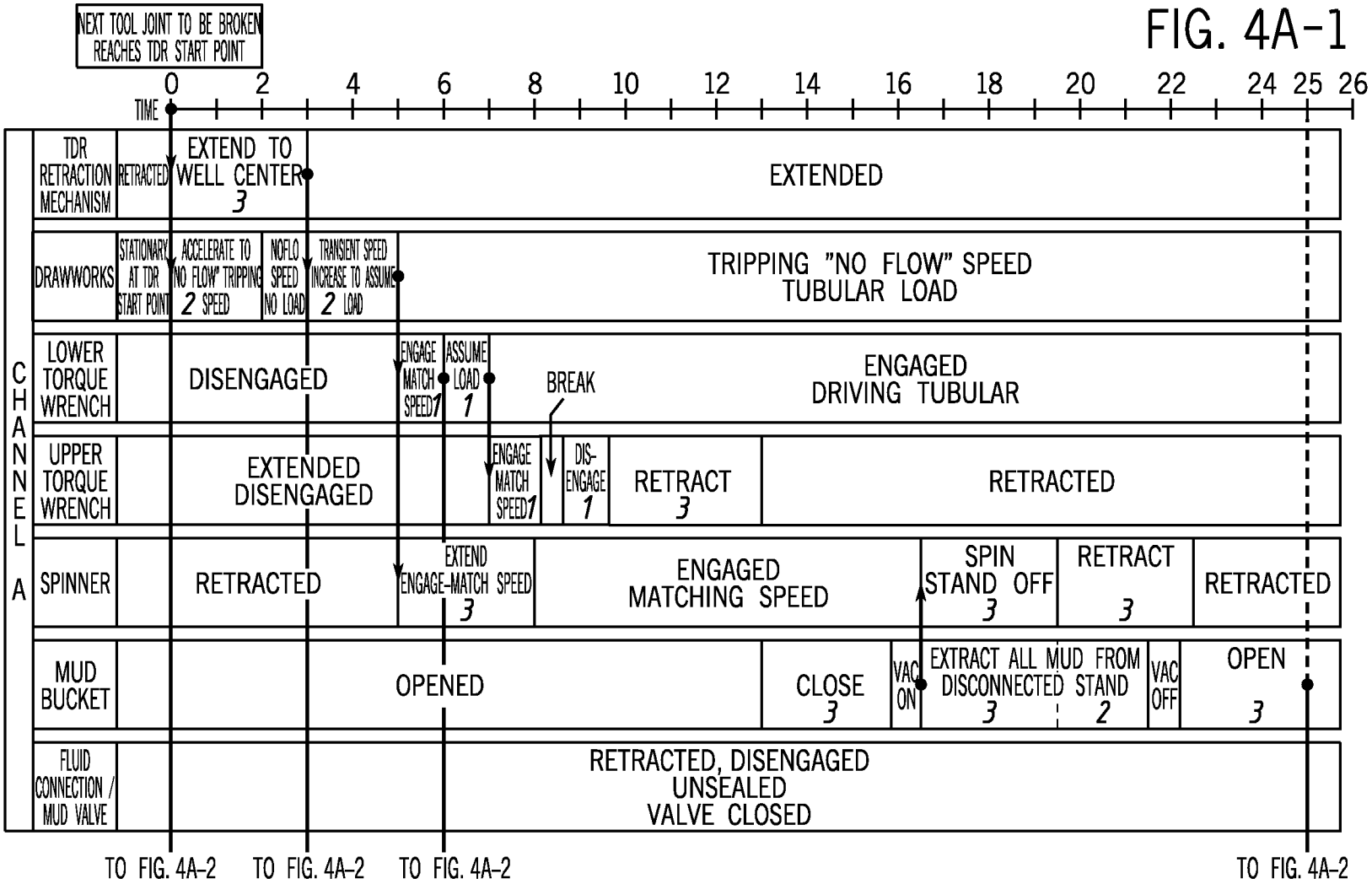
FIG. 4A-1
NEXT TOOL JOINT TO BE BROKEN REACHES TDR START POINT
TIME
0
2
4
6
8
10
12
14
16
18
20
22
24
25
26
CHANNEL A
TDR RETRACTION MECHANISM
RETRACTED
EXTEND TO WELL CENTER 3
EXTENDED
DRAWWORKS
STATIONARY AT TDR START POINT
ACCELERATE TO "NO FLOW" TRIPPING SPEED 2
NO FLOW SPEED
NO LOAD
TRANSIENT SPEED
INCREASE TO ASSUME 2 LOAD
TRIPPING "NO FLOW" SPEED TUBULAR LOAD
LOWER TORQUE WRENCH
DISENGAGED
ENGAGE MATCH SPEED 1
ASSUME MATCH LOAD 1
ENGAGED DRIVING TUBULAR
BREAK
UPPER TORQUE WRENCH
EXTENDED DISENGAGED
ENGAGE MATCH SPEED 1
DIS-ENGAGE 1
RETRACT 3
RETRACTED
SPINNER
RETRACTED
EXTEND ENGAGE-MATCH SPEED 3
ENGAGED MATCHING SPEED
SPIN STAND OFF 3
RETRACT 3
RETRACTED
MUD BUCKET
OPENED
CLOSE 3
VAC ON
EXTRACT ALL MUD FROM DISCONNECTED STAND 3
2
VAC OFF
OPEN 3
FLUID CONNECTION / MUD VALVE
RETRACTED, DISENGAGED UNSEALED VALVE CLOSED
TO FIG. 4A-2
TO FIG. 4A-2
TO FIG. 4A-2
TO FIG. 4A-2
TO FIG. 4A-2

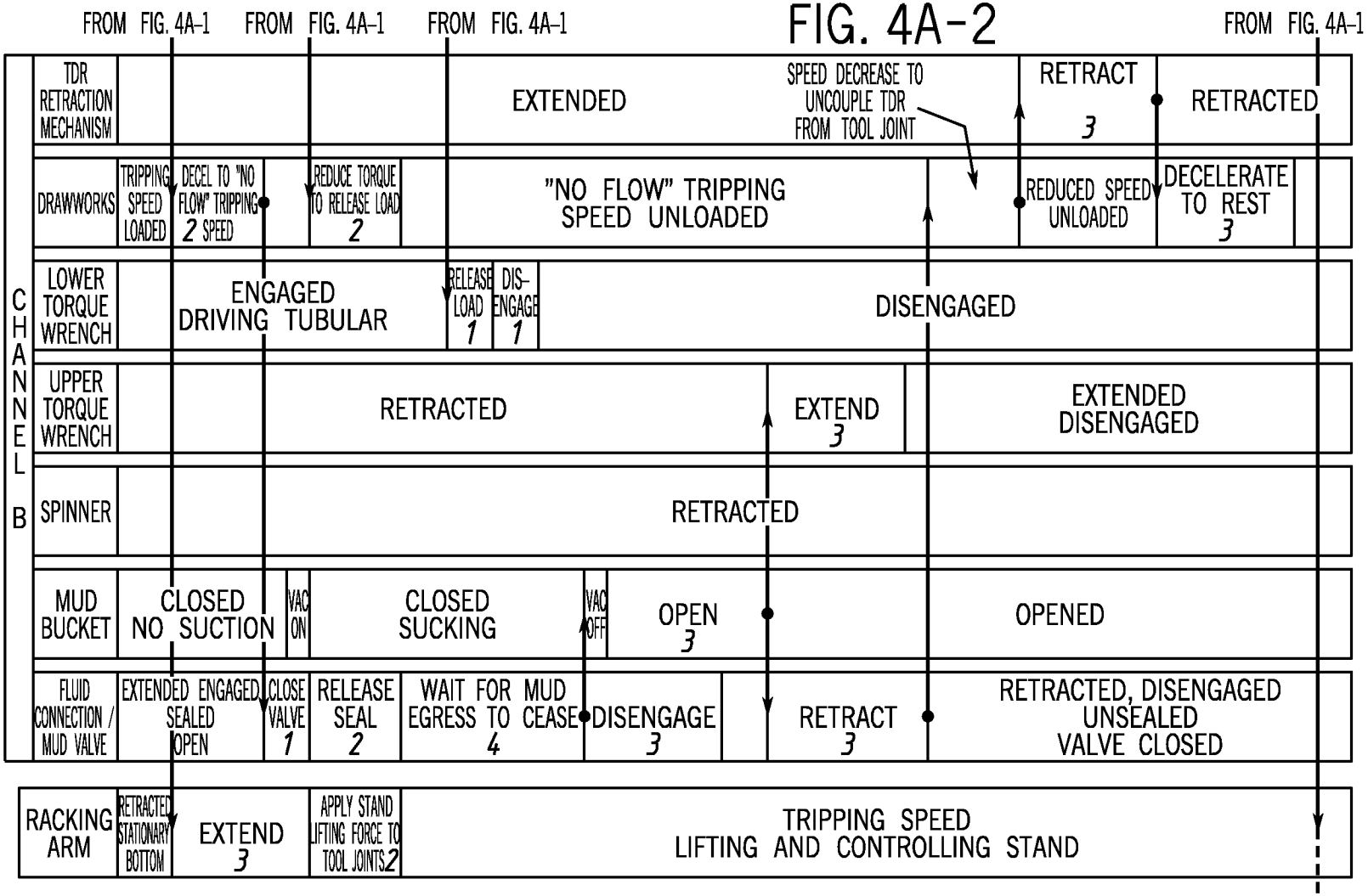
FIG. 4A-2
FROM FIG. 4A-1
FROM FIG. 4A-1
FROM FIG. 4A-1
FROM FIG. 4A-1
CHANNEL B
TDR RETRACTION MECHANISM
DRAWWORKS
LOWER TORQUE WRENCH
UPPER TORQUE WRENCH
SPINNER
MUD BUCKET
FLUID CONNECTION / MUD VALVE
RACKING ARM
EXTENDED
SPEED DECREASE TO UNCOUPLE TDR FROM TOOL JOINT
RETRACT 3
RETRACTED
TRIPPING SPEED LOADED
DECEL TO "NO FLOW" TRIPPING SPEED 2
REDUCE TORQUE TO RELEASE LOAD 2
"NO FLOW" TRIPPING SPEED UNLOADED
REDUCED SPEED UNLOADED
DECELERATE TO REST 3
ENGAGED DRIVING TUBULAR
RELEASE LOAD 1
DIS-ENGAGE 1
DISENGAGED
RETRACTED
EXTEND 3
EXTENDED DISENGAGED
RETRACTED
CLOSED NO SUCTION
VAC ON
CLOSED SUCKING
VAC OFF
OPEN 3
OPENED
EXTENDED ENGAGED SEALED OPEN
CLOSE VALVE 1
RELEASE SEAL 2
WAIT FOR MUD EGRESS TO CEASE 4
DISENGAGE 3
RETRACT 3
RETRACTED, DISENGAGED UNSEALED VALVE CLOSED
RETRACTED STATIONARY BOTTOM
EXTEND 3
APPLY STAND LIFTING FORCE TO TOOL JOINTS 2
TRIPPING SPEED LIFTING AND CONTROLLING STAND

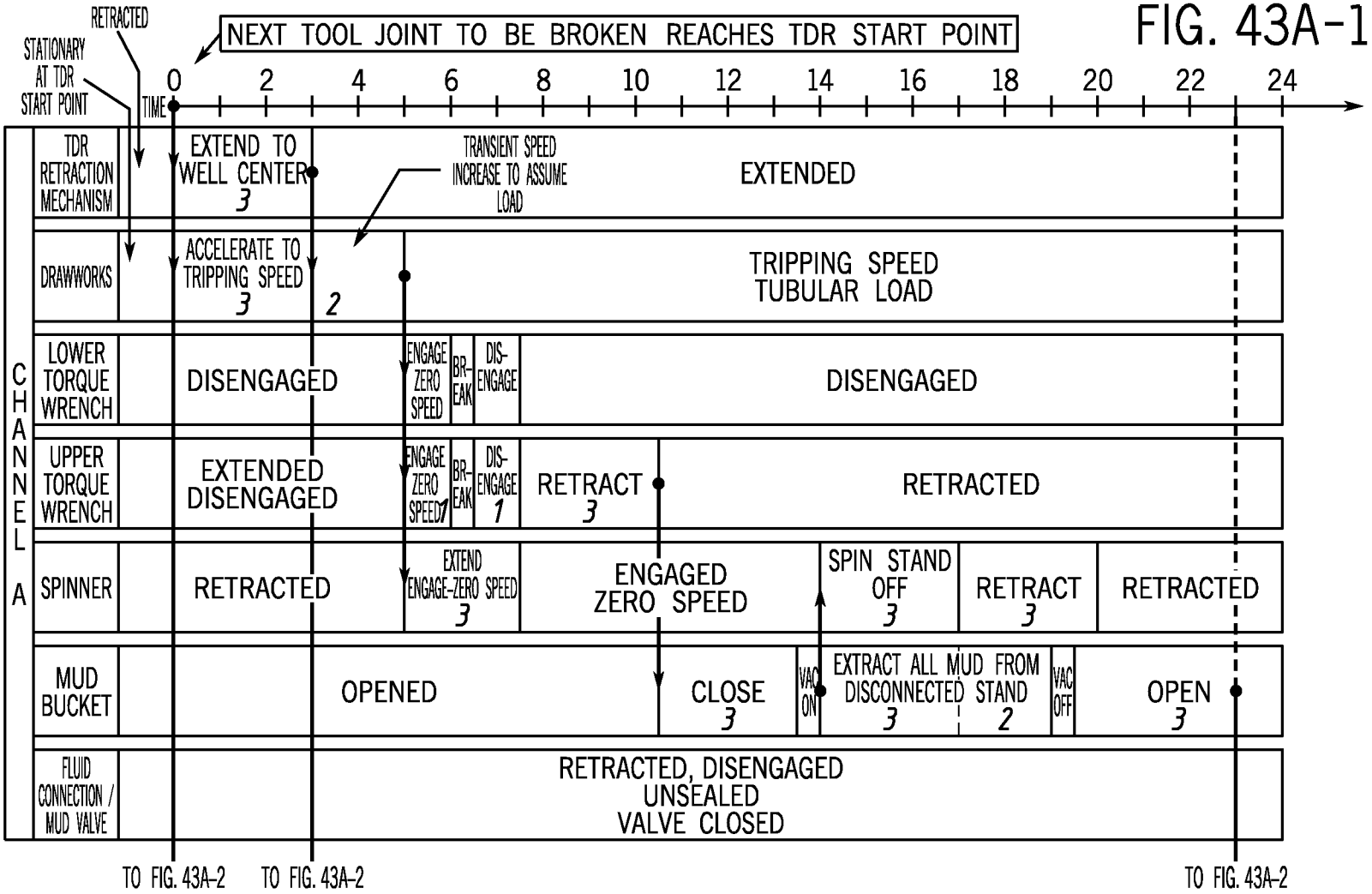
FIG. 43A-1
NEXT TOOL JOINT TO BE BROKEN REACHES TDR START POINT
RETRACTED
STATIONARY AT TDR START POINT
TIME
0
2
4
6
8
10
12
14
16
18
20
22
24
TDR RETRACTION MECHANISM
DRAWWORKS
LOWER TORQUE WRENCH
UPPER TORQUE WRENCH
SPINNER
MUD BUCKET
FLUID CONNECTION / MUD VALVE
CHANNEL A
EXTEND TO WELL CENTER 3
EXTENDED
TRANSIENT SPEED INCREASE TO ASSUME LOAD
ACCELERATE TO TRIPPING SPEED 3
TRIPPING SPEED TUBULAR LOAD
2
DISENGAGED
ENGAGE ZERO SPEED
BR-EAK
DIS-ENGAGE
EXTENDED DISENGAGED
RETRACTED
RETRACT 3
ENGAGE ZERO SPEED
BR-EAK
DIS-ENGAGE 1
RETRACTED
EXTEND ENGAGE-ZERO SPEED 3
ENGAGED ZERO SPEED
OPENED
CLOSE 3
WAC ON
SPIN STAND OFF 3
EXTRACT ALL MUD FROM DISCONNECTED STAND 3
RETRACT 3
WAC OFF
2
RETRACTED
OPEN 3
RETRACTED, DISENGAGED UNSEALED VALVE CLOSED
TO FIG. 43A-2
TO FIG. 43A-2
TO FIG. 43A-2

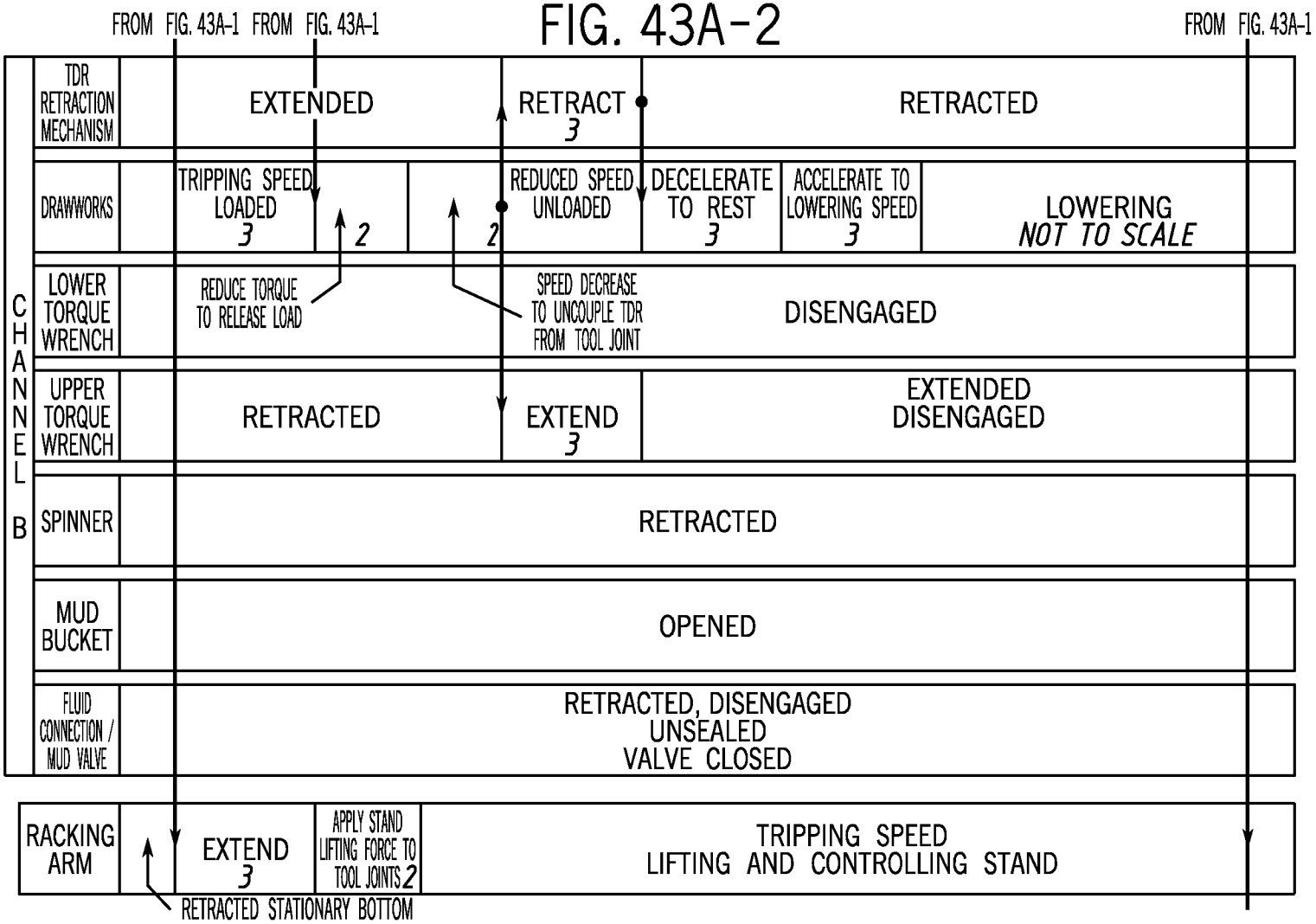
FIG. 43A-2
FROM FIG. 43A-1
FROM FIG. 43A-1
FROM FIG. 43A-1
TDR RETRACTION MECHANISM
DRAWWORKS
LOWER TORQUE WRENCH
UPPER TORQUE WRENCH
SPINNER
MUD BUCKET
FLUID CONNECTION / MUD VALVE
RACKING ARM
CHANNEL B
EXTENDED
TRIPPING SPEED LOADED 3
REDUCE TORQUE TO RELEASE LOAD
2
RETRACTED
RETRACT 3
REDUCED SPEED UNLOADED
SPEED DECREASE TO UNCOUPLE TDR FROM TOOL JOINT
DECELERATE TO REST 3
ACCELERATE TO LOWERING SPEED 3
LOWERING NOT TO SCALE
DISENGAGED
RETRACTED
EXTEND 3
EXTENDED DISENGAGED
RETRACTED
OPENED
RETRACTED, DISENGAGED UNSEALED VALVE CLOSED
EXTEND 3
APPLY STAND LIFTING FORCE TO TOOL JOINTS 2
RETRACTED STATIONARY BOTTOM
TRIPPING SPEED LIFTING AND CONTROLLING STAND

SYSTEM AND METHODS FOR CONTINUOUS AND NEAR CONTINUOUS DRILLING

CROSS-REFERENCE TO RELATED APPLICATION

This application claims the benefit of U.S. Provisional Patent Application Ser. No. 61/458,240, filed on Nov. 19, 2010, which is incorporated herein by reference in its entirety.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

FIELD OF THE INVENTION

The invention relates generally to systems and methods useful in drilling applications. More specifically, the invention relates to systems and methods useful for drilling for oil and/or natural gas, although not necessarily limited to such applications.

BACKGROUND OF THE ART

Those skilled in the art of drilling applications for oil and gas will appreciate that a great deal of time can be consumed by various operations during the course of drilling a well. Among other things, each time a drill string needs to be tripped out of a wellbore, a potentially substantial amount of time is lost to drilling operations. Because the daily cost of drilling a well can be substantial, especially in connection with offshore drilling in deepwater applications, efforts have been made to reduce the time spent on tripping operations. Similarly, efforts have been made to try to speed up and obtain greater efficiencies in drilling operations generally. Specifically, efforts have been made to try to maintain the continuous and near continuous drilling of the well. The inputs that the driller has at his disposal to manage the well are rotation of the drill pipe, hoisting (raising or sometimes lowering) the drill pipe, and the circulation of fluid down through the drill pipe and back to the surface. A significant problem with existing drilling techniques is that they require the drill pipe to stop at the drillfloor to be connected to the next section of drill pipe entering or being pulled from the well. During this stopping period all dynamic inputs used by the driller to manage the well stops because the drilling equipment can no longer rotate, hoist or pump fluids while moving. It is during this stopping time, or connection time, that the well experiences many of the classic well management issues that cause non-productive time (NPT). Of course, such efforts must be taken with care so as not to compromise safety and to also prevent or minimize the potential for accidents or pollution.

One approach taken in the past involves the use of a "multi-activity" drilling assembly which includes two tubular stations. Such an approach is described in U.S. Pat. No. 6,085,851, issued to Scott, et al., on Jul. 11, 2000, titled "Multi-Activity Offshore Exploration and/or Development Drill Method and Apparatus ("Scott")," which is hereby incorporated by reference as if fully set forth herein. In Scott, an apparatus and method is described that involves the use of two drill strings so that certain auxiliary actions can be ongoing with respect to one drill string while drilling or tripping operations are ongoing with respect to a second drill string. This approach has certain drawbacks, not least of which are the use of two drill strings and the added complexity of ongoing operations with both in connection with a single derrick.

What is needed is an apparatus and methods for drilling and tripping that take less time than standard drilling and tripping equipment and methods.

BRIEF SUMMARY OF THE INVENTION

Those skilled in the art will appreciate that this summary of the invention, and the accompanying detailed description of embodiments of the invention do not define the scope of the invention and do not provide a substitute for the claims in defining the scope of the invention, but are merely provided for guidance in providing a better understanding of the full scope of the invention as measured by the claims. In one embodiment of the invention, a system is provided which has as its goal and provides as an advantage the ability to obtain continuous or near continuous tripping operations in connection with a rig having a derrick, two independently operable drawworks, two independently operable traveling differential roughnecks, a drilling fluid divert system, and an integrated control system for automatically controlling drilling operations. In another embodiment of the invention, the system further includes a number of sensors responsive to well parameters that feed information regarding the well to the integrated control system which takes action based on one or more of such well parameters to further control drilling operations. In another embodiment of the invention, a method is provided for automatically controlling the operation of two independently operable traveling differential roughnecks in a derrick to obtain continuous or near continuous tripping operations. In still another method, an operator may modify the automated drilling activities by specifying additional conditions or parameters for safety, environmental and other preferences or concerns. In still another embodiment, the system automatically stores data regarding drilling activities, well conditions and parameters, and operating conditions in a database.

One benefit provided by the present disclosure is that, while drilling, it does not stop during connection times, and this continuous or near continuous rotation, hoisting capability and mud circulation of the drill string significantly decreases the likelihood of classic oil and gas well drilling challenges such as, but not limited to, differentially sticking the drill pipe to the wellbore wall and complications arising from build up of wellbore cuttings due to loss of circulation.

The present disclosure provides a drilling and tripping system, comprising a plurality of lifting systems, a plurality of traveling differential roughnecks, each associated with at least one of the plurality of lifting systems, one or more pipe handling and storage system associated with at least one of the plurality of traveling differential roughnecks, one or more drilling fluid diverting system associated with at least one of the plurality of traveling differential roughnecks, and a control system. In certain embodiments the drilling and tripping system comprises a first lifting system and a second lifting system. In alternative embodiments, the drilling and tripping system comprises a first lifting system, a second lifting system, and a third lifting system. In some embodiments, the first lifting system and/or the second lifting system and/or the third lifting system comprises a drawworks, a winch, a hydraulic ram, a rack and pinion system, or a high load linear motor.

In other embodiments the drilling and tripping system comprises a first traveling differential roughneck and a second traveling differential roughneck. In further embodiments the drilling and tripping system comprises a first traveling differential roughneck, a second traveling differential roughneck, and a third traveling differential roughneck. In particular embodiments, the first traveling differential roughneck and/or the second traveling differential roughneck and/or the third traveling differential roughneck comprises one, some or all of the following components: a rotating elevator bowl; a lower rotating torque wrench; an upper rotating torque wrench; a spinner; a mud bucket; and a fluid connection system. In further embodiments the rotating elevator bowl comprises one, some or all of the following components: a main body; a bowl; a thrust bearing; an aligned radial opening in the main body, bowl and thrust bearing; a motor; and a plurality of sensors. In still other embodiments the lower rotating torque wrench comprises one, some or all of the following components: a ring gear comprising a gate; at least a first motor; and a plurality of cam locked jaws. In additional embodiments the upper rotating torque wrench comprises one, some or all of the following components: a ring gear comprising a gate; at least a first motor; and a plurality of cam locked jaws. In certain embodiments, the spinner is a two-part spinner. In particular embodiments the mud bucket is a two-part mud bucket.

In some embodiments, the control system comprises a computer, the computer further comprising instructions for operating the drilling and tripping system. In other embodiments the control system comprises instructions for simultaneously controlling the operations of the lifting systems, the travelling differential roughnecks, the pipe handling and storage system, and the drilling fluid diverting system. In still other embodiments the control system comprises instructions responsive to data associated with drilling or tripping operations. In further embodiments the control system comprises instructions responsive to data stored in non-volatile memory, real-time data associated with drilling or tripping operations, and user inputs.

The present disclosure also provides a method for removing a portion of a drillstring from a hole with continuous or nearly continuous rotation and near continuous mud circulation, comprising outfitting a drilling rig with the drilling and tripping system of claim 1, and operating the drilling and tripping system to remove at least a portion of a drillstring from a hole with continuous or nearly continuous rotation and nearly continuous mud circulation.

In addition, the present disclosure provides a method for drilling an oil or gas well, comprising outfitting a drilling rig with the drilling and tripping system of claim 1, and operating the drilling and tripping system to drill an oil or gas well.

Additionally, the present disclosure provides a method for removing a tubular from a riser or a cased hole at maximum speed without the need for fluid circulation or rotation of the tubular, comprising outfitting a drilling rig with the drilling and tripping system of claim 1, and operating the drilling and tripping system to remove a tubular from a riser or a cased hole at maximum speed without the need for fluid circulation or rotation of the tubular.

BRIEF DESCRIPTION OF THE SEVERAL VIEWS OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 4A and FIG. 4B. A block diagram showing one embodiment of a detailed operational sequence for one cycle of removing a tubular from a hole at 1 foot/second with continuous rotation and near continuous mud circulation. At the end of each of the described cycle, the cycle repeats with Channel A performing the tasks done by Channel B and vice-versa. FIG. 4A. A block diagram showing one embodiment of a detailed operational sequence for the first approximately 62.5% of one cycle of removing a tubular from a hole at 1 foot/second with continuous rotation and near continuous mud circulation. FIG. 4B. A block diagram showing one embodiment of a detailed operational sequence for the last approximately 37.5% of one cycle of removing a tubular from a hole at 1 foot/second with continuous rotation and near continuous mud circulation.

FIG. 5A. Schematic of drilling and tripping system at t=0 seconds before the first TDR extends and engages below the tool joint. FIG. 5B. Close-up of the first TDR at t=0 seconds.

FIG. 6A. Schematic of drilling and tripping system at t=5 seconds as the spinner of the first TDR extends to engage the tubular. FIG. 6B. Close-up of the first TDR at t=5 seconds.

FIG. 7A. Schematic of drilling and tripping system at t=11 seconds as the upper torque wrench of the first TDR retracts. FIG. 7B. Close-up of the first TDR at t=11 seconds.

FIG. 8A. Schematic of drilling and tripping system at t=14 seconds as the mud bucket of the first TDR closes. FIG. 8B. Close-up of the first TDR at t=14 seconds.

FIG. 9A. Schematic of drilling and tripping system at t=19 seconds as the mud bucket of the first TDR extracts mud as the spinner disconnects the tubular. FIG. 9B. Close-up of the first TDR at t=19 seconds.

FIG. 10A. Schematic of drilling and tripping system at t=24 seconds as the mud bucket of the first TDR retracts. FIG. 10B. Close-up of the first TDR at t=24 seconds.

FIG. 11A. Schematic of drilling and tripping system at t=26 seconds as the racking arm removes the disconnected tubular. FIG. 11B. Close-up of the first TDR at t=26 seconds.

FIG. 12A. Schematic of drilling and tripping system at t=32 seconds as the fluid connection system of the first TDR engages the rotating tubular. FIG. 12B. Close-up of the first TDR at t=32 seconds.

FIG. 13A. Schematic of drilling and tripping system at t=36 seconds as the mud flow begins upon sealing. FIG. 13B. Close-up of the first TDR at t=36 seconds.

FIG. 14A. Schematic of drilling and tripping system at t=45 seconds as the tubular is being pulled with rotation and mud flow. FIG. 14B. Close-up of the first TDR at t=45 seconds.

FIG. 15A. Schematic of drilling and tripping system at t=77 seconds as the second TDR engages with the next tool joint. FIG. 15B. Close-up of the first TDR at t=77 seconds.

FIG. 16A. Schematic of drilling and tripping system at t=81 seconds as the second TDR takes over weight load and rotation of the tubular. FIG. 16B. Close-up of the first TDR at t=81 seconds.

FIG. 17A. Schematic of drilling and tripping system at t=92 seconds as the fluid connection system of the first TDR is disengaged. FIG. 17B. Close-up of the first TDR at t=92 seconds.

FIG. 18A. Schematic of drilling and tripping system at t=95 seconds as the first TDR begins to retract from the tubular. FIG. 18B. Close-up of the first TDR at t=95 seconds.

FIG. 19A. Schematic of drilling and tripping system at t=103 seconds as the first TDR descends the derrick while the racking arm removes the stand. FIG. 19B. Close-up of the first TDR and the second TDR at t=103 seconds.

FIG. 20A. Schematic of drilling and tripping system at t=115 seconds as the second TDR pulls and rotates the tubular. FIG. 20B. Close-up of the first TDR at t=115 seconds.

FIG. 21A. Schematic of drilling and tripping system at t=129 seconds as the first TDR is back in the start position, awaiting the next tool joint. FIG. 21B. Close-up of the first TDR at t=129 seconds.

FIG. 22A. A block diagram showing one embodiment of a detailed operational sequence for the first approximately 46.5% of one cycle of drilling at 1 foot/second. FIG. 22B. A block diagram showing one embodiment of a detailed operational sequence for the last approximately 53.5% of one cycle of drilling at 1 foot/second.

FIG. 23A. Schematic of drilling and tripping system at t=1 second as the first TDR is drilling—rotating and lowering tubular and circulating mud. FIG. 23B. Close-up of the first TDR at t=1 second.

FIG. 24A. Schematic of drilling and tripping system at t=8 seconds as the stand reaches the drill floor, penetration stops and the mud valve is closed. FIG. 24B. Close-up of the first TDR at t=8 seconds.

FIG. 25A. Schematic of drilling and tripping system at t=19 seconds as the fluid connection system of the first TDR retracts and the mud bucket of the first TDR is opened. FIG. 25B. Close-up of the first TDR at t=19 seconds.

FIG. 26A. Schematic of drilling and tripping system at t=23 seconds as the racking arm inserts a new stand while the spinner and upper torque wrench of the first TDR engages. FIG. 26B. Close-up of the first TDR at t=23 seconds.

FIG. 27A. Schematic of drilling and tripping system at t=26 seconds as the spinner and upper torque wrench of the first TDR connects the new stand. FIG. 27B. Close-up of the first TDR at t=26 seconds.

FIG. 28A. Schematic of drilling and tripping system at t=30 seconds as the spinner and upper torque wrench of the first TDR disengages. FIG. 28B. Close-up of the first TDR at t=30 seconds.

FIG. 29A. Schematic of drilling and tripping system at t=34 seconds as the second TDR engages with the tubular at the top of the derrick. FIG. 29B. Close-up of the first TDR at t=34 seconds.

FIG. 30A. Schematic of drilling and tripping system at t=36 seconds as the first TDR retracts from the well center. FIG. 30B. Close-up of the first TDR at t=36 seconds.

FIG. 31A. Schematic of drilling and tripping system at t=43 seconds as the first TDR is lifted to the top of the derrick. FIG. 31B. Close-up of the first TDR at t=43 seconds.

FIG. 32A. Schematic of drilling and tripping system at t=50 seconds as the drilling continues via the second TDR. FIG. 32B. Close-up of the first TDR and the second TDR at t=50 seconds.

FIG. 33A. Schematic of drilling and tripping system at t=129 seconds as the second TDR reaches the drill floor and penetration stops. FIG. 33B. Close-up of the second TDR at t=129 seconds.

FIG. 34A. Schematic of drilling and tripping system at t=146 seconds as the second TDR disconnects while the racking arm brings in the next stand. FIG. 34B. Close-up of the second TDR at t=146 seconds.

FIG. 35A. Schematic of drilling and tripping system at t=152 seconds as the second TDR connects the new stand. FIG. 35B. Close-up of the second TDR at t=152 seconds.

FIG. 36A. Schematic of drilling and tripping system at t=162 seconds as the first TDR engages the top of the new stand. FIG. 36B. Close-up of the first TDR at t=162 seconds.

FIG. 37A. Schematic of drilling and tripping system at t=165 seconds as the first TDR picks up the weight, rotational load and engages the fluid connections system. FIG. 37B. Close-up of the first TDR at t=165 seconds.

FIG. 38A. Schematic of drilling and tripping system at t=170 seconds as the second TDR has retracted and the first TDR is drilling. FIG. 38B. Close-up of the first TDR at t=170 seconds.

FIG. 39A. Schematic of drilling and tripping system at t=175 seconds as the second TDR is raised to the top of the derrick. FIG. 39B. Close-up of the first TDR at t=175 seconds.

FIG. 40A. Schematic of drilling and tripping system at t=185 seconds as the racking arm positions the next stand. FIG. 40B. Close-up of the first TDR and the second TDR at t=185 seconds.

FIG. 41A. Schematic of drilling and tripping system at t=210 seconds as the first TDR continues to drill. FIG. 41B. Close-up of the first TDR at t=210 seconds.

FIG. 42A. Schematic of drilling and tripping system at t=250 seconds as the first TDR reaches the drill floor and the cycle repeats. FIG. 42B. Close-up of the first TDR at t=250 seconds.

FIG. 43A and FIG. 43B. A block diagram showing one embodiment of a detailed operational sequence for one cycle of removing a tubular from a riser or a cased hole at 3 feet/second without the need for fluid circulation or rotation of the tubular. At the end of the described cycle, the cycle repeats with Channel A performing the tasks done by Channel B and vice-versa. FIG. 43A. A block diagram showing one embodiment of a detailed operational sequence for the first approximately 54.8% of one cycle of removing a tubular from a riser or a cased hole at 3 feet/second without the need for fluid circulation or rotation of the tubular. FIG. 43B. A block diagram showing one embodiment of a detailed operational sequence for the last approximately 45.2% of one cycle of removing a tubular from a riser or a cased hole at 3 feet/second without the need for fluid circulation or rotation of the tubular.

The drilling and tripping system is shown at t=32 seconds as the second TDR picks up the weight and the first TDR retracts.

Figure 52:
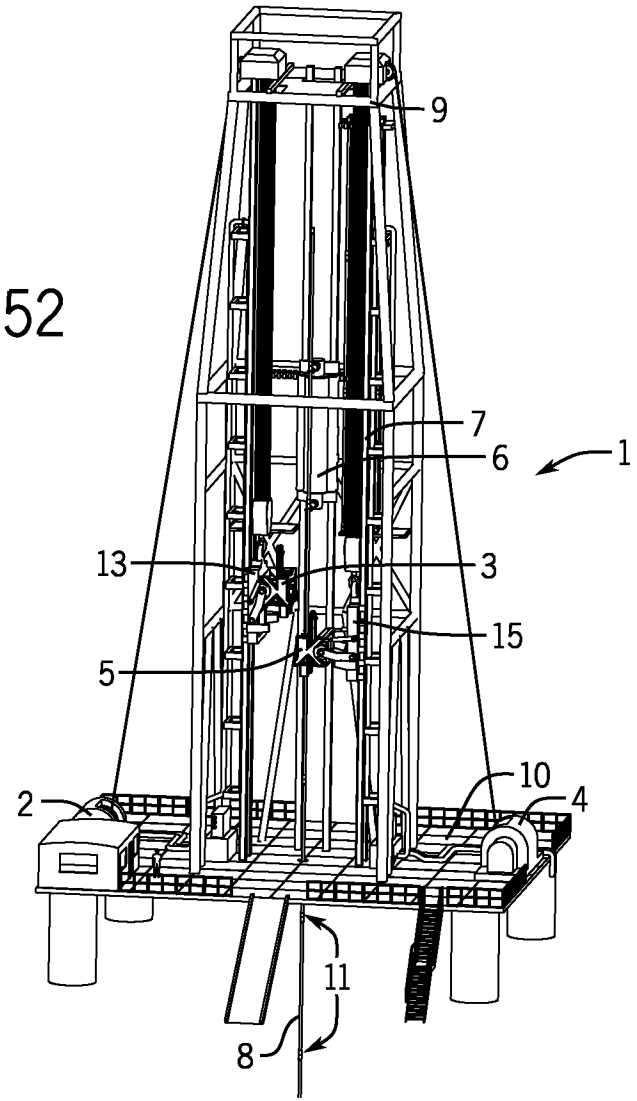

FIG. 52. A schematic representation of the drilling and tripping system shown in FIG. 1 during removal of the tubular from a hole at 3 feet/second without circulation or rotation. The drilling and tripping system is shown at t=36 seconds as the second TDR disconnects the tool joint while the first TDR descends the derrick.

Figure 53:
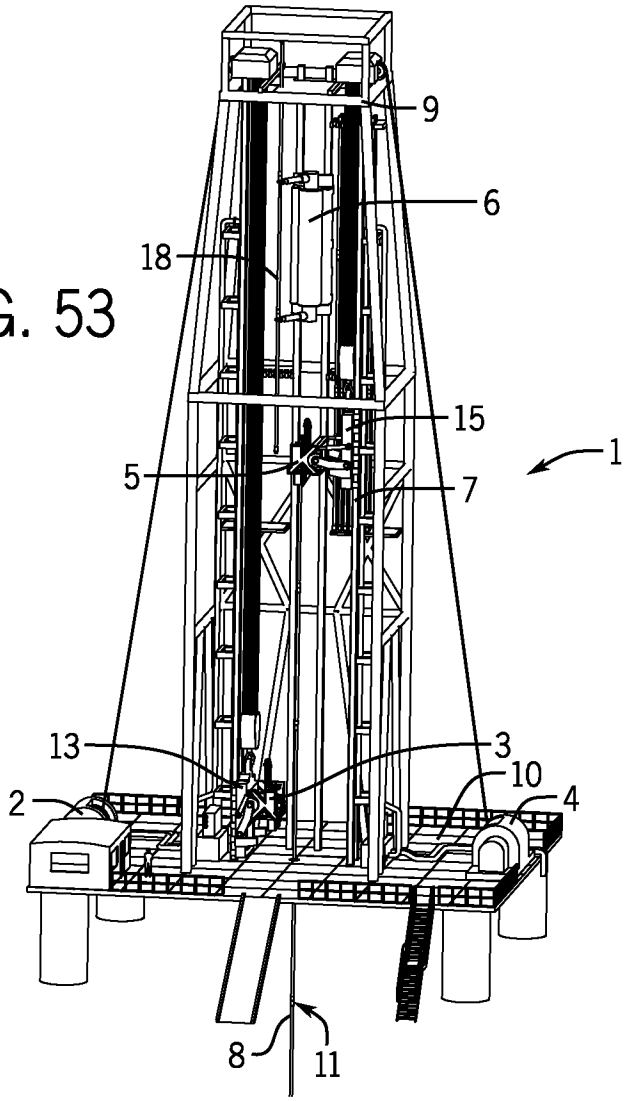

FIG. 53. A schematic representation of the drilling and tripping system shown in FIG. 1 during removal of the tubular from a hole at 3 feet/second without circulation or rotation. The drilling and tripping system is shown at t=49 seconds as the second TDR has disconnected the stand and the racking arm racks it.

Figure 54:
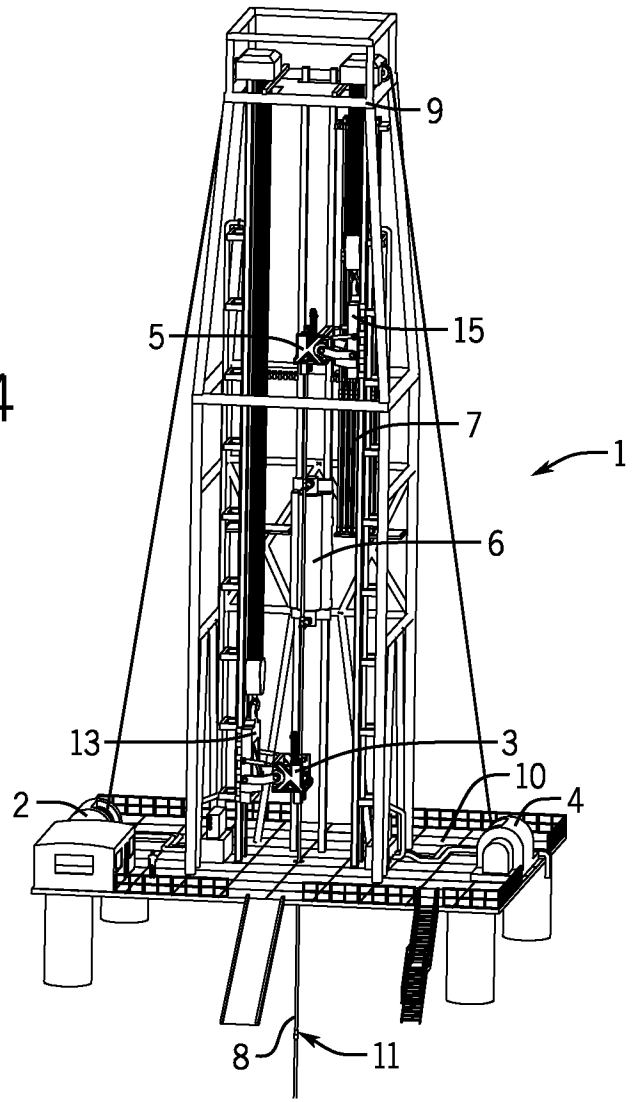

FIG. 54. A schematic representation of the drilling and tripping system shown in FIG. 1 during removal of the tubular from a hole at 3 feet/second without circulation or rotation. The drilling and tripping system is shown at t=60 seconds as the cycle repeats.

DETAILED DESCRIPTION OF THE INVENTION

The present disclosure provides a drilling and tripping equipment package and control scheme and related methods containing two or more complete systems that operate simultaneously and continuously or nearly continuously in a synchronized manner such that the feeding of tubulars into or out of a well bore is achieved with continuous or nearly continuous movement, without the need for periodic interruptions. The drilling and tripping equipment package and control scheme is also able to rotate the tubulars in the well bore with continuous speed and torque sufficient for both drilling and back-reaming operations. The drilling and tripping equipment package and control scheme is additionally able to circulate drilling fluid into the internal bore of the tubulars with sufficient pressure and flow to facilitate both drilling and back-reaming operations, with minimal interruption to circulation.

As detailed herein, the systems and methods shown and described may be used to automatically control operations and activities in connection with drilling an oil or gas well such that continuous or near continuous operations are achieved. In addition, the integrated control system allows for user input of drilling parameters that may be desired for operation of the system, as well as control of operations based on data relating to ongoing drilling or tripping operations and/or data relevant to drilling or tripping operations that may be stored in memory associated with the control system. The integrated control system alternatively can be used to follow some or all preset parameters and information that it is programmed to follow. The integrated control system thus allows an operator to modify or customize the operations of the integrated control system and the overall system, such as by allowing the operator to specify additional parameters that may indicate an unsafe condition that are an operator preference or are applicable to a given well but not necessarily to other wells or applications. Moreover, the integrated control system and its database can be used to store a wide variety of data regarding drilling activities and operations, wellbore conditions, drilling parameters and the like, which can then be used to evaluate the operations and the well, and to plan one or more other wells and the operations and activities relevant thereto.

Figure 1:
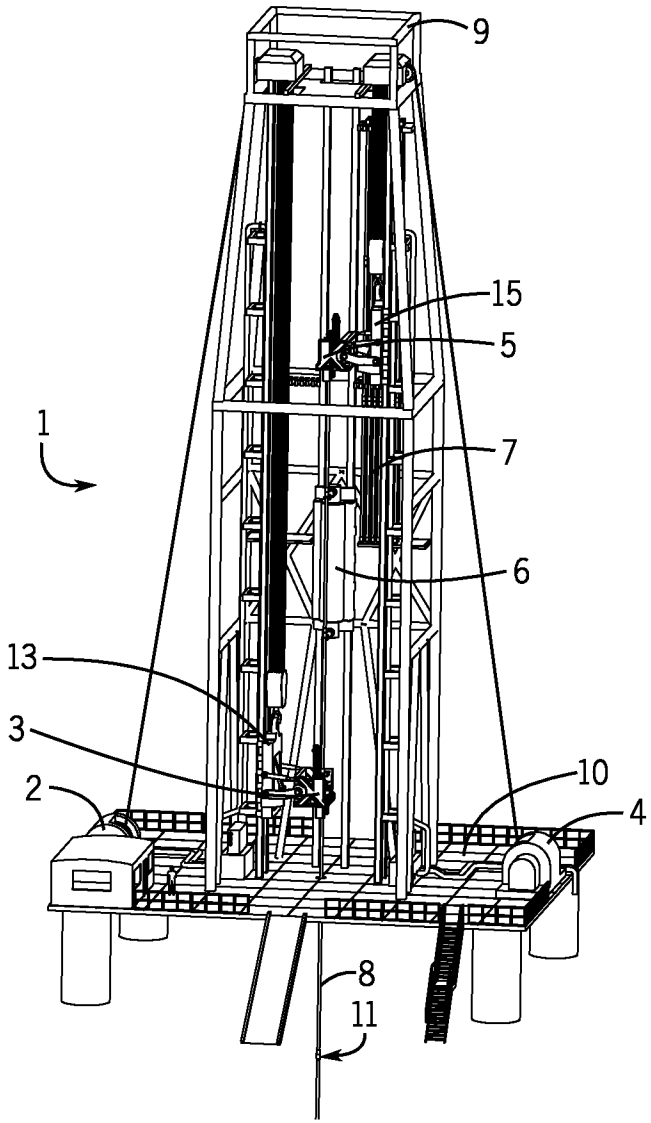
FIG. 1. A schematic representation of one embodiment of a disclosed drilling and tripping system.

Referring now to FIG. 1, a schematic representation of one embodiment of a disclosed drilling and tripping system 1 is shown. In this particular embodiment, drilling and tripping system 1 includes a first drawworks 2 (also referred to herein as drawworks A), a first traveling differential roughneck 3, which is mounted on a first moving dolly 13, a second drawworks 4 (also referred to herein as drawworks B), a second traveling differential roughneck 5, which is mounted on a second moving dolly 15, a racking arm 6, pipe rack 7, tubular 8, and tool joint 11. Also shown in FIG. 1 is a derrick 9 and the drill floor 10 of the derrick 9.

The disclosed drilling and tripping system includes two or more coordinated, automatically controlled lifting systems capable of lifting and/or lowering the rated weight of the tubulars, with any required overpull and safety factors. In the embodiment of the drilling and tripping system shown in FIG. 1, this lifting system is a traditional drawworks (winch), although in other embodiments (not shown) the lifting system can be a hydraulic ram, a rack and pinion system, a high load linear motor, or any other device capable of lifting the required weight. The embodiment of the drilling and tripping system shown in FIG. 1 includes a first drawworks 2 and a second drawworks 4.

The disclosed drilling and tripping system also includes two or more coordinated, automatically controlled retractable tools mounted on moving dollies and lifted/lowered by the aforementioned lifting system. This tool is generally referred to as a traveling differential roughneck, or TDR. As depicted in FIG. 1, the drilling and tripping system includes a first TDR 3 (also referred to herein as TDR-A) and a second TDR 5 (also referred to herein as TDR-B). The TDR implements numerous functions, including attaching the lifting device to the tubulars, allowing it to be lifted and lowered while rotating, rotating the tubulars for drilling and back-reaming operations, making and breaking joints between stands of tubular, containing and returning excess drilling fluid to the drilling fluid system, aligning and connecting stands of tubular while the tubular is rotating and in continuous vertical motion, disconnecting and removing stands while the tubular is rotating and in continuous vertical motion, connecting the high pressure and flow drilling fluid system into the tubular to allow near continuous fluid flow as stands are added and removed from the tubular. Thus, the TDR carries the weight of the drilling tubular or drillstring in a manner that allows free rotation, rotates the drilling tubular with sufficient torque for drilling and back-reaming operations, makes-up and breaks-out tool joints in the tubular, connects and disconnects stands of tubular into and out of connection with existing stands, captures drilling fluid that egresses from the tubular at different points in the operating cycle, cleans and pre-treats tubular threads, and couples the circulating drilling fluid into the tubular for drilling and back-reaming operations. As detailed herein, all of the functions of the TDR may be carried out as the tubular is in continuous rotation and vertical motion.

The bottom part of the TDR includes a rotating elevator bowl (REB; not visible in FIG. 1; see, for example, REB 19 in FIG. 23B and REB 29 in FIG. 33B) that functions to carry the weight of the drilling tubular in such a manner that the tubular is free to rotate. The weight of the tubular is carried on the bottom shoulder of the tool joint. The major components of the REB are: a main body that carries the tubular weight back to the TDR main frame; a bowl that is free to rotate, supported by a thrust bearing wherein the bearing elements are not free to precess as the bowl rotates; an aligned radial opening (termed the "throat") in the main body, the bowl, and the thrust bearing that allows the REB to engage on and off the tubular from the side of the derrick; a "pony" motor (electrical or hydraulic) that is able to rotate the bowl when disconnected from the tubular to allow for alignment of the throat between the bowl and the main body; and sensors to indicate the alignment of the bowl throat with the body throat.

The TDR also includes a lower rotating torque wrench (LTW; not visible in FIG. 1; see, for example, FIG. 23B), which is an electrically or hydraulically powered wrench that engages on the bottom half of the tool joint and is used to rotate the tubular for all drilling operations. The major components of the LTW are: a ring gear with a "gate" that may be opened to create a throat allowing the wrench to engage and disengage the tubular in the horizontal axis (when this "gate" is closed the ring gear is a complete 360° gear ring): one or more motor(s) (hydraulic or electrical) for driving pinion gears that are coupled to the ring gear (the power and speed ratings of these motors, together with the gear ratio of the ring and pinion gears is determined based on the torque and speed requirements of the drilling application); and a plurality of cam locked jaws that can be coupled and uncoupled from the tubular.

The TDR also includes an upper rotating torque wrench (UTW; not visible in FIG. 1; see, for example, FIG. 26B), which is hydraulically powered wrench that engages on the top half of the tool joint and is used to connect and disconnect tool joints in the tubular. Unlike the LTW, the UTW either rotates at zero torque, or makes small incremental movements at high torque, hence its power requirements are much smaller than the LTW. In addition, unlike the LTW, it is necessary to allow the UTW to be retracted from the tool joint in order to allow the mud bucket to engage during spinner and fluid connection operations. Notwithstanding the difference in power rating and the need for retraction, the main components of the UTW are the same as the LTW.

The TDR also includes a spinner (not visible in FIG. 1; see, for example, FIG. 7B), which is a hydraulically or electrically powered device for rapid rotation of stands of tubular during connection and disconnection. The spinner operates after the UTW has "broken" the joint in "pulling out of hole" operations and before the UTW "makes" the joint in "going into hole" operations. In addition, the TDR also includes a mud bucket (MB; not visible in FIG. 1; see, for example, FIG. 9B), which is a two part mud container that closes around the tool joint whenever the egress of drilling fluid is expected. The MB is provided with a suitable vacuum pipe that is able to extract the drilling fluid at its maximum egress rate and return it to the fluid handling system. Also, the MB may have the necessary detergent and air systems to clean drilling fluid from threads that are about to be connected. Additionally, the MB may incorporate a system for dispensing "pipe dope" onto threads that are about to be connected.

The TDR also includes a fluid connection system (FCS; not visible in FIG. 1; see, for example, FIG. 12B and FIG. 25B), which is a retractable quick connect system for connecting the drilling fluid into the top of the drilling tubular during drilling and back-reaming operations, and utilizes similar technology to an inflatable packer. The FCS includes a rotating coupling to allow the tubular to rotate freely, and is rated for suitable pressure and flow for drilling and back-reaming operations. The FCS is equipped with one or more valves for sealing the line from the mud pumps and Drilling Fluid Divert System (FDS; not visible in FIG. 1) as needed during drilling operations. The FDS is an additional series of valves between the mud pumps and the first and second TDR due to the need to rapidly divert drilling fluid to the first TDR, the second TDR, or to neither TDR. The FDS allows drilling fluid to be routed to either the first TDR, the second TDR, or to circulate back to the mud tanks without stopping the mud pumps.

The disclosed drilling and tripping system also includes one or more pipe handling and storage systems that allows stands of drill pipe to be moved from the well center to suitable storage rack(s) as they are disconnected from the drill string and disengaged from the TDR, and to move them back to well center as they engage with the TDR. All of these actions are carried out with the tubular in constant rotation and vertical motion. As depicted in FIG. 1, the main component of this system is a racking arm 6, and also includes a pipe rack 7, although in other in other embodiments (not shown) additional racking arm(s) and/or pipe racks can be included.

The disclosed drilling and tripping system also includes a drilling fluid diverting system (not visible in FIG. 1; see, for example, FIG. 14B and FIG. 37B) that allows drilling fluid to be directed to either the first TDR 3 or the second TDR 5, or to be re-circulated to the mud system (not shown) without stopping the mud pumps (not shown).

Figure 2:
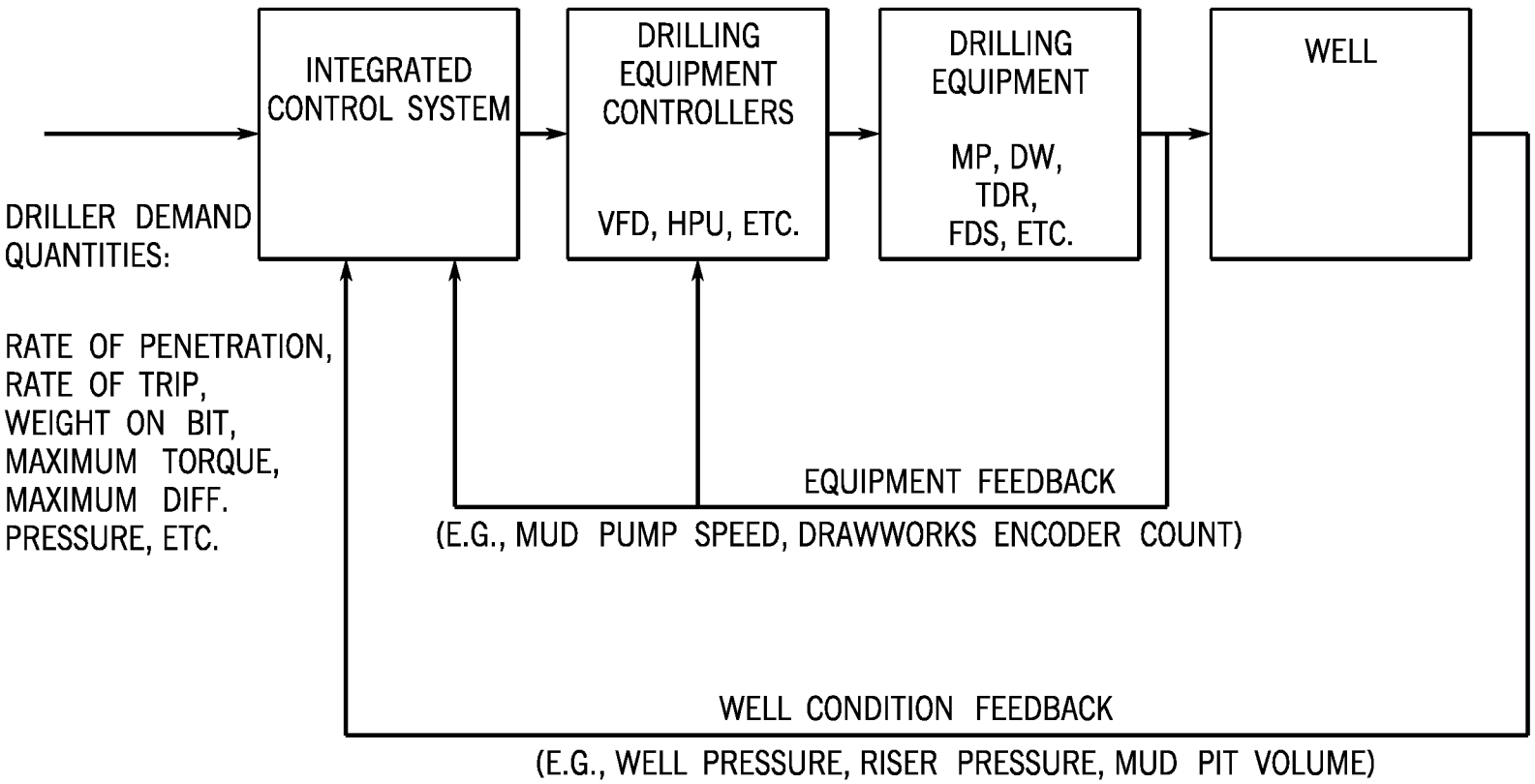
FIG. 2. A block diagram of one embodiment of a concept of an integrated control system.
Figure 3:
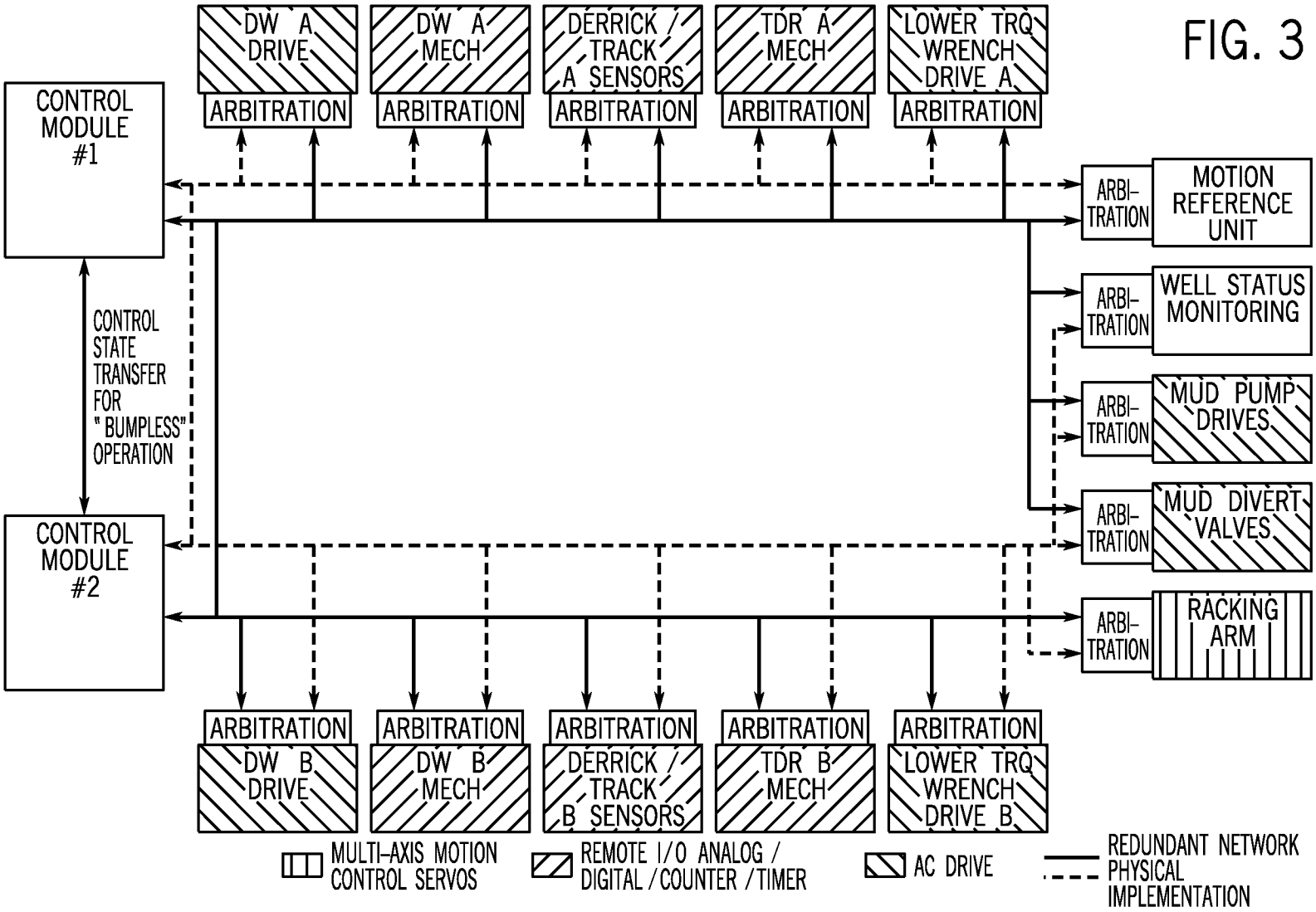
FIG. 3. A block diagram of one embodiment of an integrated control system top level hardware.

The disclosed drilling and tripping system also includes an integrated redundant control system (FIG. 2), with numerous sensors and actuators that can be used to control all of the above sub-systems in a synchronized manner to facilitate continuous or nearly continuous operation in both tripping and drilling modes of operation. This is generally referred to herein as the Integrated Control System or ICS. The ICS is a redundant digital controller that can be programmed to have and exert control over all functions of the drilling equipment. Alternatively, the ICS can be programmed to control only certain aspects of operations if that should be deemed desirable. Additionally, the ICS is integrated with all of the drive systems used in the drilling process (drawworks, mud pumps, torque wrenches, etc.) to allow for fully automated operation. The ICS is additionally provided with sensor information for monitoring various well parameters to allow for automatic control of such things as tripping speeds and rate of penetration based on well conditions. The ICS may also be provided with signals from motion feedback devices to allow active heave control to be incorporated into the automatic drilling process. The main components of the ICS are an integrated array of control modules, connected via redundant networks to all necessary input/output nodes to actuate all machinery and read all sensors. The hardware will comply with (or exceed) Safety Integrity Level 3, as per IEC 61508 (FIG. 3).

In the ICS, two or more control modules operate in a redundant mode with "bumpless" transfer between active and standby controller. There are several suitable physical implementations of the control module, including, but not limited to, a high performance industrial programmable logic controller, such as a high performance industrial PC, a high performance single board computer, etc. The requirements for the control module include sufficient processing capability to perform all necessary control algorithms within a suitable time period, sufficient network connectivity to connect with sufficient bandwidth and low enough latency to all the other nodes on the system (see discussion on network below), including connection to other control modules in the redundant array, and availability of suitable programming tools to allow the control system to be implemented in a manner suitable for industrial control and automation applications.

The ICS also includes two or more network physical layers with redundant operation. Depending on the required bandwidth and latency, the network may use a "multi-drop" or "star" topology, or a combination with each network spur being multi-dropped to a reduced number of nodes. There are several suitable physical implementation of the redundant network, including, but not limited to, Process Field Bus (PROFIBUS) or Ethernet-based (Modbus TCP, EtherCAT, ProfiNET). The requirements for the network are sufficient bandwidth and low enough latency to exchange all required data within time periods consistent with the required dynamic response of all control sequences and closed-loop control functions, deterministic timing to allow all sequence response times and closed-loop performances to be ascertained, rugged physical implementation consistent with the oilfield environment of operation, rugged electrical characteristics (ESD, EMC, etc.) consistent with the oilfield environment of operation, and adequate data protection and/or data redundancy to ensure operation of the system is not compromised by data corruption.

Table 1 describes the Control Nodes:

TABLE 1

| Control Node | Description |
|---|---|
| Drawworks Drive (A & B) | These are the drives (assumed to be AC variable frequency drives) that drive the two drawworks on the system |
| Drawworks Machine (A & B) | Additional actuators and sensors for the drawworks machinery (e.g., drum encoders, brake pressure sensors, etc.) |
| Derrick Track Sensors (A & B) | Sensors from the derrick tracks for such things as motion limit switches |
| Lower Torque Wrench Drive (A & B) | Drives for the lower torque wrenches. These can be Hydraulic Power Units if the torque wrench motors are hydraulic, or AC variable frequency drives if they are AC motors) |
| TDR (A & B) | Sensors and actuators for all the equipment physically located on the TDR |
| Mud Pump Drives | AC variable speed drives for the mud pumps |
| Mud Divert Valves | Sensors and actuators for the mud flow control valves needed to route drilling fluid to the first TDR, the second TDR or to bypass flow to the mud tanks. This includes mud pit level sensors |
| Racking Arm Motion Controller | Multi-axis motion controller for sequencing the complex movements of the racking arm (and other components in the pipe handling system) This controller is assumed to interface to all the sensors and actuators required in the pipe handling system |
| Well Status Monitoring | A number of sensors that provide real time data to the ICS to allow drilling operations to be automated—e.g. well pressure sensors, marine riser pressure |
| Motion Reference Unit | Provides multi-dimensional position, velocity and acceleration feedback to allow for active heave control systems to be implemented in the ICS |

Regarding the ICS data description, each of the nodes on the networks of the ICS exchange sensor feedback and/or actuator control signals with the control modules. Table 2 details the information that is required to be exchanged for each of the main nodes on the networks.

TABLE 2

| Network Node | Sensor Information Sent to Control Modules | Actuator Information Received from Control Modules |
|---|---|---|
| Drawworks Drive (A & B) | Motor torque(s)<br>Motor speed<br>Motor encoder count(s)<br>Enable status<br>Health status | Enable command<br>Speed reference<br>Torque limit<br>Torque offset<br>Speed droop |
| Drawworks Machine (A & B) | Brake status<br>Drum encoders | Brake control |
| Derrick Track Sensors (A & B) | TDR carriage motion limit switches | |
| Lower Torque Wrench Drive (A & B) | Motor torque(s)<br>Motor speed<br>Motor encoder count(s)<br>Enable status<br>Health status | Enable command<br>Speed reference<br>Torque limit<br>Torque offset<br>Speed droop |
| TDR (A & B) | Extended limit switch<br>Retracted limit switch<br>REB alignment sensor<br>LTW ring gear alignment sensor<br>LTW "gate" position sensor<br>LTW jaws engaged sensor<br>UTW retracted/extended limit switches<br>UTW ring gear alignment sensor<br>UTW "gate" position sensor<br>UTW jaws engaged sensor<br>UTW Torque sensor<br>MB open/closed limit switches<br>MB vacuum pressure feedback<br>MB fluid presence sensor<br>Spinner retracted/engaged limit switches<br>Spinner rotation counter<br>FCS retracted/extended limit switches<br>FCS disengaged/engaged limit switches<br>FCS sealed limit switches<br>FCS valve status limit switches | Enable rotary elevator bowl pony motor<br>Extend/retract command for TDR carriage<br>LTW gate control command<br>LTW jaw engage command<br>UTW retract/engage command<br>UTW "gate" control command<br>UTW motor command<br>UTW jaw engage command<br>MB open/close command<br>MB vacuum on/off command<br>Spinner engage/retract command<br>Spinner rotate/direction commands<br>FCS extend/retract command<br>FCS engage/disengage command<br>FCS seal commands<br>FCS valve control command |
| Mud Pump Drives | Motor torque(s)<br>Motor speed<br>Enable status<br>Health status | Enable command<br>Speed reference<br>Torque limit |
| Mud Divert Valves | Position feedback (Closed, A, B, Divert)<br>Mud level sensors | Position demand (Closed, A, B, Divert) |

TABLE 2-continued

| Network Node | Sensor Information Sent to Control Modules | Actuator Information Received from Control Modules |
|---|---|---|
| Racking Arm Motion Controller | Motion status e.g.:<br>moving pos1→pos2<br>in pos1<br>Health status | Motion commands, e.g.:<br>Move to next pos<br>Enable command |
| Well Status Monitoring | Well head pressure<br>Riser pressure | BOP<br>Diverter |
| Motion Reference Unit | Six axis acceleration<br>Six axis velocity<br>Six axis position | Integration control signals |

In one embodiment, the ICS is programmed to have direct control over the following functions: the rate of lowering/raising the lifting mechanisms (e.g., the drawworks); the rate of rotation of the tubular; the rate of spinner rotation during connection and disconnection of the tubular; connection and disconnection of the FCS, including the drilling fluid control valves on the TDR; movements of the racking arm and other pipe handling equipment; forces applied by the racking arm to stands of tubular as they are added and removed from the drilling tubular; drawworks control parameters during drilling—"Weight on Bit" and/or "Rate of Penetration"; drawworks control parameters during active heave compensation, in both "Fixed to Bottom" and "Non-Fixed to Bottom" modes (and during mode transitions); mud pump speed; and the FDS.

The ICS is capable of operating with normal driller inputs for traditional drilling controls (e.g., Weight on Bit, Rate of Penetration, Rate of Trip, etc.). Additionally, the ICS is able to determine optimal settings for these parameters based upon well condition monitoring (e.g., fluid pressure, rate of mud addition), with operator set parameters serving as upper limits. The ICS also implements functions such as active heave compensation and collision avoidance. Since the ICS has direct control over all drilling equipment, and is provided with all available feedback data from the well, additional capabilities can be added as the science and technology of oil well drilling advances. In its fully developed implementation, the ICS will trip, drill and ream wells in a fully automated, intelligent, adaptive manner, basing all its decisions on data measured directly from the well.

There are numerous specific operational sequences that are required under different phases and conditions of the drilling process. The operational sequences for three typical scenarios are detailed below. The first scenario is removing a tubular from a hole with continuous rotation and near continuous mud circulation, the second scenario is drilling, and the third scenario is removing a tubular from a riser or a cased hole at maximum speed without the need for fluid circulation or rotation of the tubular. At the end of each of the described cycles, the cycle repeats with Channel A performing the tasks done by Channel B and vice-versa. The skilled artisan will readily appreciate that numerous other scenarios are applicable using the present disclosure, although most other scenarios are generally simplifications or combinations of the sequences of these three scenarios.

Removing Tubular with Continuous Rotation and Near Continuous Mud Circulation

Figures 1, 4B:
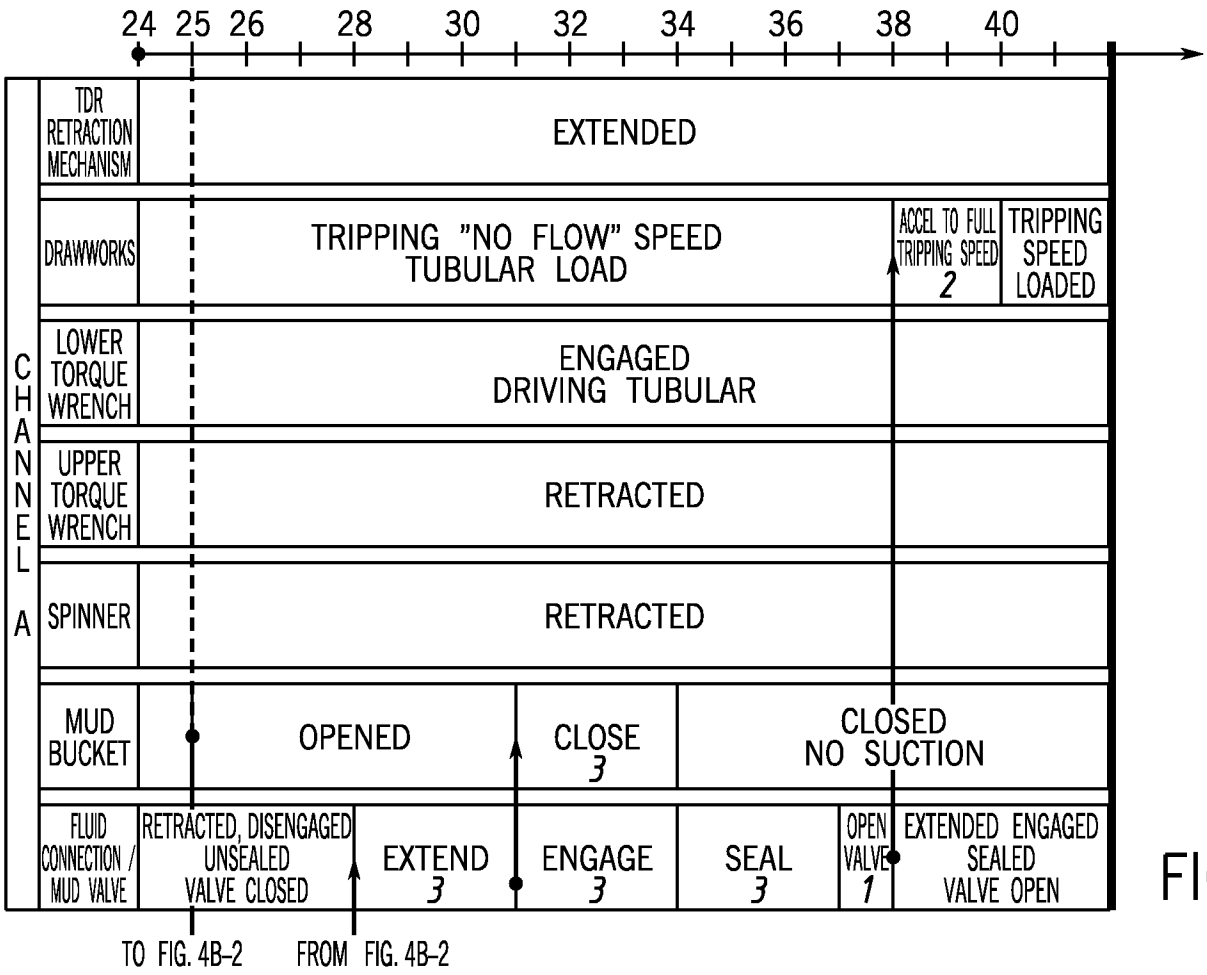
Figures 2, 4B:
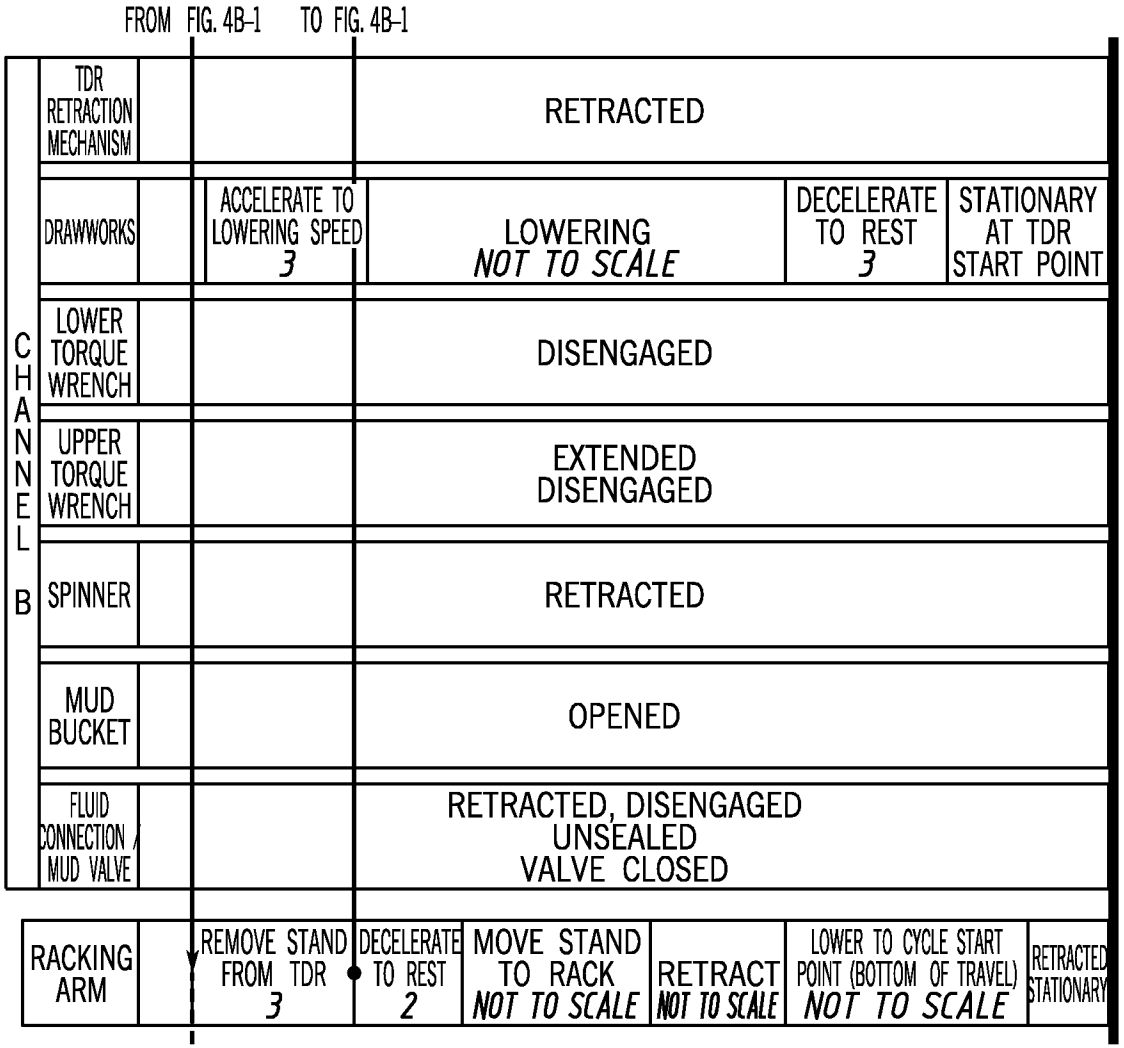
Figure 5A:
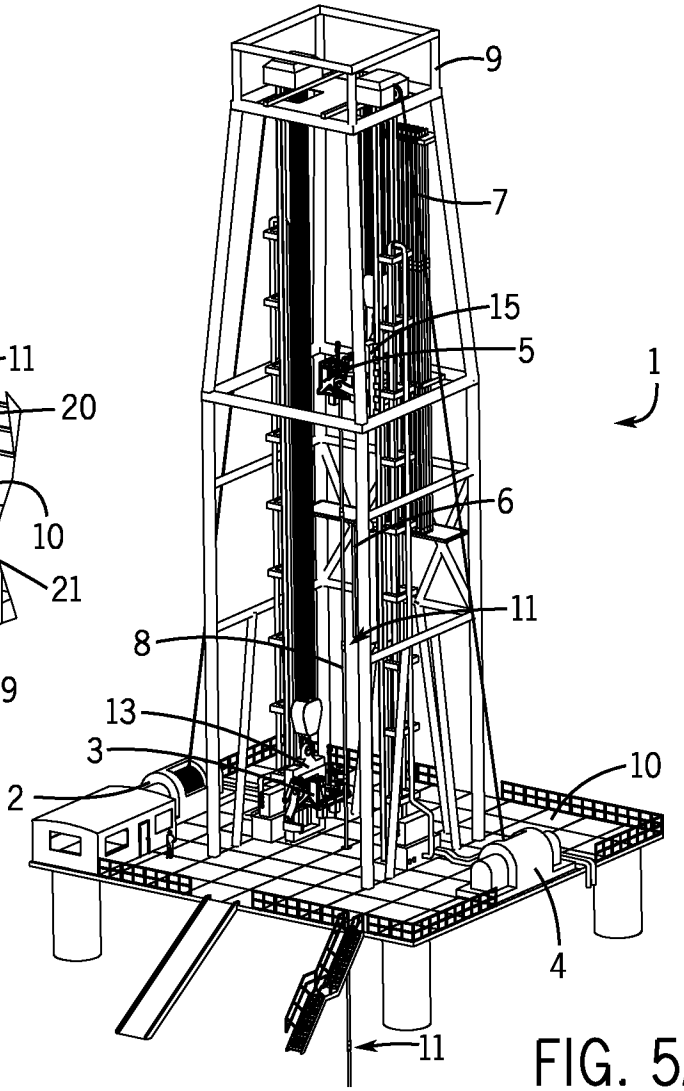
FIG. 5A and FIG. 5B. A schematic representation of the drilling and tripping system shown in FIG. 1 during removal of tubular from a hole at 1 foot/second with continuous rotation and near continuous mud circulation.
Figure 5B:
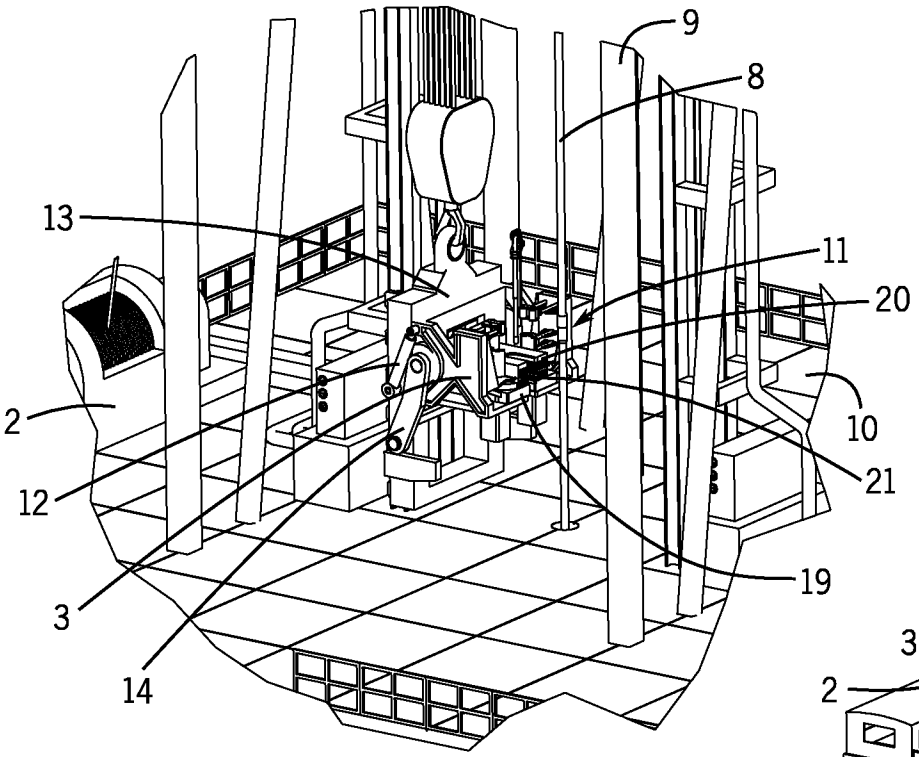

FIG. 4A and FIG. 4B shows the detailed operational sequence of one cycle for removing a tubular from a hole at 1 foot/second with continuous rotation and near continuous mud circulation. FIGS. 5 through 21 provide "snapshots" of one embodiment of a presently disclosed drilling and tripping system as it completes two cycles of the operational sequence shown in FIG. 4A and FIG. 4B. Referring to FIG. 5A, which is a schematic of one embodiment of a drilling and tripping system 1 is shown at t=0 seconds just before the first TDR 3 extends and engages the tubular 8 below the tool joint 11. Like features and elements in the drawings have the same numerals in the various figures. Shown in FIG. 5A are first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 5B, which shows a close-up view of the first TDR 3 at t=0 seconds. Shown in FIG. 5B are portions of the derrick 9 and drill floor 10, first drawworks 2, first TDR 3, first moving dolly 13, tubular 8, tool joint 11, and piston 12 and pivot arm 14, which are retracted and attached to the first TDR 3 and the first moving dolly 13. Features of the first TDR 3 that are visible include UTW 20 and LTW 21.

Figure 6A:
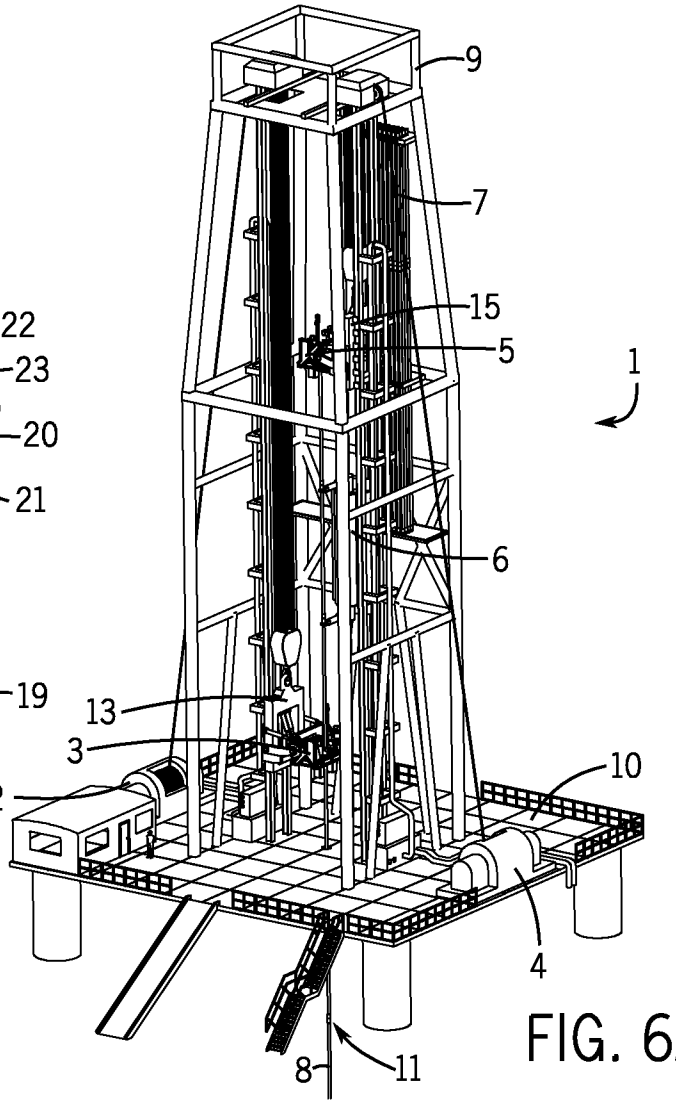
FIG. 6A and FIG. 6B. A schematic representation of the drilling and tripping system shown in FIG. 1 during removal of tubular from a hole at 1 foot/second with continuous rotation and near continuous mud circulation.
Figure 6B:
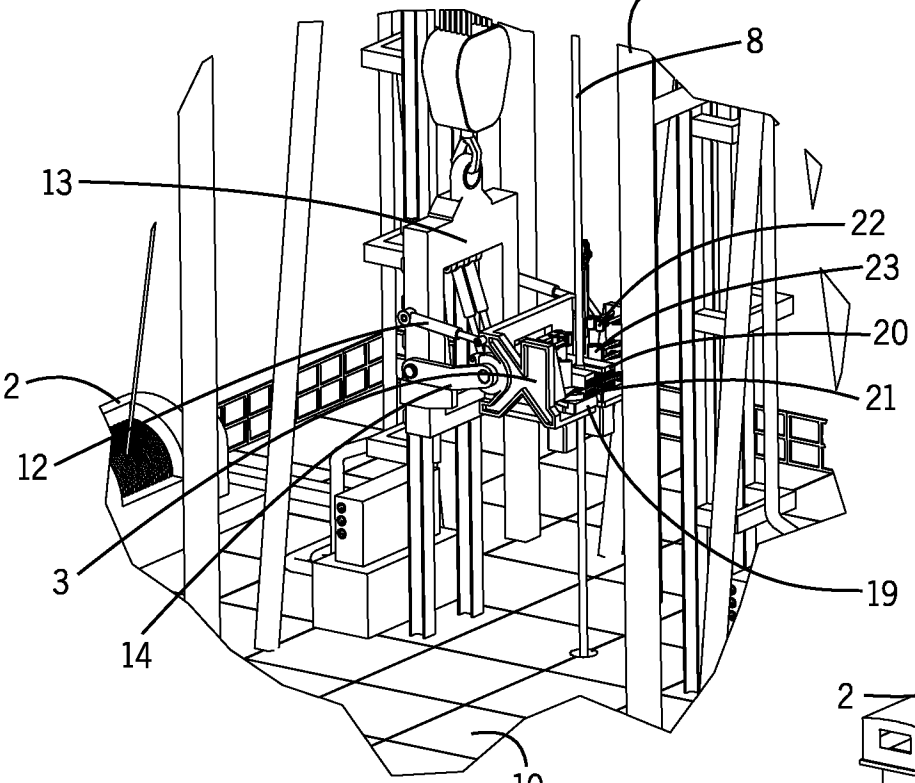

Referring now to FIG. 6A, which is a schematic of one embodiment of a drilling and tripping system 1 at t=5 seconds as the spinner 22 of the first TDR 3 extends to engage the tubular 8. Shown in FIG. 6A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 6B, which shows a close-up view of the first TDR 3 at t=5 seconds. Shown in FIG. 6B are portions of the derrick 9 and drill floor 10, first drawworks 2, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, and mud bucket 23.

Figure 7A:
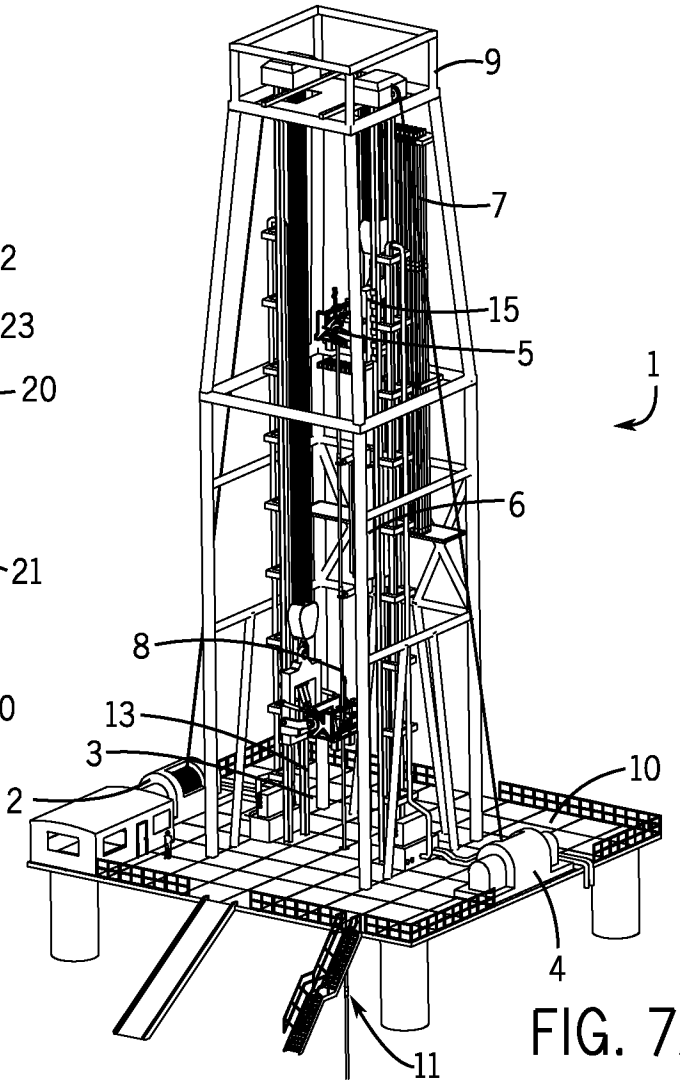
FIG. 7A and FIG. 7B. A schematic representation of the drilling and tripping system shown in FIG. 1 during removal of tubular from a hole at 1 foot/second with continuous rotation and near continuous mud circulation.
Figure 7B:
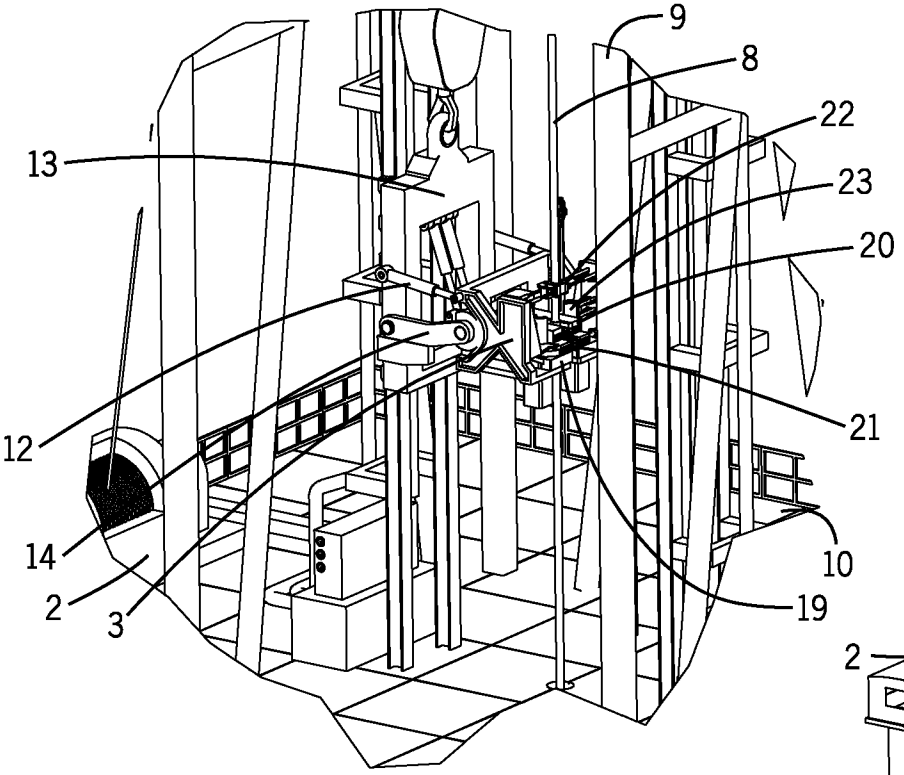

Referring now to FIG. 7A, which is a schematic of one embodiment of a drilling and tripping system 1 at t=11 seconds as the UTW 20 of the first TDR 3 retracts. Shown in FIG. 7A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 7B, which shows a close-up view of the first TDR 3 at t=11 seconds. Shown in FIG. 7B are portions of the derrick 9 and drill floor 10, first drawworks 2, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, and mud bucket 23.

Figure 8A:
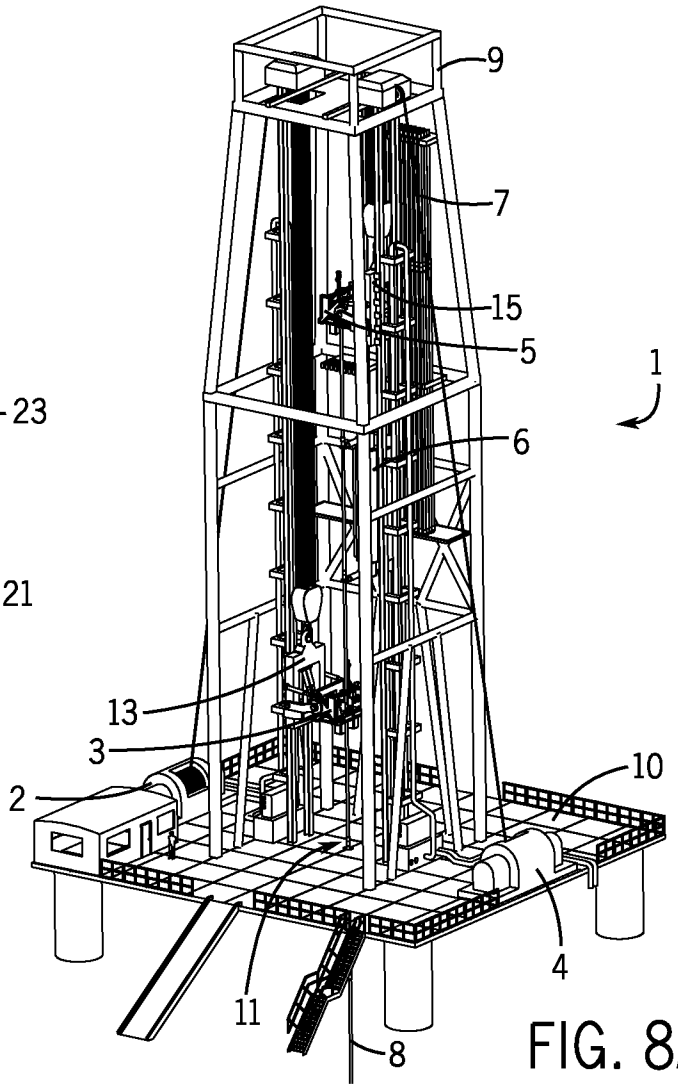
FIG. 8A and FIG. 8B. A schematic representation of the drilling and tripping system shown in FIG. 1 during removal of tubular from a hole at 1 foot/second with continuous rotation and near continuous mud circulation.
Figure 8B:
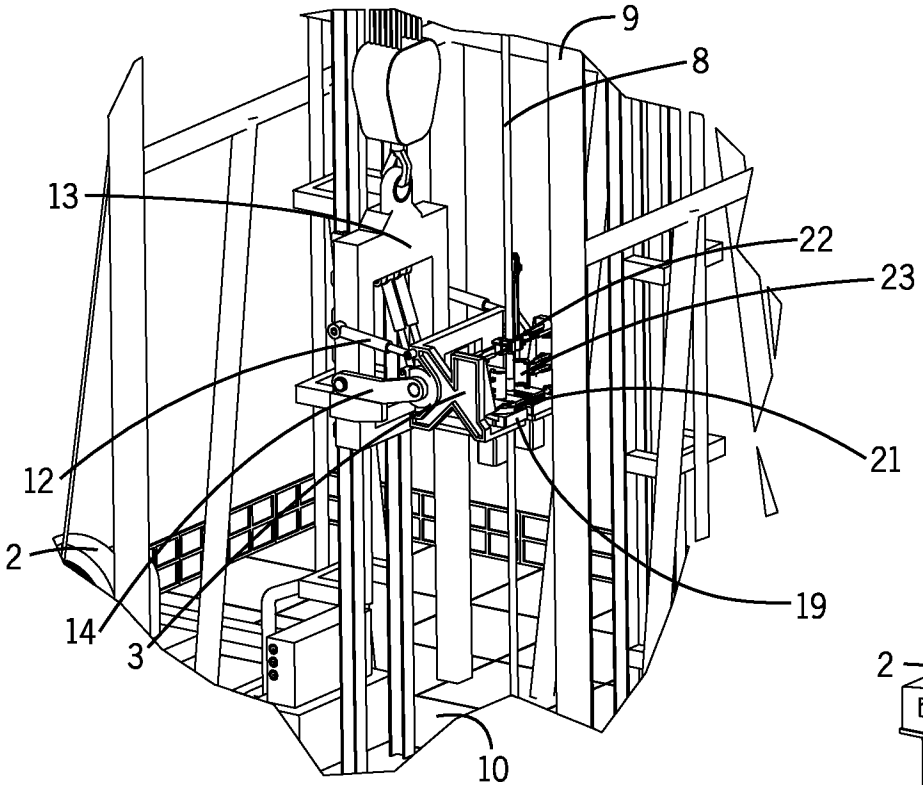

Referring now to FIG. 8A, which is a schematic of one embodiment of a drilling and tripping system 1 at t=14 seconds as the mud bucket 23 of the first TDR 3 closes. Shown in FIG. 8A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 8B, which shows a close-up view of the first TDR 3 at t=14 seconds. Shown in FIG. 8B are portions of the derrick 9 and drill floor 10, first drawworks 2, first TDR 3, first moving dolly 13, tubular 8, and piston 12 and pivot arm 14, which are extended and attached to the first TDR 3 and the first moving dolly 13. Features of the first TDR 3 that are visible include LTW 21, spinner 22, and mud bucket 23.

Figure 9A:
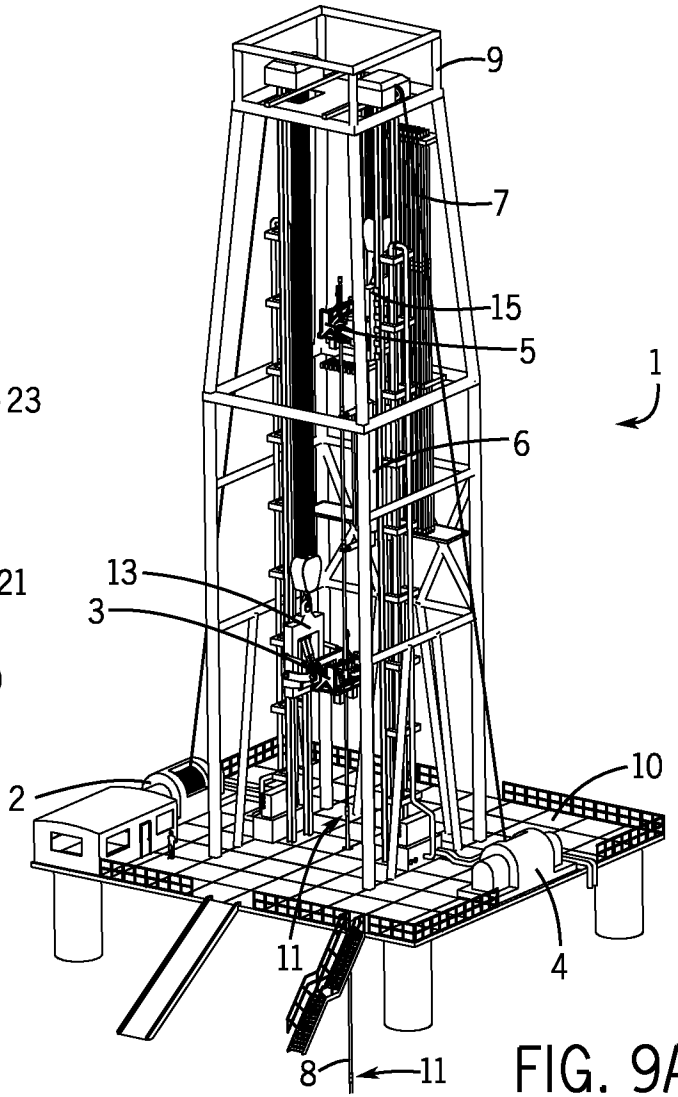
FIG. 9A and FIG. 9B. A schematic representation of the drilling and tripping system shown in FIG. 1 during removal of tubular from a hole at 1 foot/second with continuous rotation and near continuous mud circulation.
Figure 9B:
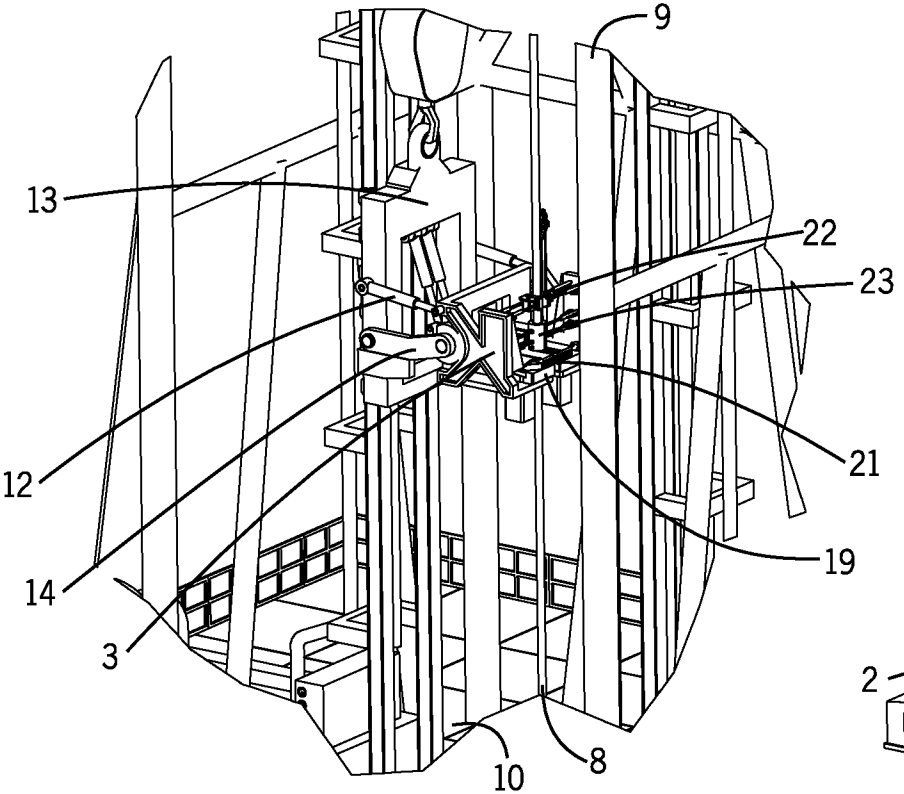

Referring now to FIG. 9A, which is a schematic of one embodiment of a drilling and tripping system 1 at t=19 seconds as the mud bucket 23 of the first TDR 3 extracts mud as the spinner 22 disconnects the tubular 8. Shown in FIG. 9A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 9B, which shows a close-up view of the first TDR 3 at t=19 seconds. Shown in FIG. 9B are portions of the derrick 9 and drill floor 10, first TDR 3, first moving dolly 13, tubular 8, and piston 12 and pivot arm 14, which are extended and attached to the first TDR 3 and the first moving dolly 13. Features of the first TDR 3 that are visible include LTW 21, spinner 22, and mud bucket 23.

Figure 10A:
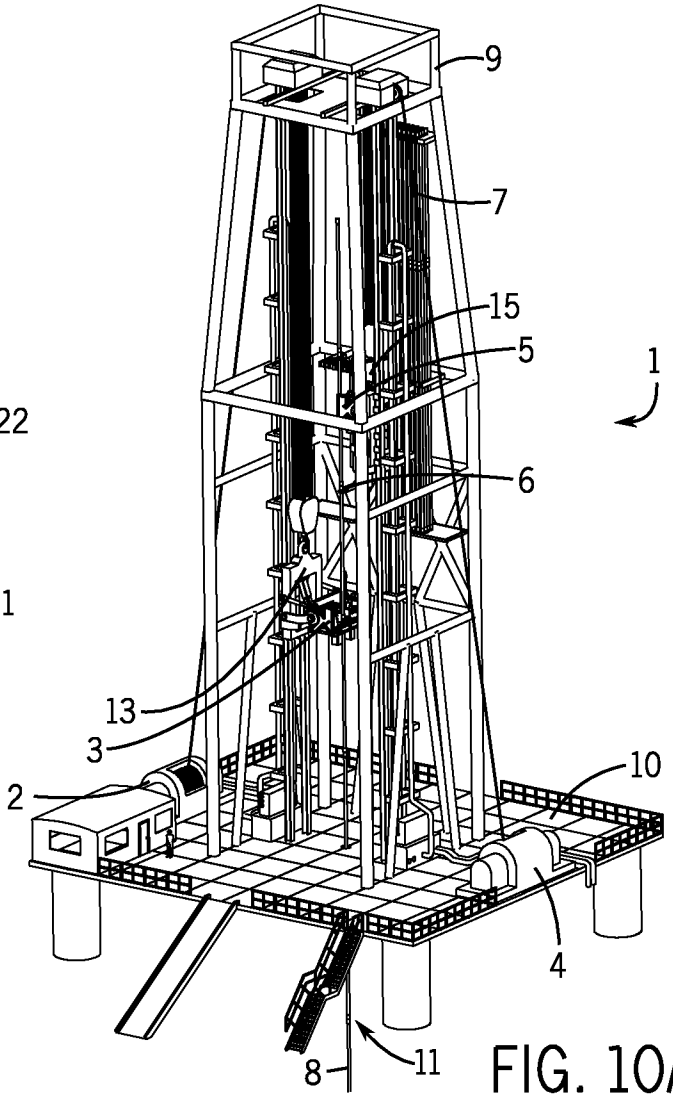
FIG. 10A and FIG. 10B. A schematic representation of the drilling and tripping system shown in FIG. 1 during removal of tubular from a hole at 1 foot/second with continuous rotation and near continuous mud circulation.
Figure 10B:
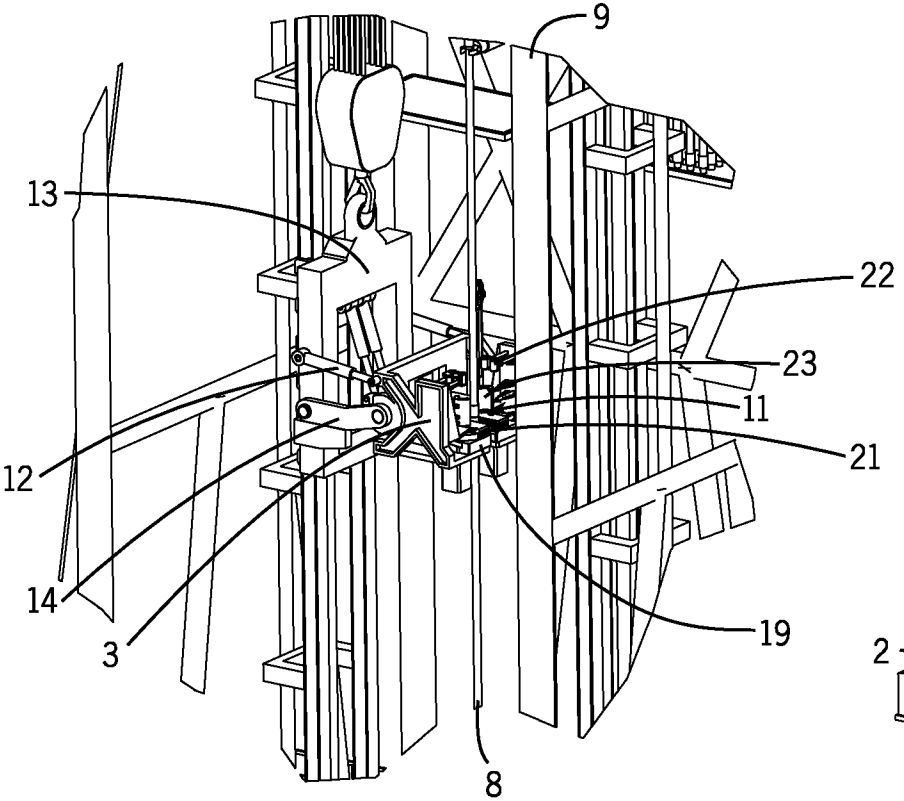

Referring now to FIG. 10A, which is a schematic of one embodiment of a drilling and tripping system 1 at t=24 seconds as the mud bucket 23 of the first TDR 3 retracts. Shown in FIG. 10A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 10B, which shows a close-up view of the first TDR 3 at t=24 seconds. Shown in FIG. 10B is a portion of the derrick 9, first TDR 3, first moving dolly 13, tubular 8, tool joint 11, and piston 12 and pivot arm 14, which are extended and attached to the first TDR 3 and the first moving dolly 13. Features of the first TDR 3 that are visible include LTW 21, spinner 22, and mud bucket 23.

Figure 11A:
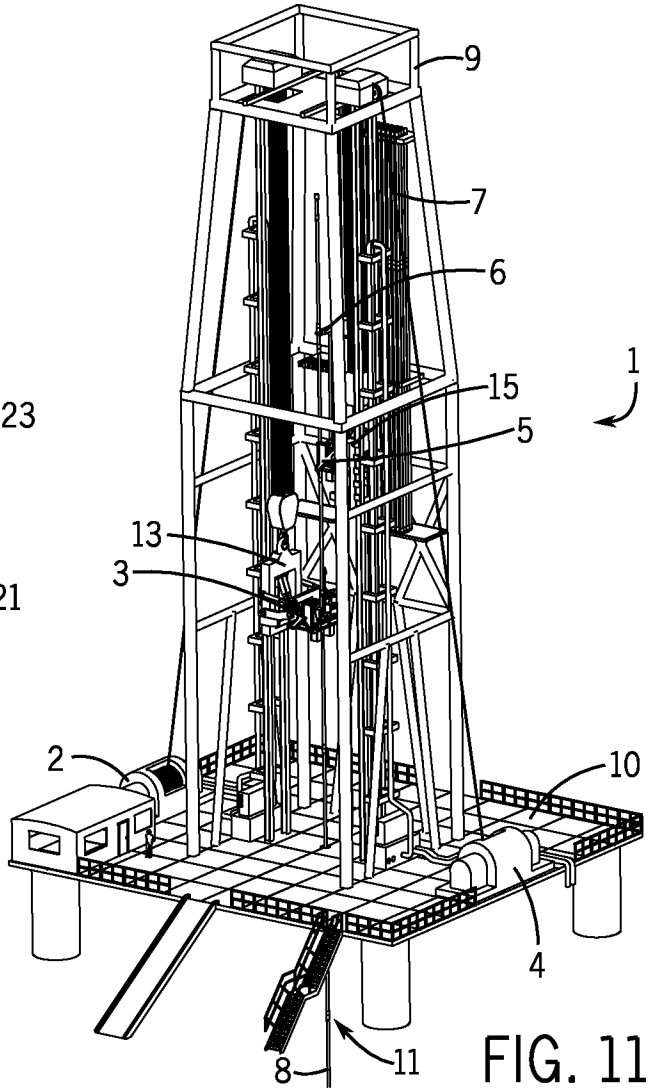
FIG. 11A and FIG. 11B. A schematic representation of the drilling and tripping system shown in FIG. 1 during removal of tubular from a hole at 1 foot/second with continuous rotation and near continuous mud circulation.
Figure 11B:
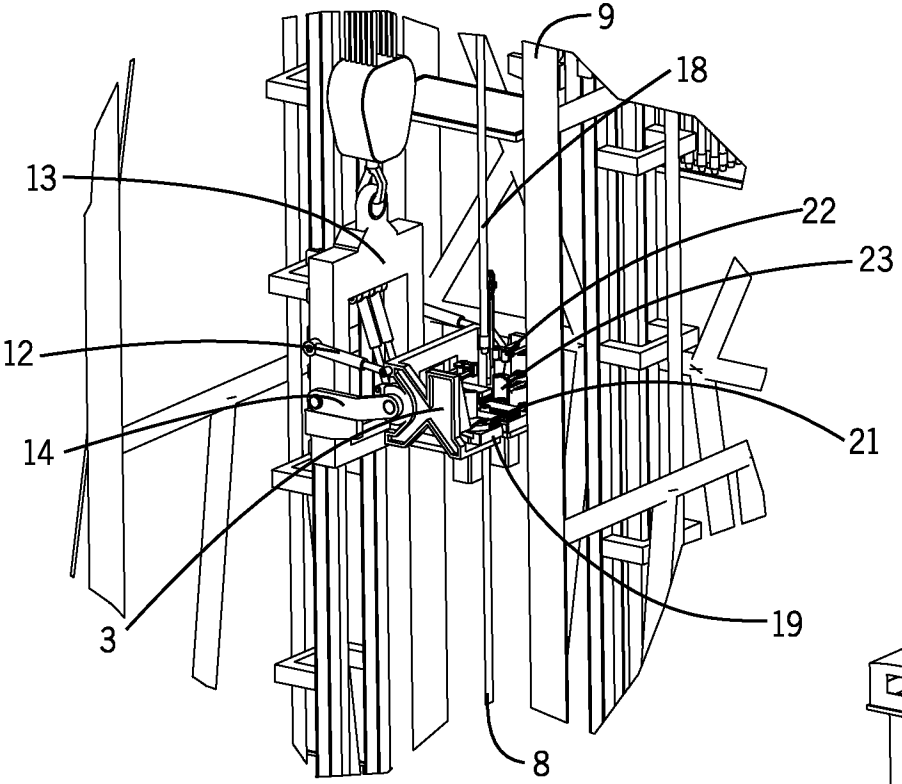

Referring now to FIG. 11A, which is a schematic of one embodiment of a drilling and tripping system 1 at t=26 seconds as the racking arm 6 removes the stand 18 (disconnected section of tubular 8). Shown in FIG. 11A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 11B, which shows a close-up view of the first TDR 3 at t=26 seconds. Shown in FIG. 11B is a portion of the derrick 9, first TDR 3, first moving dolly 13, stand 18, tubular 8, and piston 12 and pivot arm 14, which are extended and attached to the first TDR 3 and the first moving dolly 13. Features of the first TDR 3 that are visible include LTW 21, spinner 22, and mud bucket 23.

Figure 12A:
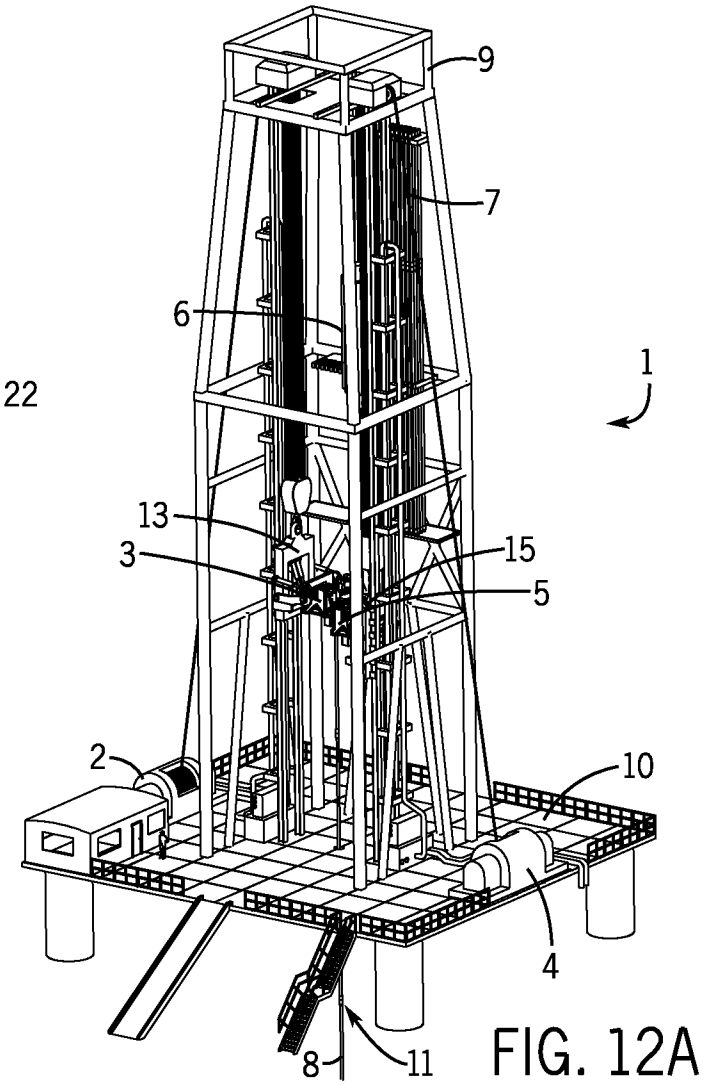
FIG. 12A and FIG. 12B. A schematic representation of the drilling and tripping system shown in FIG. 1 during removal of tubular from a hole at 1 foot/second with continuous rotation and near continuous mud circulation.
Figure 12B:
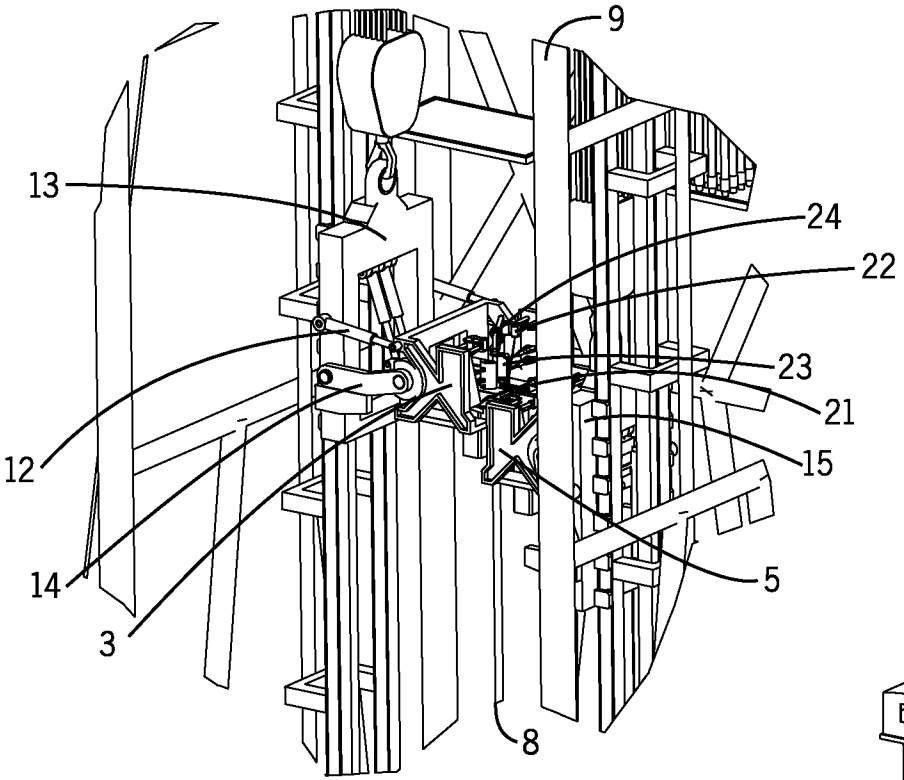

Referring now to FIG. 12A, which is a schematic of one embodiment of a drilling and tripping system 1 at t=32 seconds as the FCS 24 of the first TDR 3 engages the rotating tubular 8. Shown in FIG. 12A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 12B, which shows a close-up view of the first TDR 3 and the second TDR 5 at t=32 seconds. Shown in FIG. 12B is a portion of the derrick 9, first TDR 3, first moving dolly 13, second TDR 5, second moving dolly 15, tubular 8, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 13A:
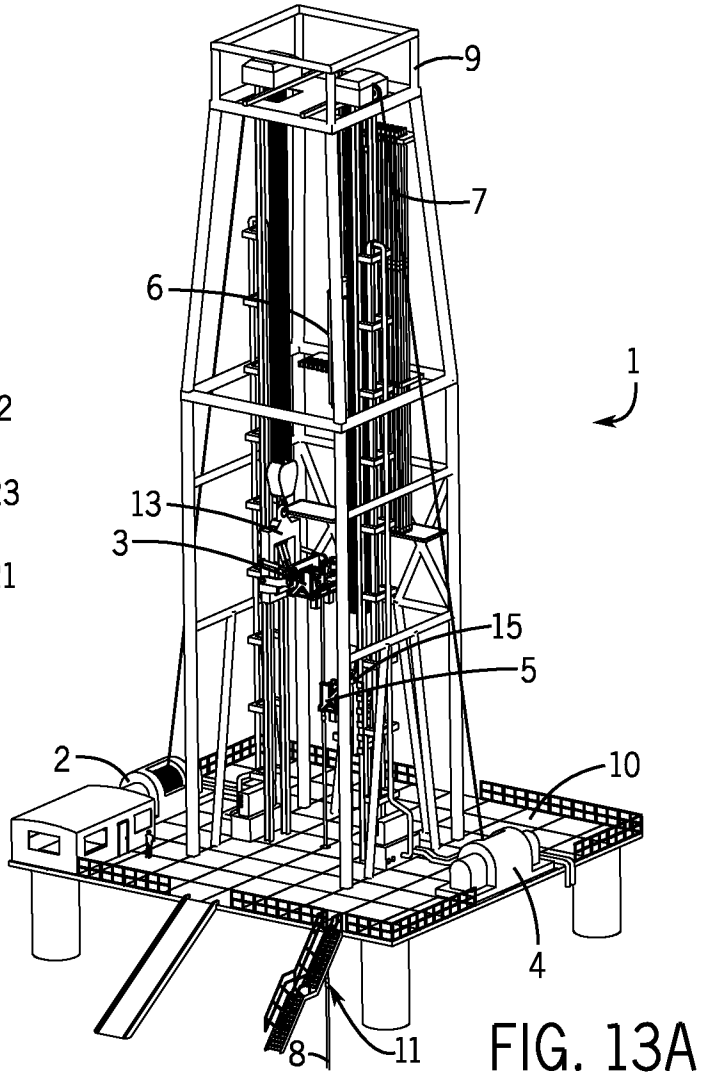
FIG. 13A and FIG. 13B. A schematic representation of the drilling and tripping system shown in FIG. 1 during removal of tubular from a hole at 1 foot/second with continuous rotation and near continuous mud circulation.
Figure 13B:
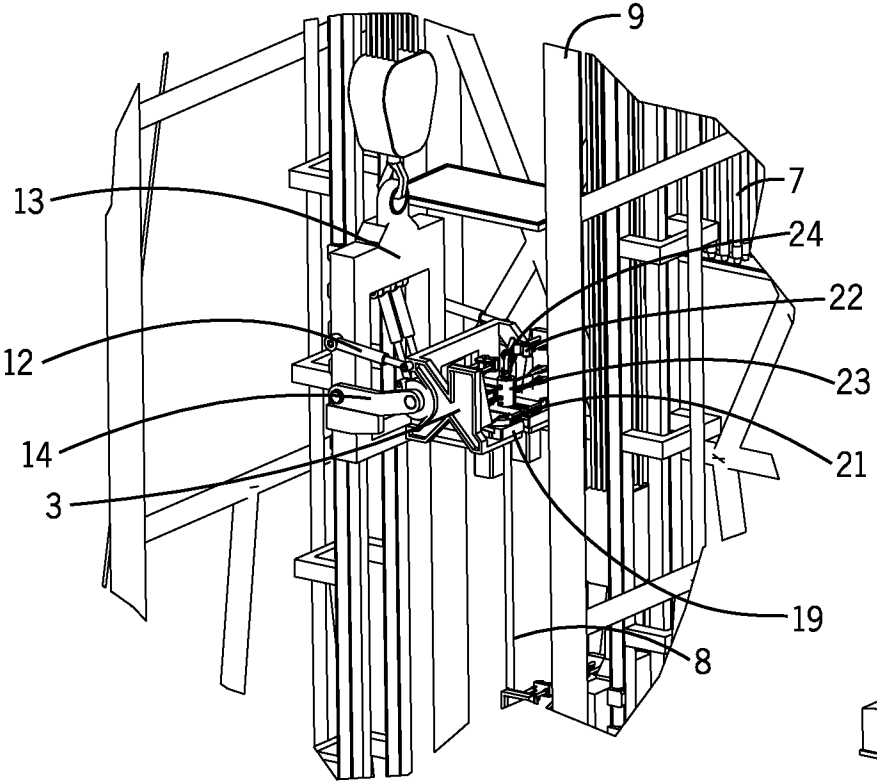

Referring now to FIG. 13A, which is a schematic of one embodiment of a drilling and tripping system 1 at t=36 seconds as the mud flow begins upon sealing. Shown in FIG. 13A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 13B, which shows a close-up view of the first TDR 3 at t=36 seconds. Shown in FIG. 13B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 14A:
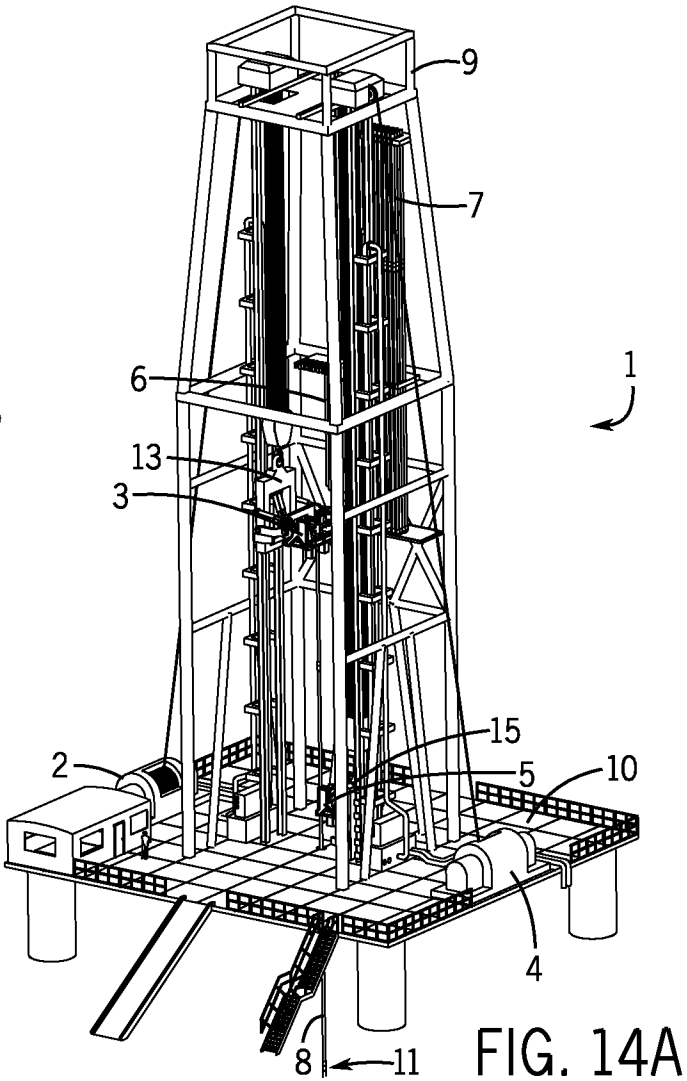
FIG. 14A and FIG. 14B. A schematic representation of the drilling and tripping system shown in FIG. 1 during removal of tubular from a hole at 1 foot/second with continuous rotation and near continuous mud circulation.
Figure 14B:
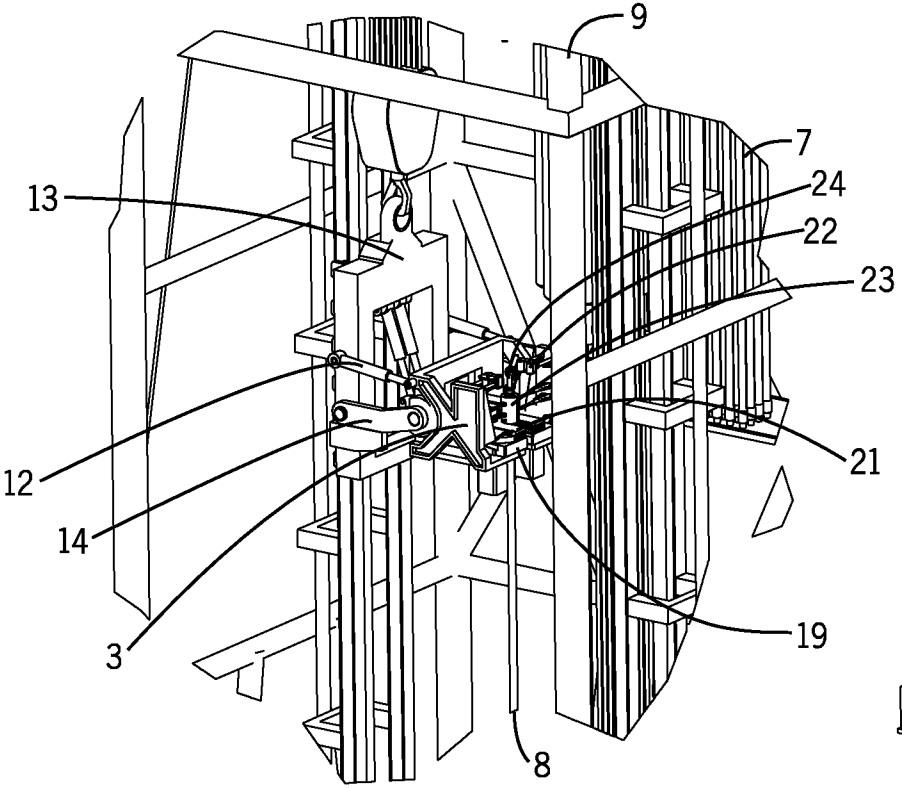

Referring now to FIG. 14A, which is a schematic of one embodiment of a drilling and tripping system at t=45 seconds as the tubular 8 is being pulled with rotation and mud flow. Shown in FIG. 14A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 14B, which shows a close-up view of the first TDR 3 at t=45 seconds. Shown in FIG. 14B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 15A:
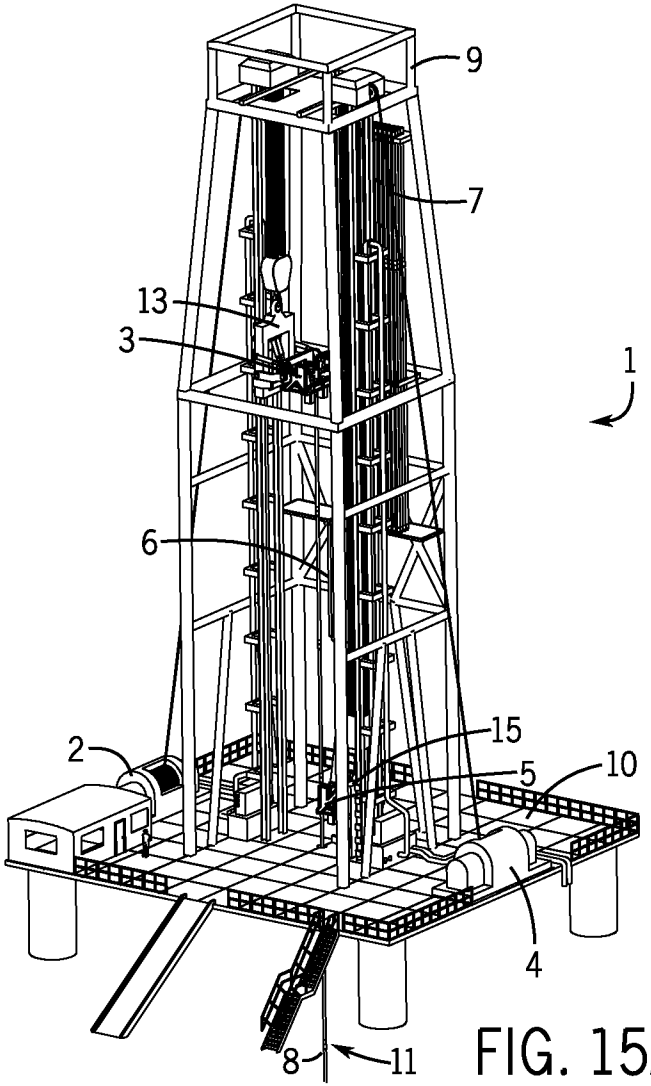
FIG. 15A and FIG. 15B. A schematic representation of the drilling and tripping system shown in FIG. 1 during removal of tubular from a hole at 1 foot/second with continuous rotation and near continuous mud circulation.
Figure 15B:
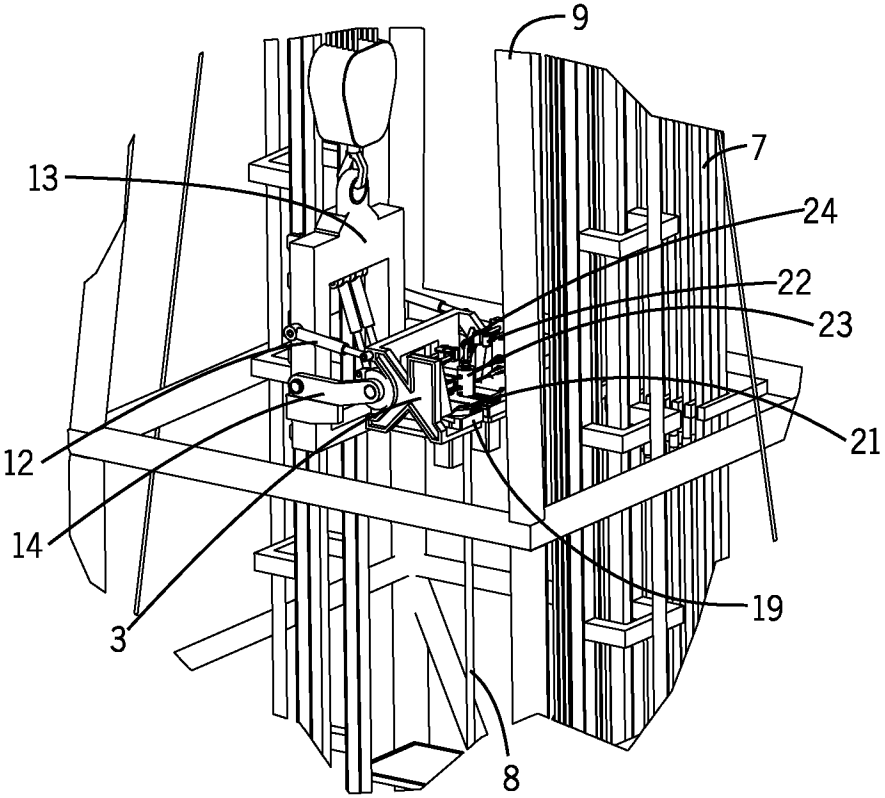

Referring now to FIG. 15A, which is a schematic of one embodiment of a drilling and tripping system 1 at t=77 seconds as the second TDR 5 engages with the next tool joint 11 of the tubular 8. Shown in FIG. 15A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 15B, which shows a close-up view of the first TDR 3 at t=77 seconds. Shown in FIG. 15B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 16A:
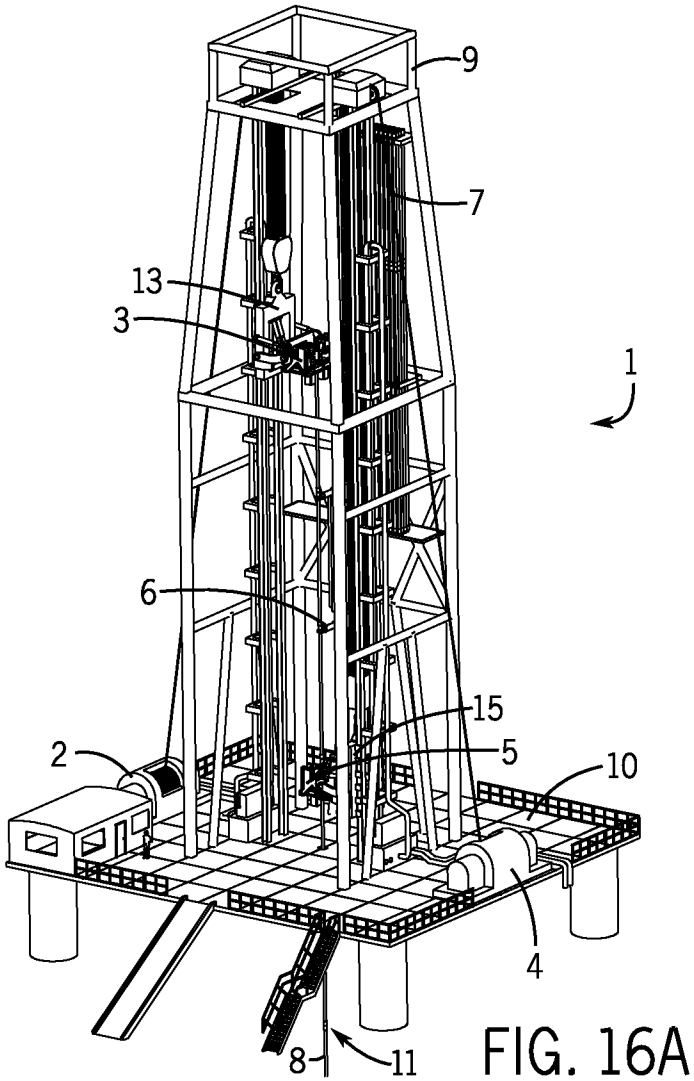
FIG. 16A and FIG. 16B. A schematic representation of the drilling and tripping system shown in FIG. 1 during removal of tubular from a hole at 1 foot/second with continuous rotation and near continuous mud circulation.
Figure 16B:
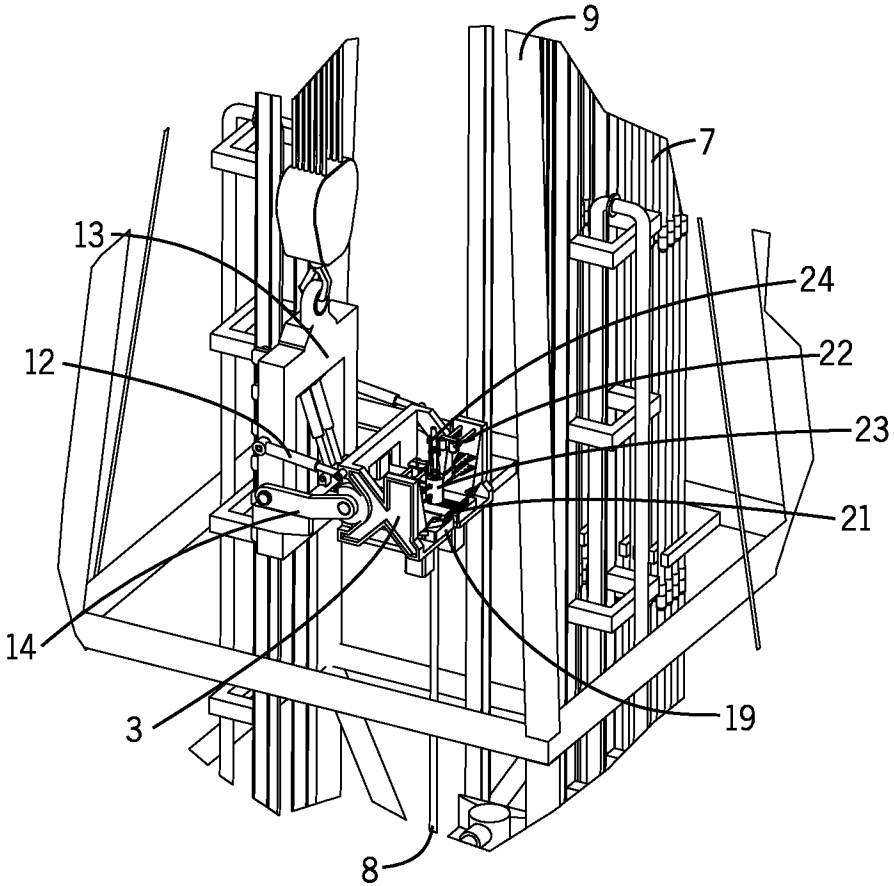

Referring now to FIG. 16A, which is a schematic of one embodiment of a drilling and tripping system 1 at t=81 seconds as the second TDR 5 takes over weight load and rotation of the tubular S. Shown in FIG. 16A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 16B, which shows a close-up view of the first TDR 3 at t=81 seconds. Shown in FIG. 16B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 17A:
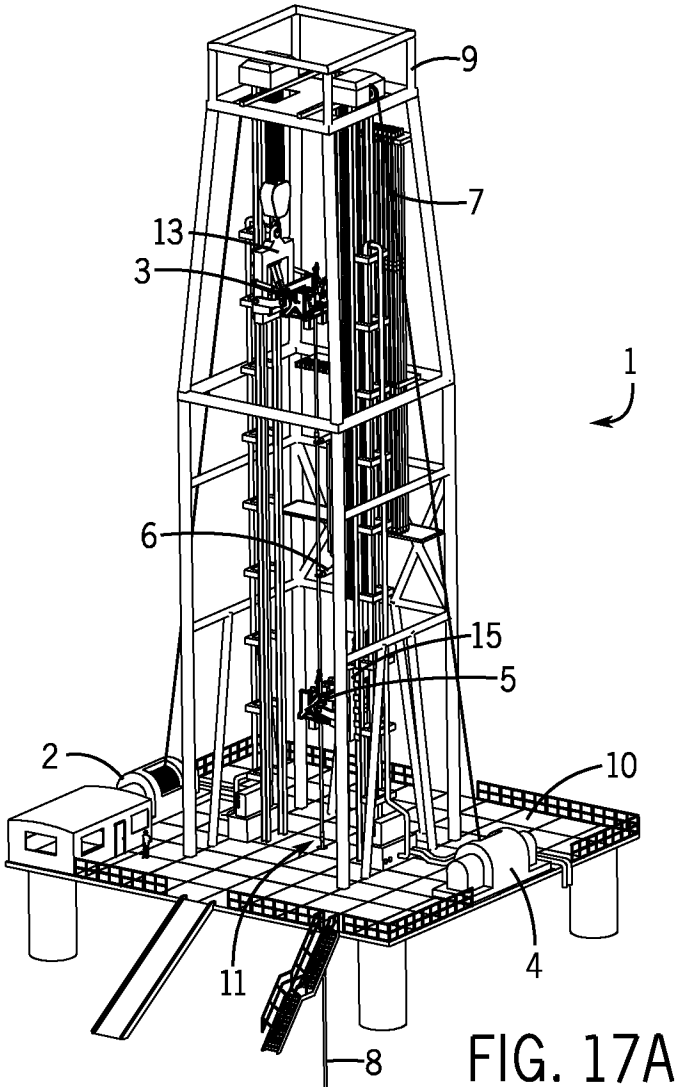
FIG. 17A and FIG. 17B. A schematic representation of the drilling and tripping system shown in FIG. 1 during removal of tubular from a hole at 1 foot/second with continuous rotation and near continuous mud circulation.
Figure 17B:
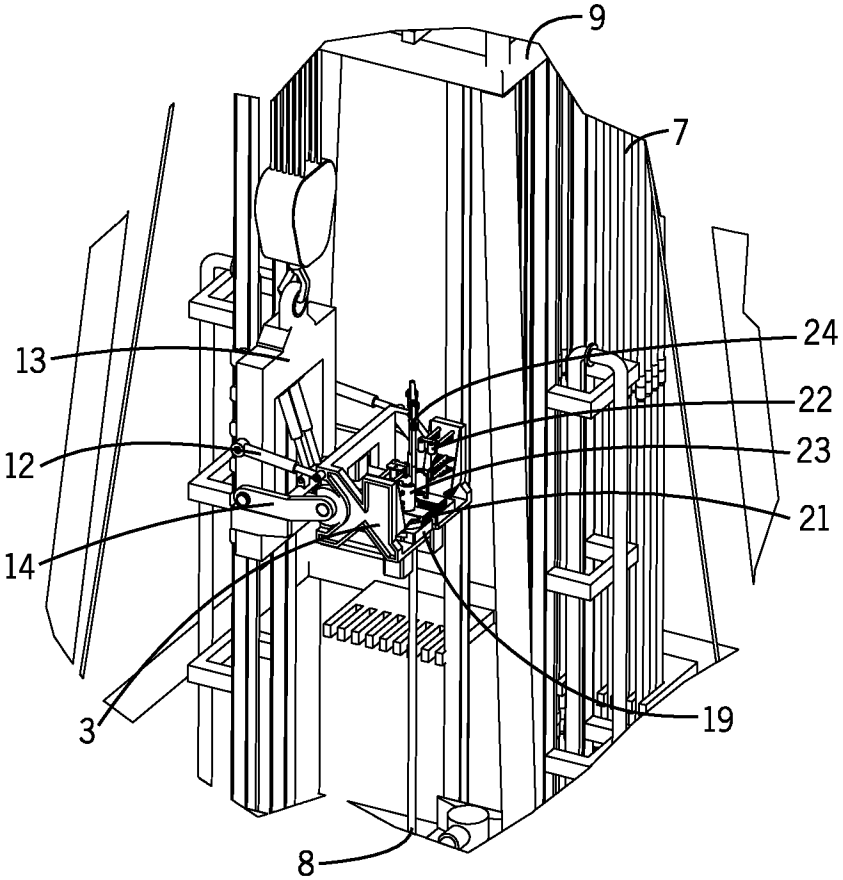

Referring now to FIG. 17A, which is a schematic of one embodiment of a drilling and tripping system 1 at t=92 seconds as the fluid connection system 24 of the first TDR 3 is disengaged. Shown in FIG. 17A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 17B, which shows a close-up view of the first TDR 3 at t=92 seconds. Shown in FIG. 17B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 18A:
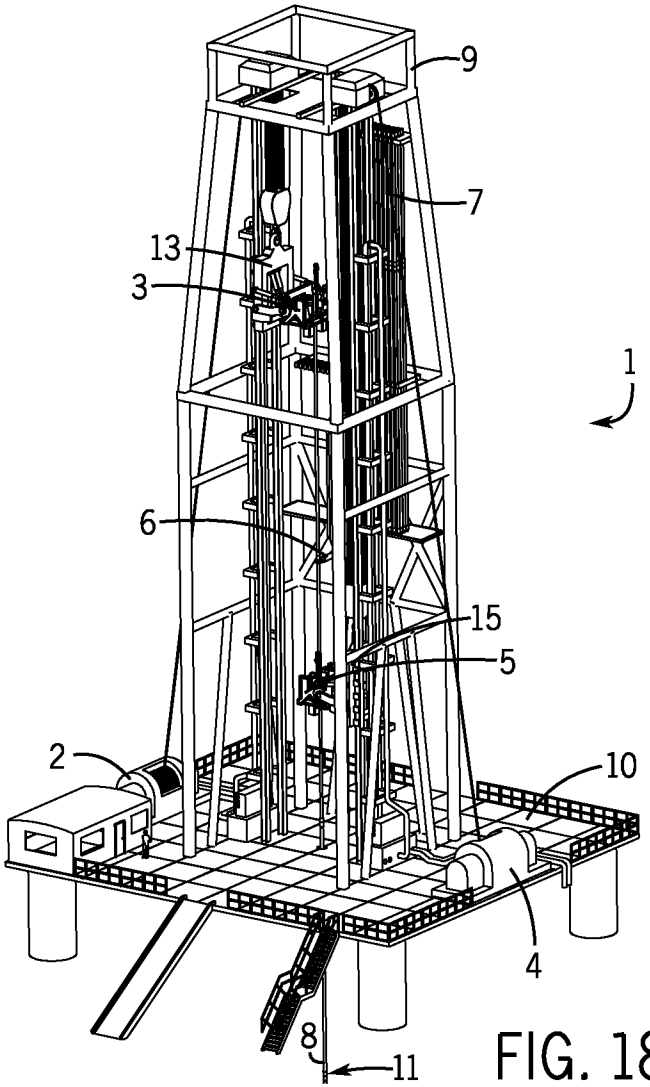
FIG. 18A and FIG. 18B. A schematic representation of the drilling and tripping system shown in FIG. 1 during removal of tubular from a hole at 1 foot/second with continuous rotation and near continuous mud circulation.
Figure 18B:
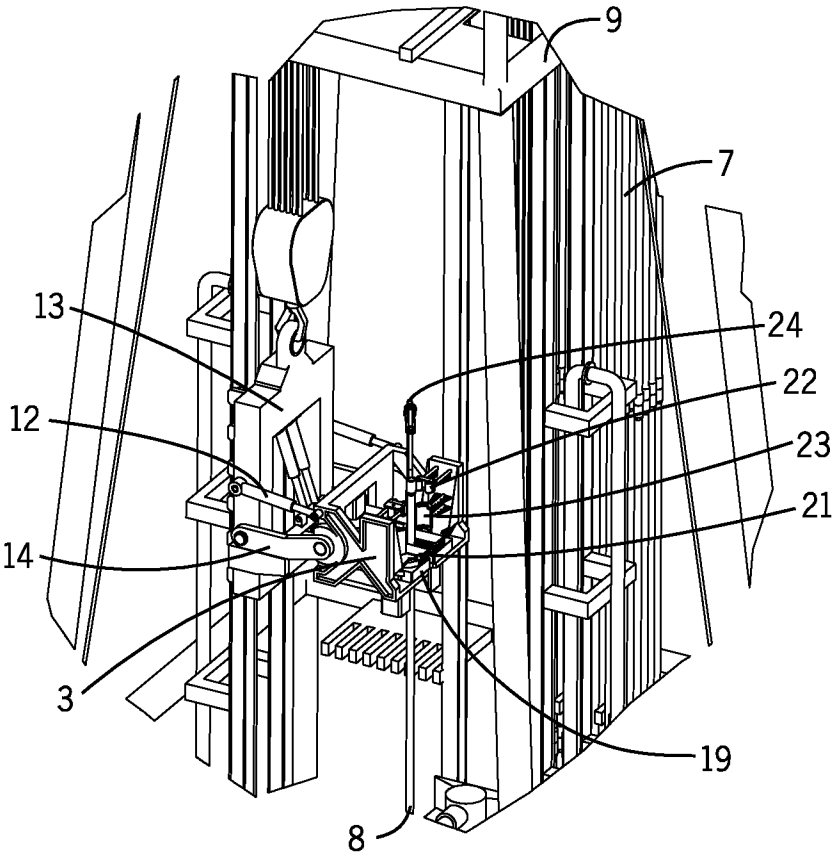

Referring now to FIG. 18A, which is a schematic of one embodiment of a drilling and tripping system 1 at t=95 seconds as the first TDR 5 begins to retract from the tubular. Shown in FIG. 18A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 18B, which shows a close-up view of the first TDR 3 at t=95 seconds. Shown in FIG. 18B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 19A:
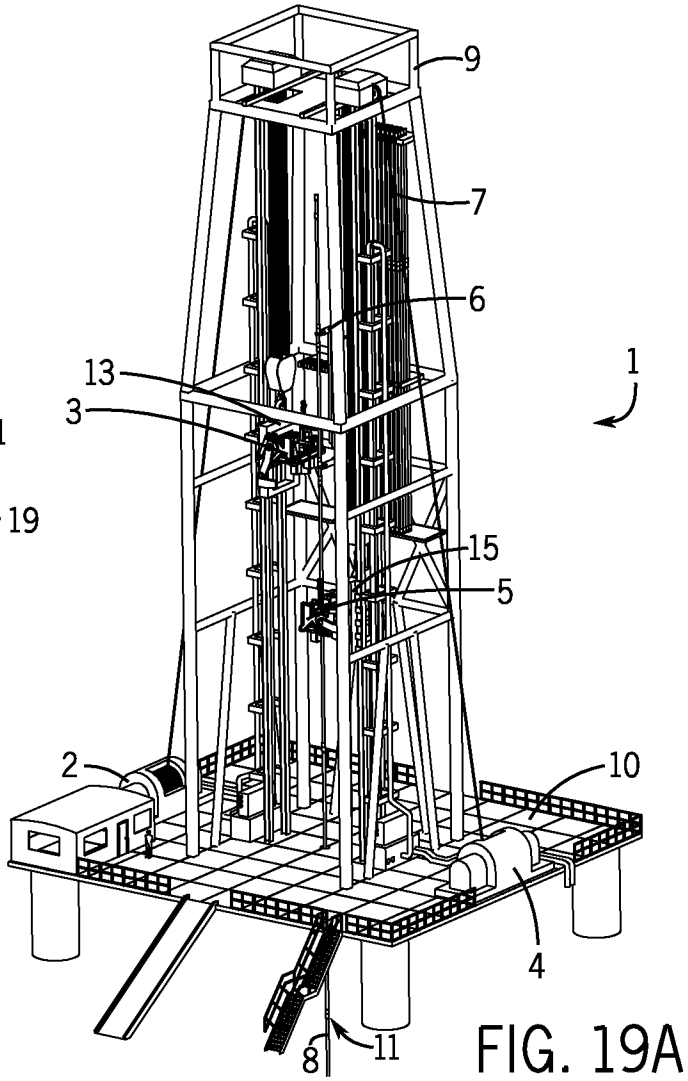
FIG. 19A and FIG. 19B. A schematic representation of the drilling and tripping system shown in FIG. 1 during removal of tubular from a hole at 1 foot/second with continuous rotation and near continuous mud circulation.
Figure 19B:
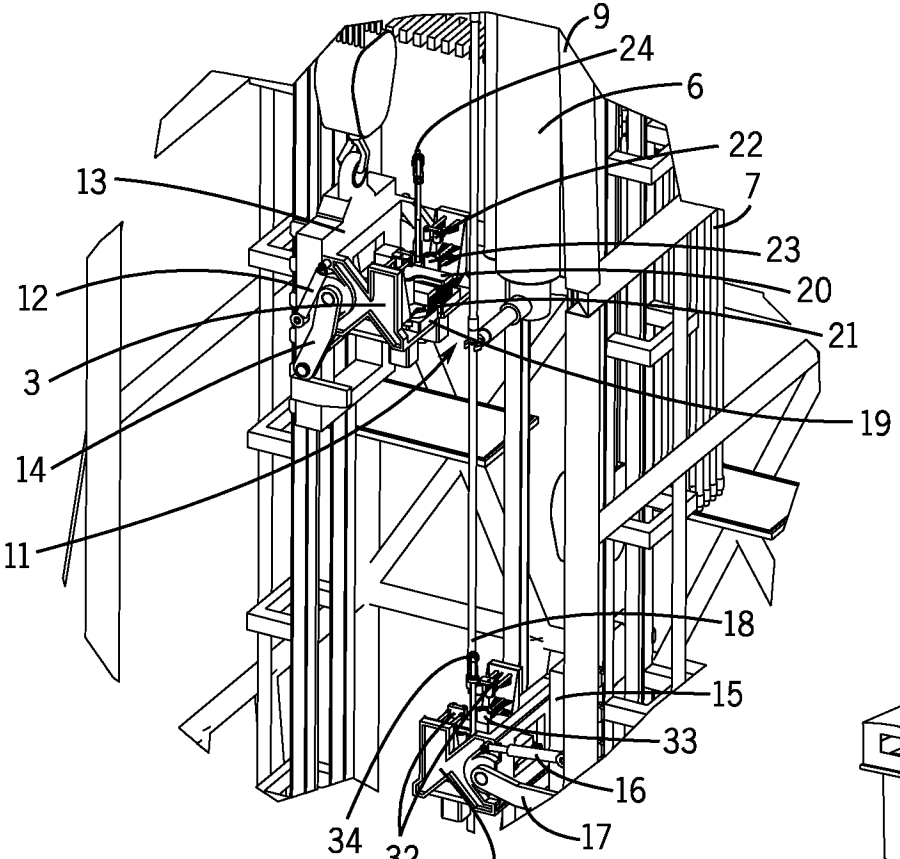

Referring now to FIG. 19A, which is a schematic of one embodiment of a drilling and tripping system 1 at t=103 seconds as the first TDR 3 descends the derrick 9 while the racking arm 6 removes the stand 18 of the tubular 8. Shown in FIG. 19A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 and the second TDR 5 are more visible in FIG. 19B, which shows a close-up view of the first TDR 3 and the second TDR 5 at t=103 seconds. Shown in FIG. 19B is a portion of the derrick 9, first TDR 3, first moving dolly 13, stand 18, pipe rack 7, piston 12 and pivot arm 14, which are retracted and attached to the first TDR 3 and the first moving dolly 13, second TDR 5, second moving dolly 15, and second piston 16 and second pivot arm 17, which are extended and attached to the second TDR 5 and the second moving dolly 15. Features of the first TDR 3 that are visible include UTW 20, LTW 21, spinner 22, mud bucket 23 and FCS 24, and features of the second TDR 5 that are visible include second spinner 32, second mud bucket 33 and second FCS 34.

Figure 20A:
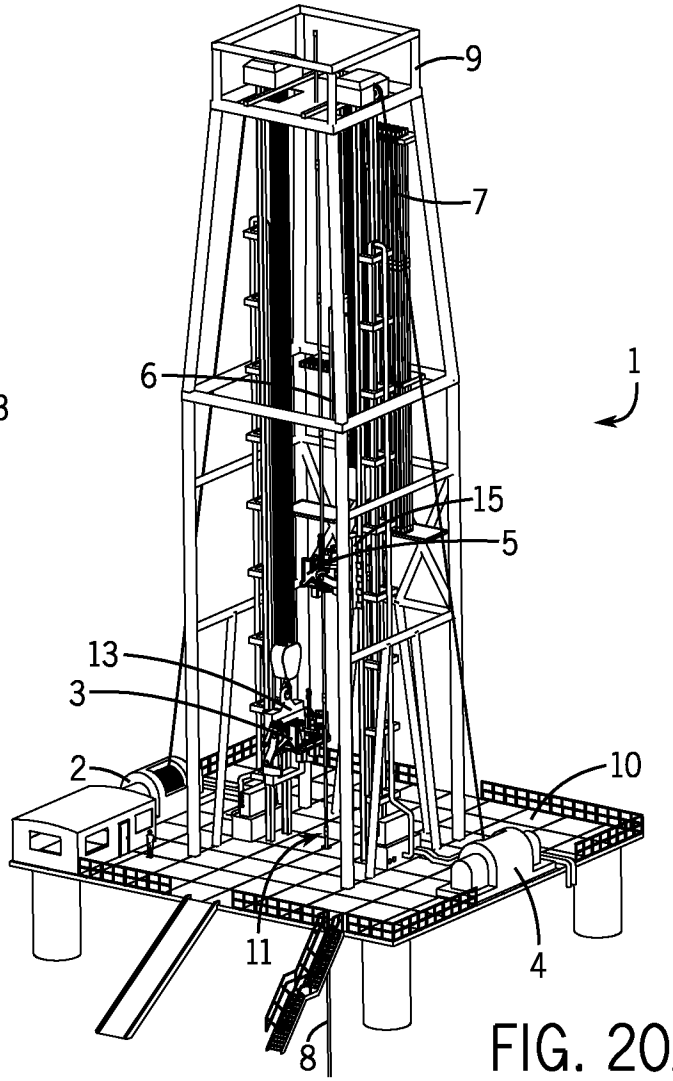
FIG. 20A and FIG. 20B. A schematic representation of the drilling and tripping system shown in FIG. 1 during removal of tubular from a hole at 1 foot/second with continuous rotation and near continuous mud circulation.
Figure 20B:
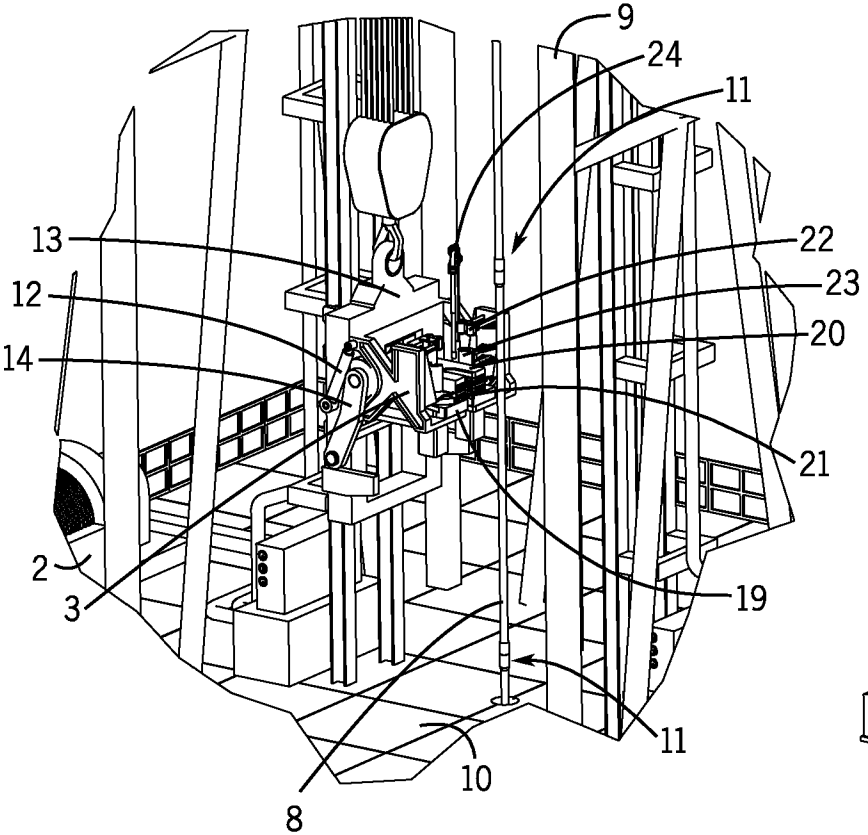

Referring now to FIG. 20A, which is a schematic of one embodiment of a drilling and tripping system 1 at t=115 seconds as the second TDR 5 pulls and rotates the tubular 8. Shown in FIG. 20A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 20B, which shows a close-up view of the first TDR 3 at t=115 seconds. Shown in FIG. 20B is a portion of the derrick 9 and drill floor 10, first drawworks 2, first TDR 3, first moving dolly 13, tubular 8, tool joints 11, and piston 12 and pivot arm 14, which are retracted and attached to the first TDR 3 and the first moving dolly 13. Features of the first TDR 3 that are visible include UTW 20, LTW 21, spinner 22, mud bucket 23 and FCS 24.

Figure 21A:
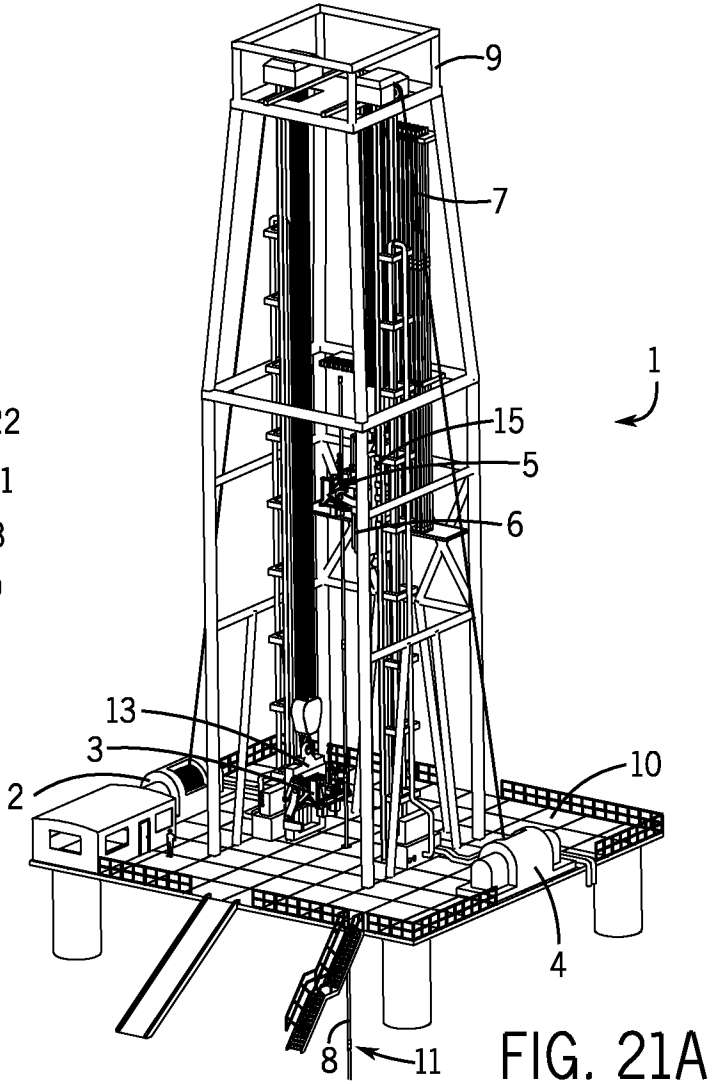
FIG. 21A and FIG. 21B. A schematic representation of the drilling and tripping system shown in FIG. 1 during removal of tubular from a hole at 1 foot/second with continuous rotation and near continuous mud circulation.
Figure 21B:
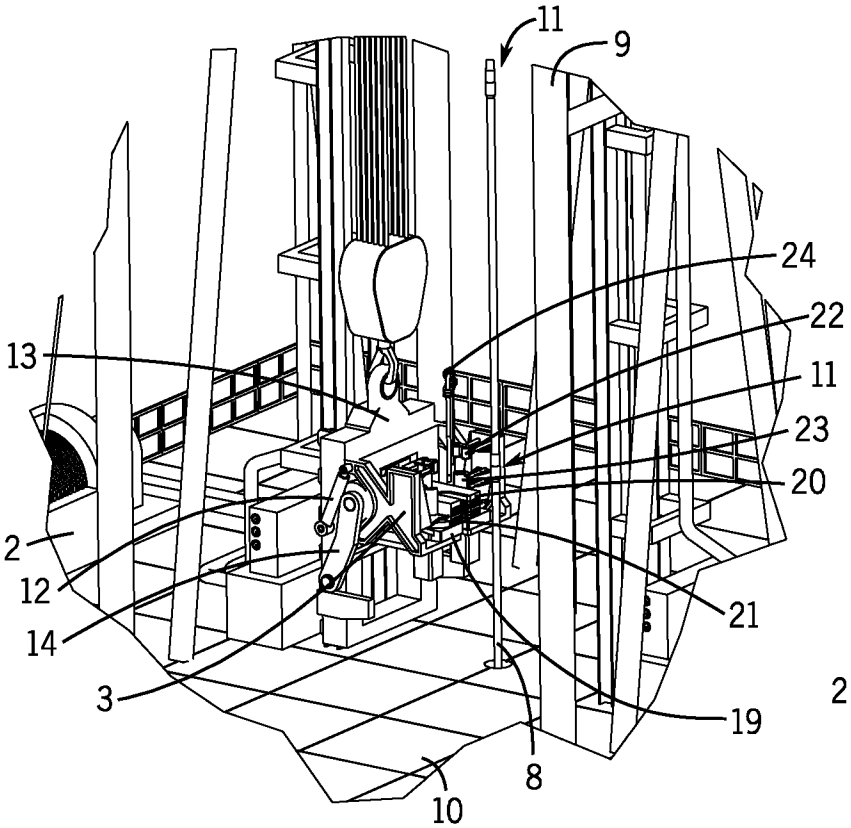

Referring now to FIG. 21A, which is a schematic of one embodiment of a drilling and tripping system at t=129 seconds as the first TDR 3 is back in the start position, awaiting the next tool joint 11 of the tubular 8. Shown in FIG. 21A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 21B, which shows a close-up view of the first TDR 3 at t=129 seconds. Shown in FIG. 21B is a portion of the derrick 9 and drill floor 10, first drawworks 2, first TDR 3, first moving dolly 13, tubular 8, tool joints 11, and piston 12 and pivot arm 14, which are retracted and attached to the first TDR 3 and the first moving dolly 13. Features of the first TDR 3 that are visible include UTW 20, LTW 21, spinner 22, mud bucket 23 and FCS 24.

Drilling

Figures 1, 22A:
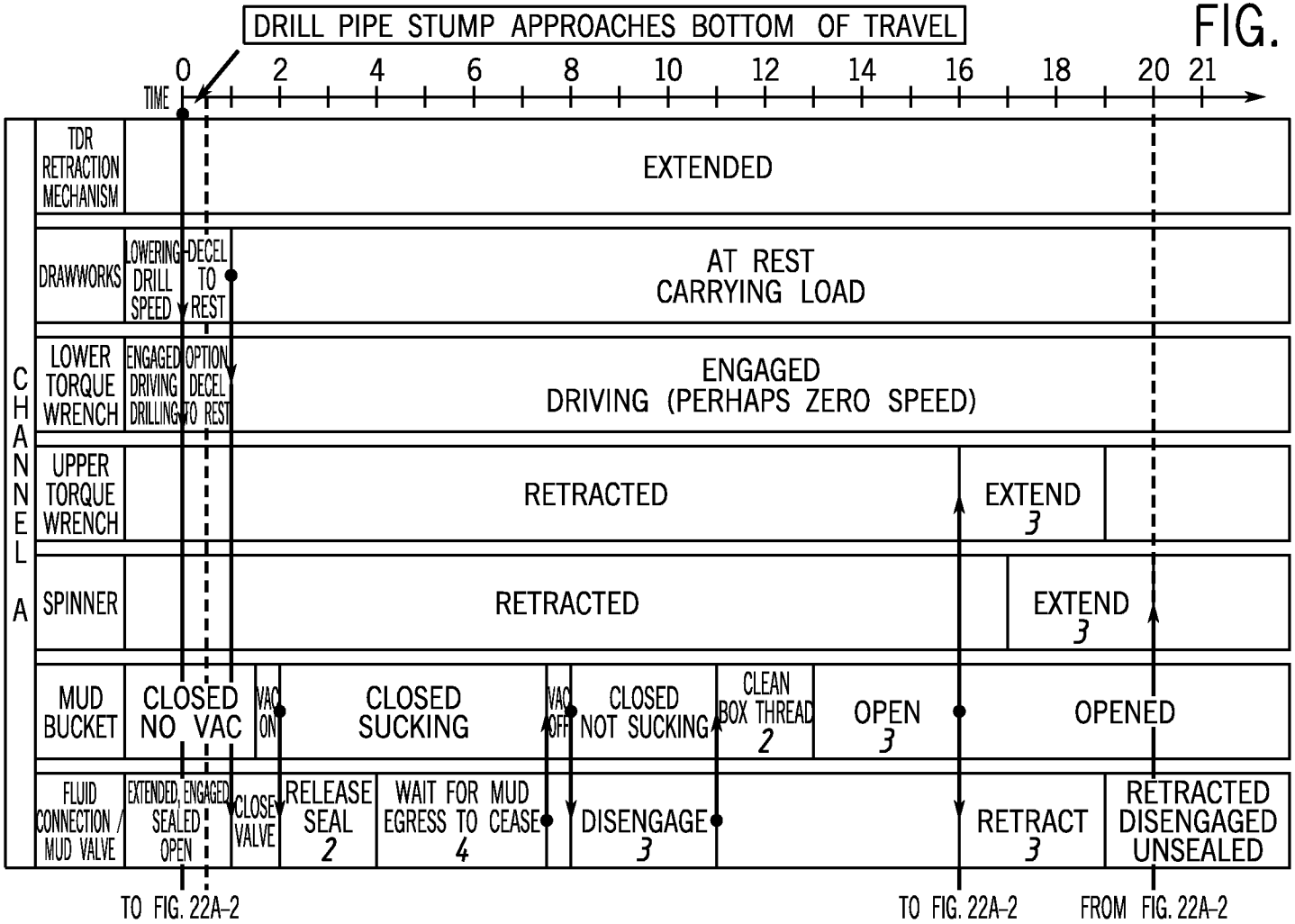
FIG. 22A and FIG. 22B. A block diagram showing one embodiment of a detailed operational sequence for one cycle of drilling at 1 foot/second. At the end of the described cycle, the cycle repeats with Channel A performing the tasks done by Channel B and vice-versa.
Figures 2, 22A:
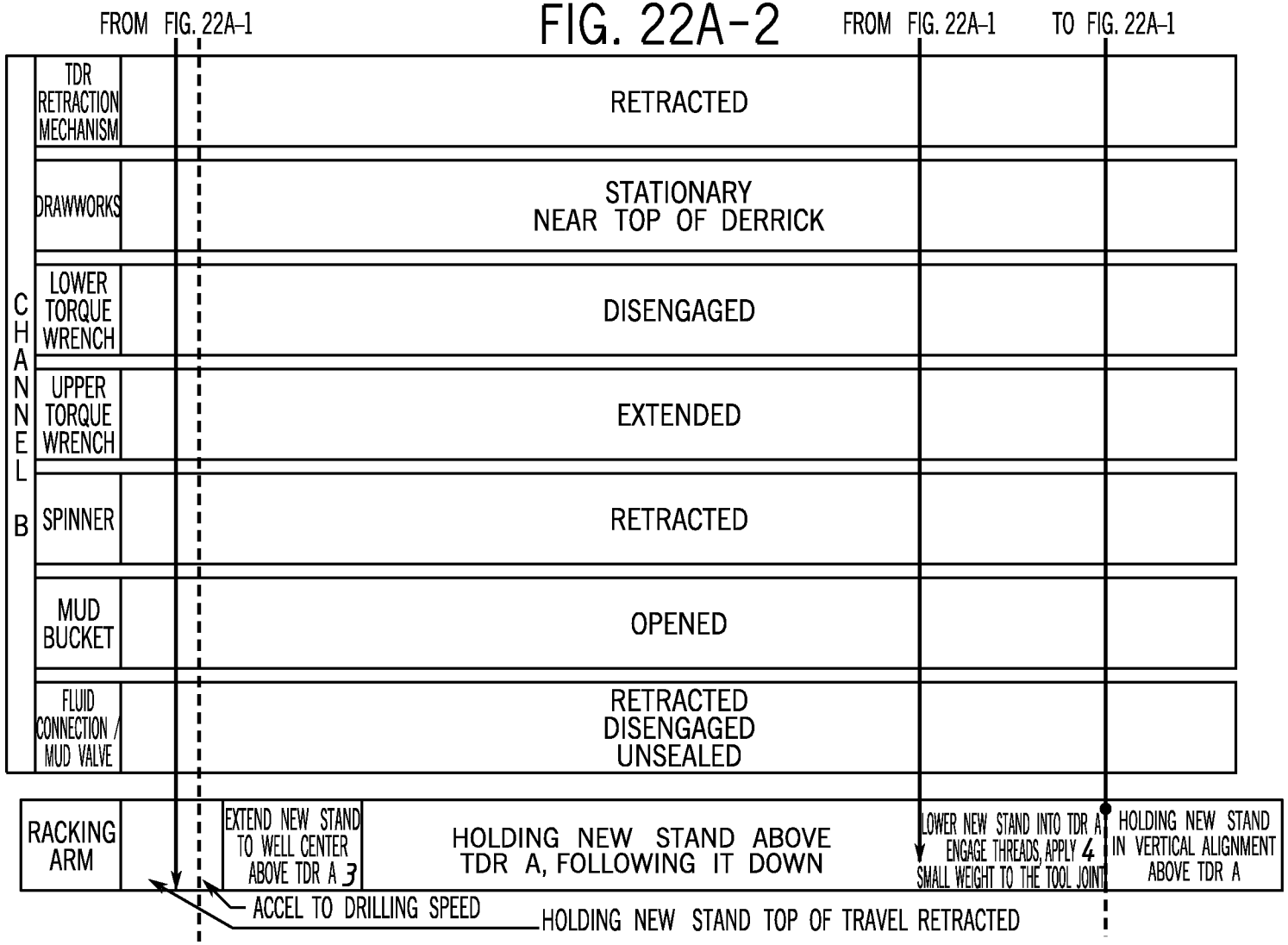
Figures 1, 22B:
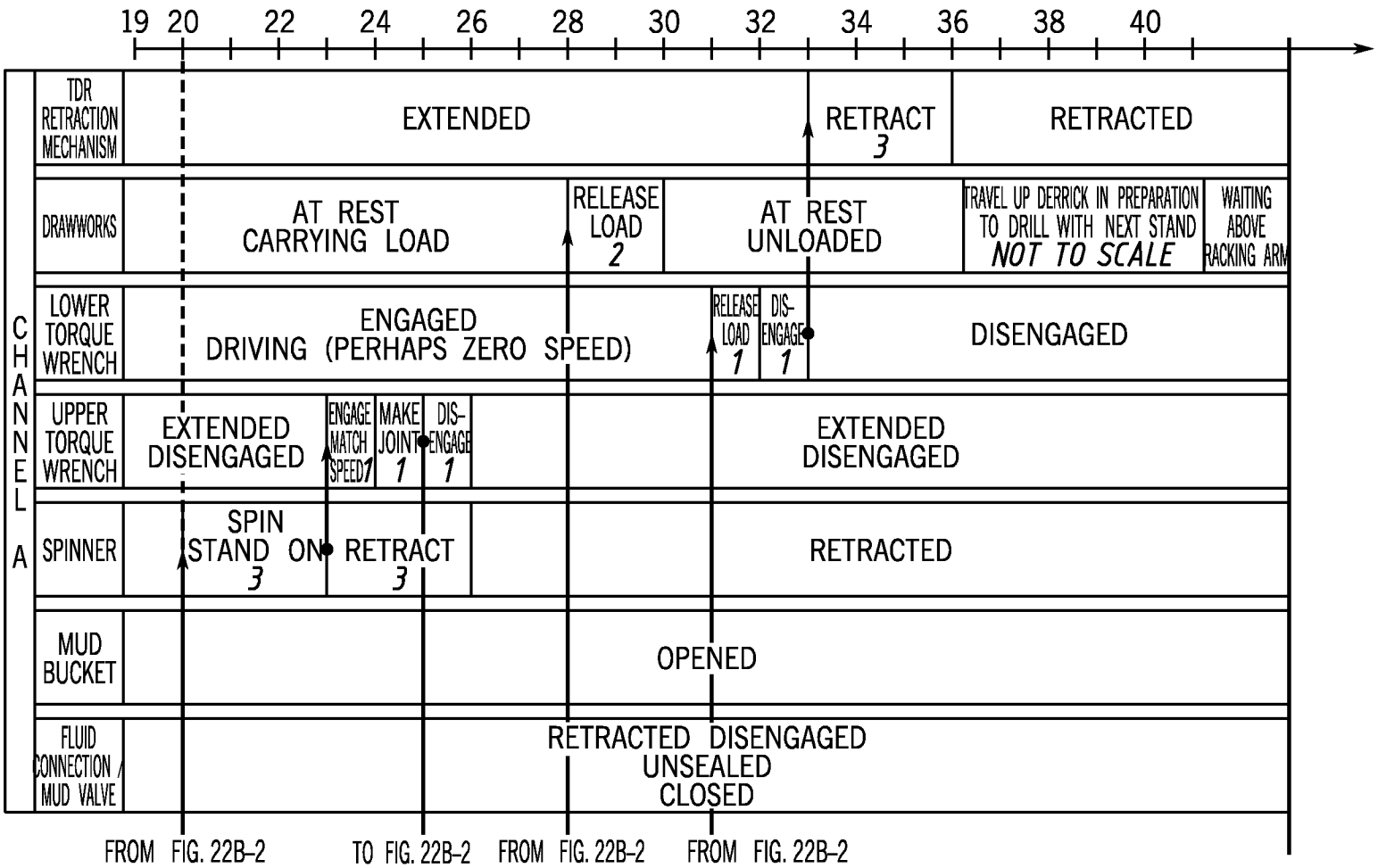
Figures 2, 22B:
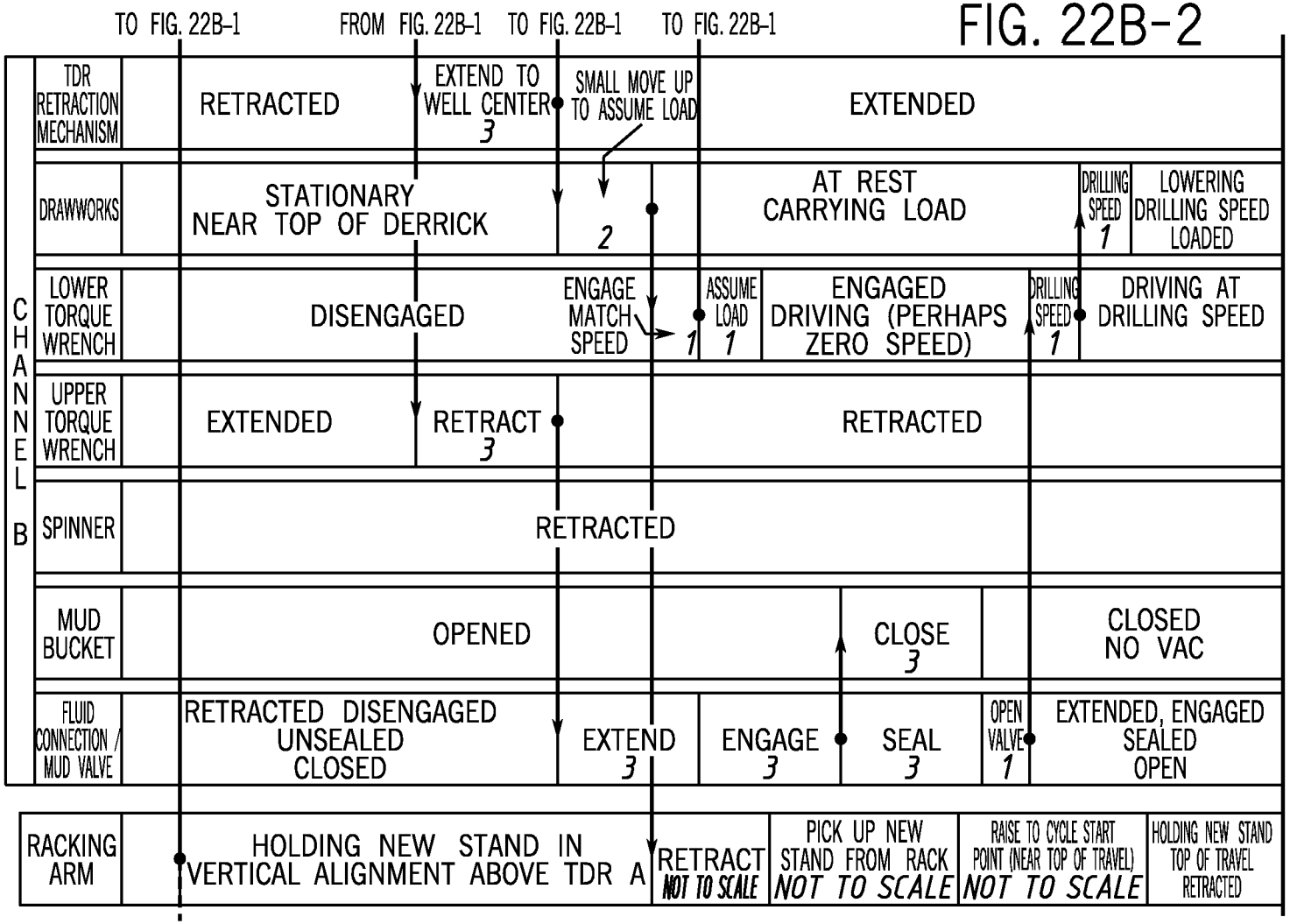
Figure 23A:
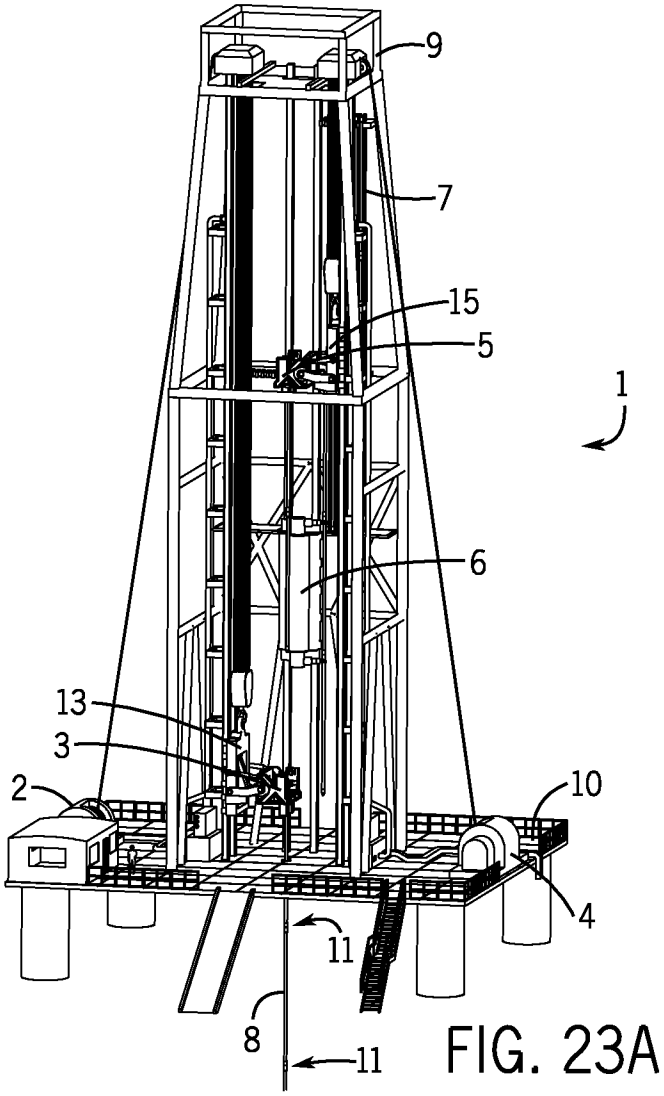
FIG. 23A and FIG. 23B. A schematic representation of the drilling and tripping system shown in FIG. 1 during drilling at 1 foot/second.
Figure 23B:
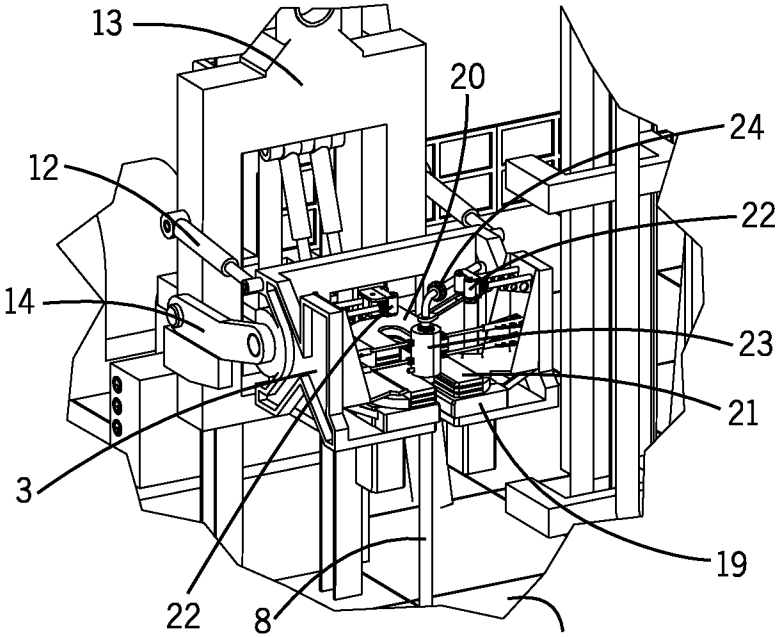

FIG. 22A and FIG. 22B shows the detailed operational sequence for one cycle of drilling at 1 foot/second. FIGS. 23 through 42 provide "snapshots" of one embodiment of a presently disclosed drilling and tripping system as it completes two cycles of the operational drilling sequence shown in FIG. 22A and FIG. 22B. Referring to FIG. 23A, which is a schematic of one embodiment of a drilling and tripping system 1 at t=1 second as the first TDR 3 is drilling—rotating and lowering tubular 8 and circulating mud. Shown in FIG. 23A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 23B, which shows a close-up view of the first TDR 3 at t=1 second. Shown in FIG. 23B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 24A:
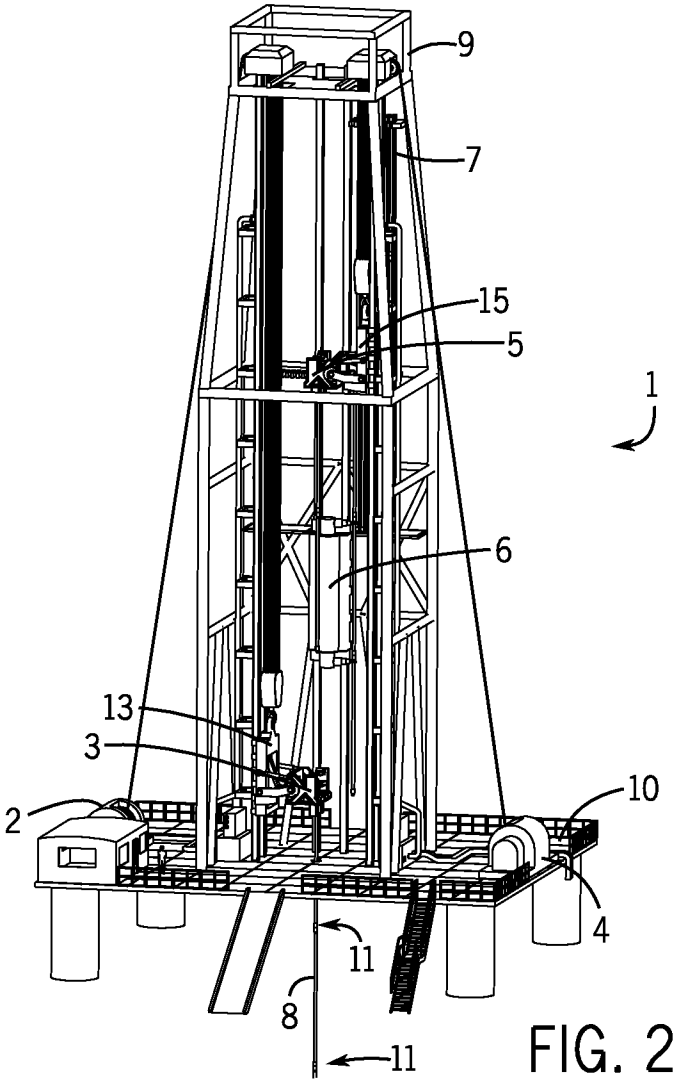
FIG. 24A and FIG. 24B. A schematic representation of the drilling and tripping system shown in FIG. 1 during drilling at 1 foot/second.
Figure 24B:
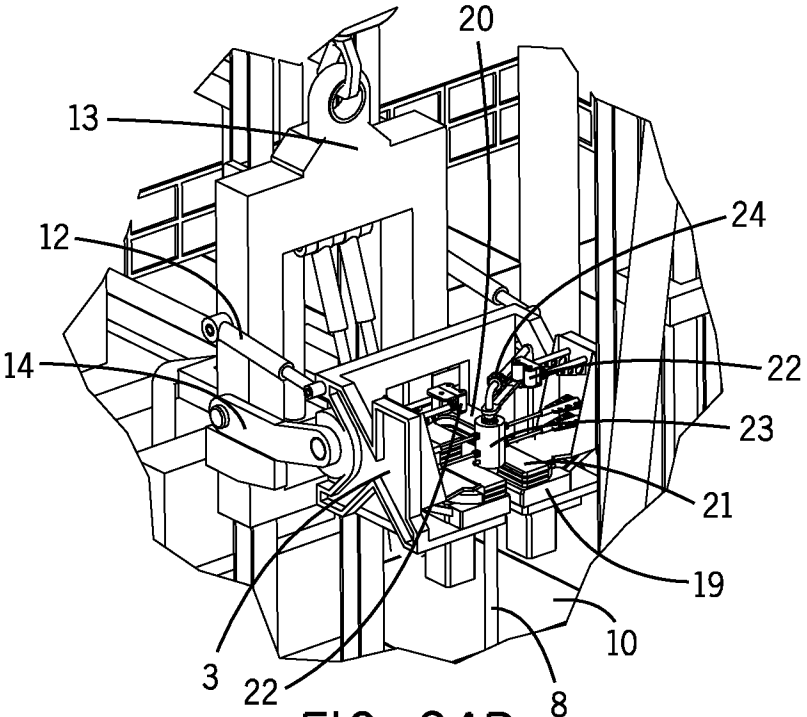

Referring now to FIG. 24A, which is a schematic of one embodiment of a drilling and tripping system 1 at t=8 seconds as the tubular 8 reaches the drill floor 10, penetration stops and the mud valve is closed. Shown in FIG. 24A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 24B, which shows a close-up view of the first TDR 3 at t=8 seconds. Shown in FIG. 24B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 25A:
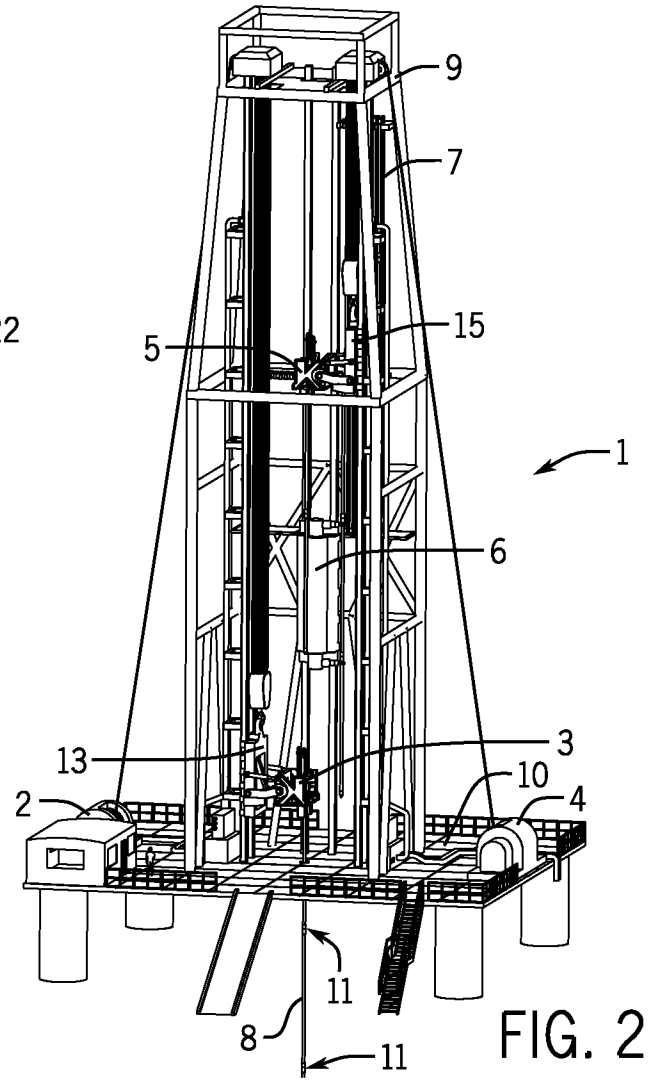
FIG. 25A and FIG. 25B. A schematic representation of the drilling and tripping system shown in FIG. 1 during drilling at 1 foot/second.
Figure 25B:
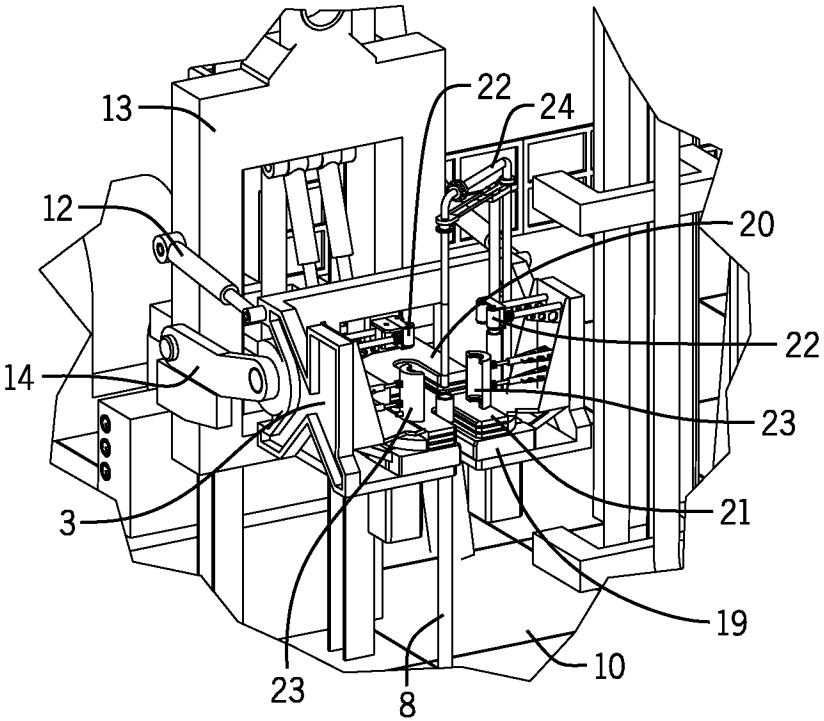

Referring now to FIG. 25A, which is a schematic of one embodiment of a drilling and tripping system 1 at t=19 seconds as the fluid connection system 24 of the first TDR 3 retracts and the mud bucket 23 of the first TDR 3 is opened. Shown in FIG. 25A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 25B, which shows a close-up view of the first TDR 3 at t=19 seconds. Shown in FIG. 25B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 26A:
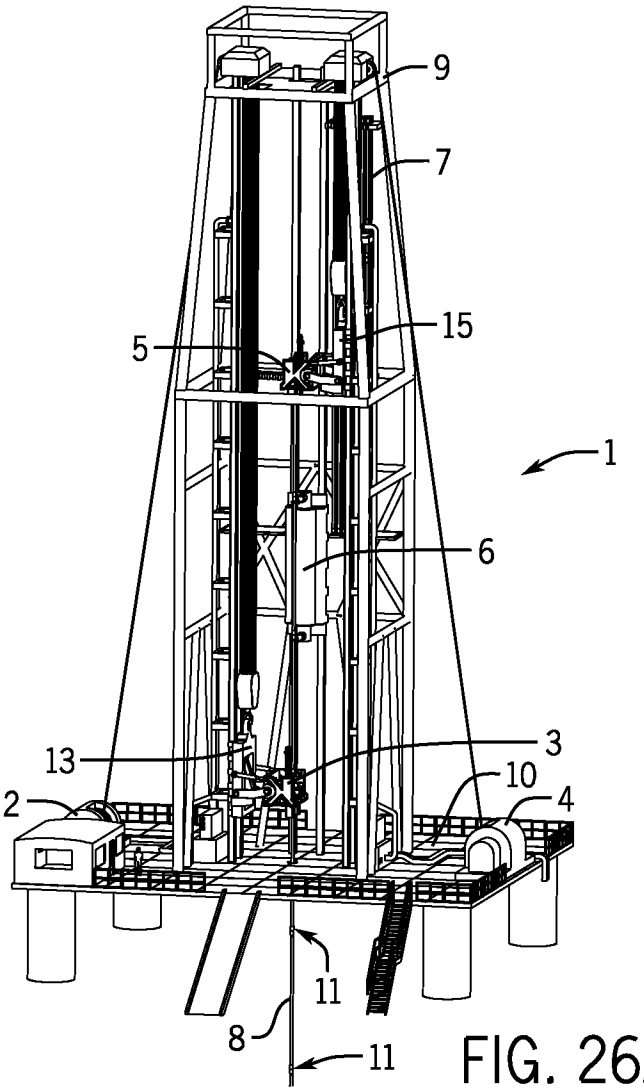
FIG. 26A and FIG. 26B. A schematic representation of the drilling and tripping system shown in FIG. 1 during drilling at 1 foot/second.
Figure 26B:
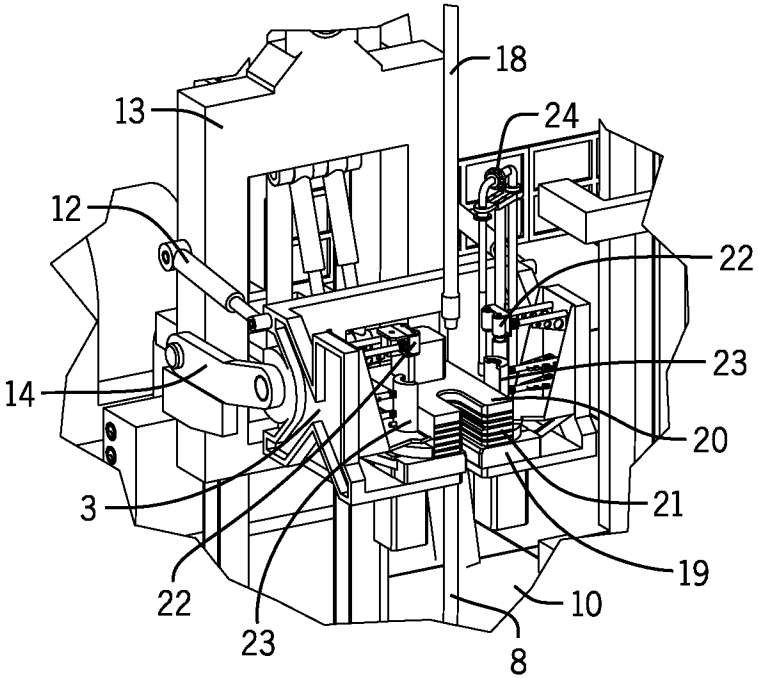

Referring now to FIG. 26A, which is a schematic of one embodiment of a drilling and tripping system 1 at t=23 seconds as the racking arm 6 inserts a new stand 18 while the spinner 22 and UTW 20 of the first TDR 3 engages. Shown in FIG. 26A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 26B, which shows a close-up view of the first TDR 3 at t=23 seconds. Shown in FIG. 26B is a portion of the drill floor 10, first TDR 3, first moving dolly 13, tubular 8, stand 18, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 27A:
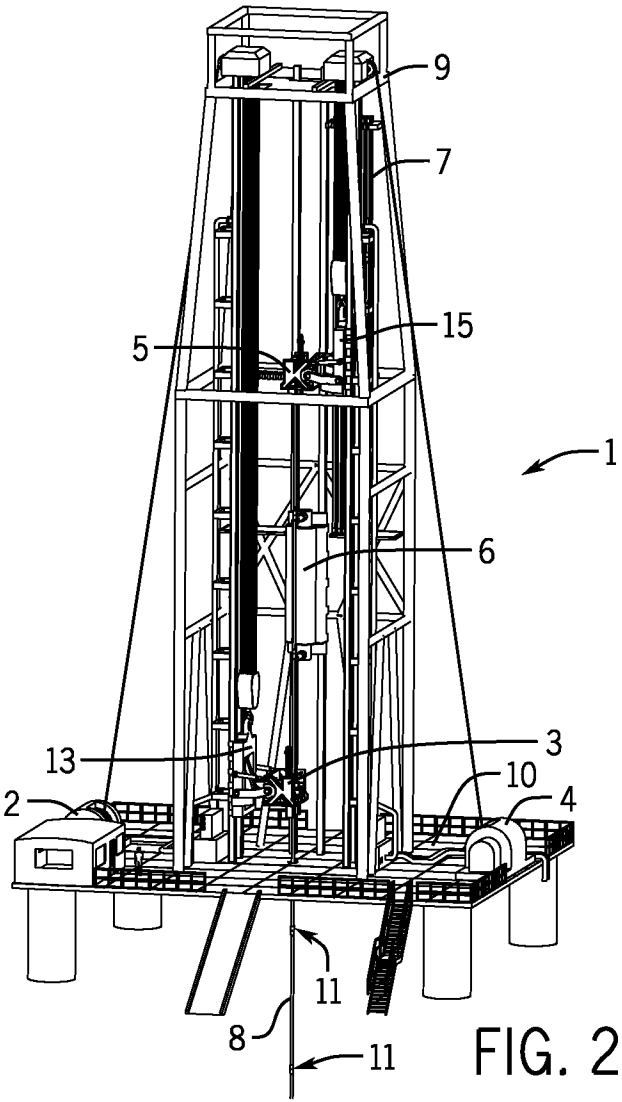
FIG. 27A and FIG. 27B. A schematic representation of the drilling and tripping system shown in FIG. 1 during drilling at 1 foot/second.
Figure 27B:
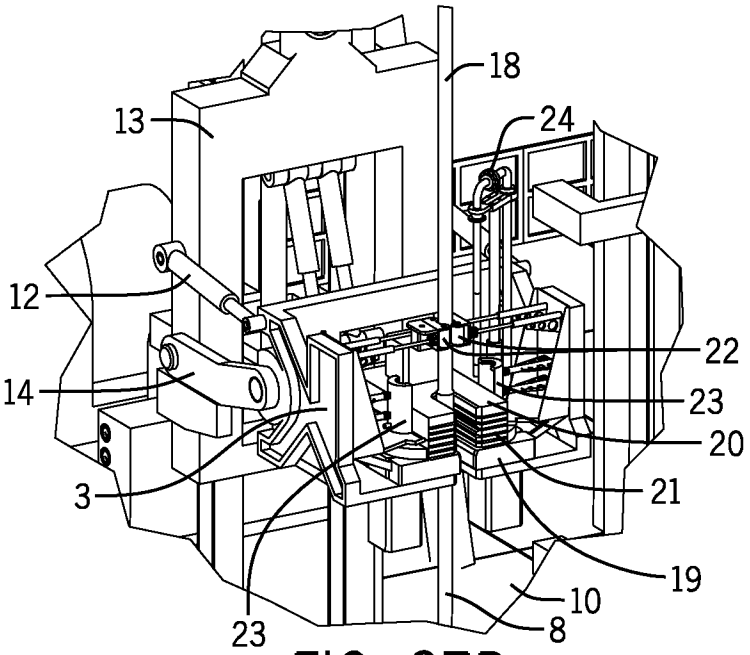

Referring now to FIG. 27A, which is a schematic of one embodiment of a drilling and tripping system 1 at t=26 seconds as the spinner 22 and UTW 20 of the first TDR 3 connects the new stand 18 to the tubular 8. Shown in FIG. 27A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 27B, which shows a close-up view of the first TDR 3 at t=26 seconds. Shown in FIG. 27B is a portion of the drill floor 10, first TDR 3, first moving dolly 13, tubular 8, stand 18, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 28A:
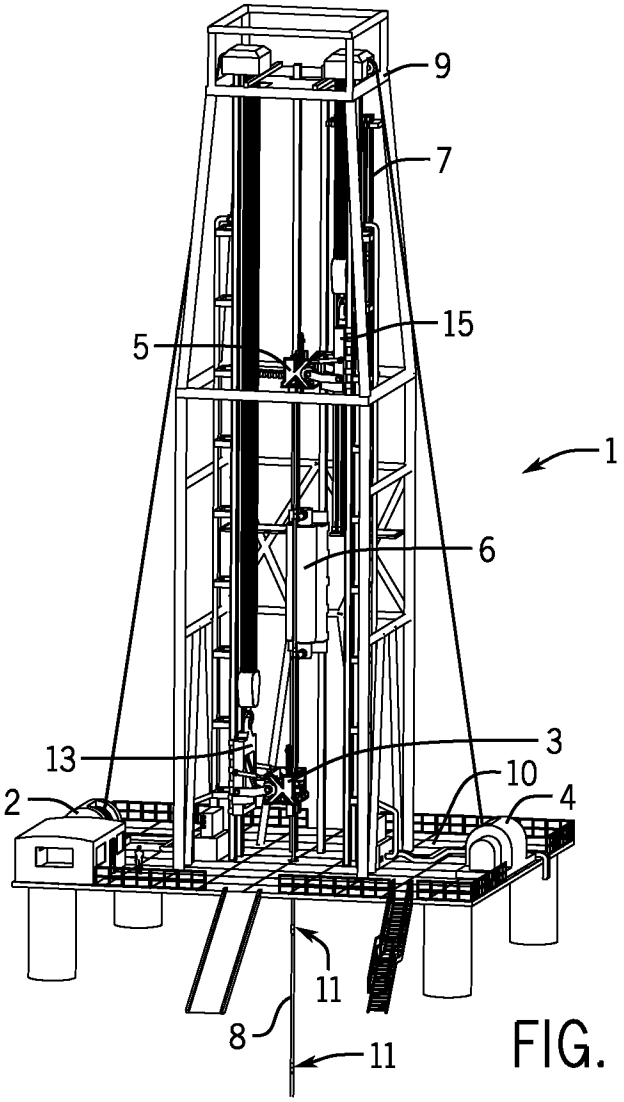
FIG. 28A and FIG. 28B. A schematic representation of the drilling and tripping system shown in FIG. 1 during drilling at 1 foot/second.
Figure 28B:
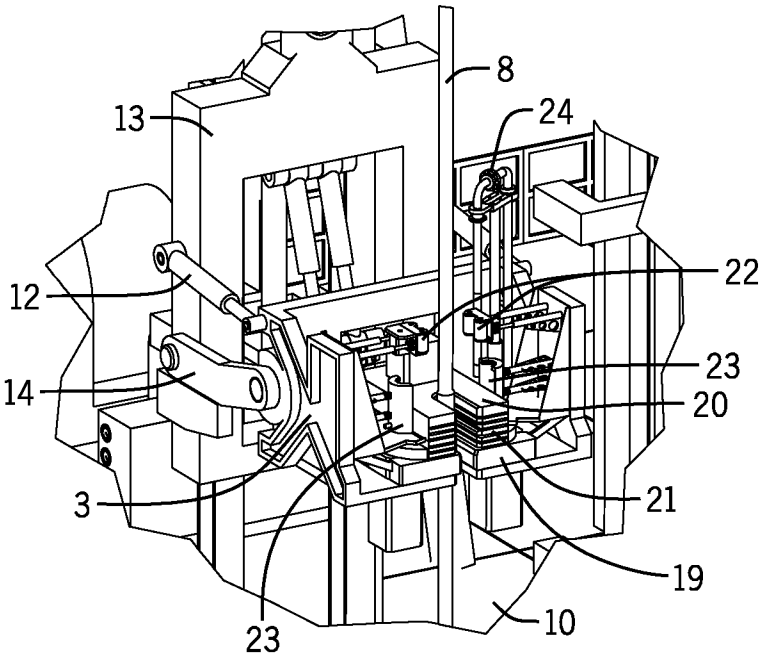

Referring now to FIG. 28A, which is a schematic of one embodiment of a drilling and tripping system 1 at t=30 seconds as the spinner 22 and UTW 20 of the first TDR 3 disengages. Shown in FIG. 28A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 28B, which shows a close-up view of the first TDR 3 at t=30 seconds. Shown in FIG. 28B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 29A:
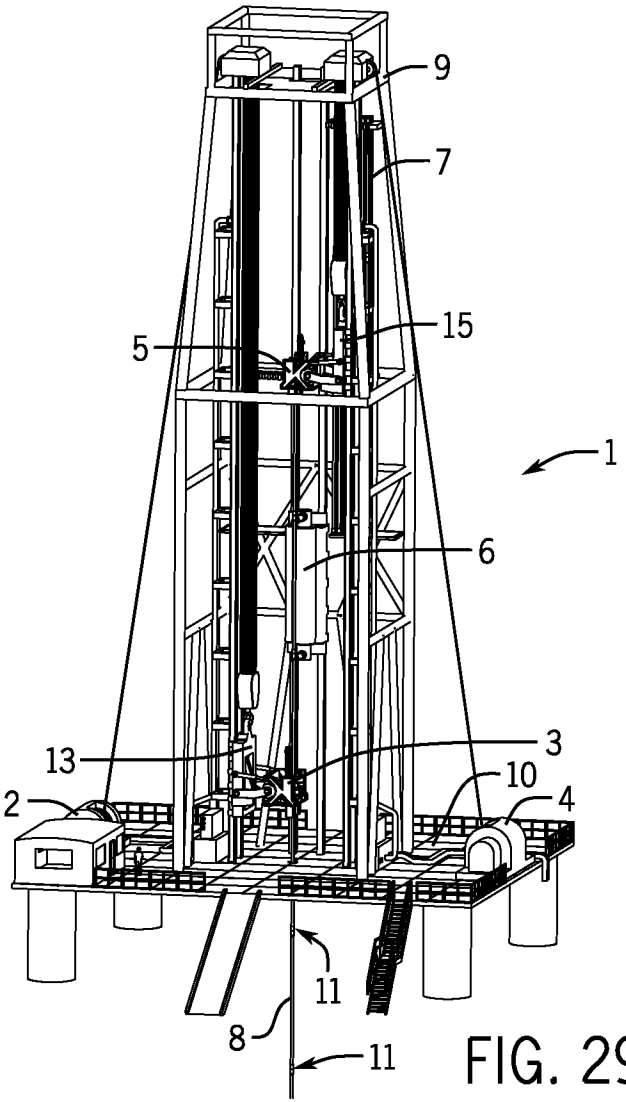
FIG. 29A and FIG. 29B. A schematic representation of the drilling and tripping system shown in FIG. 1 during drilling at 1 foot/second.
Figure 29B:
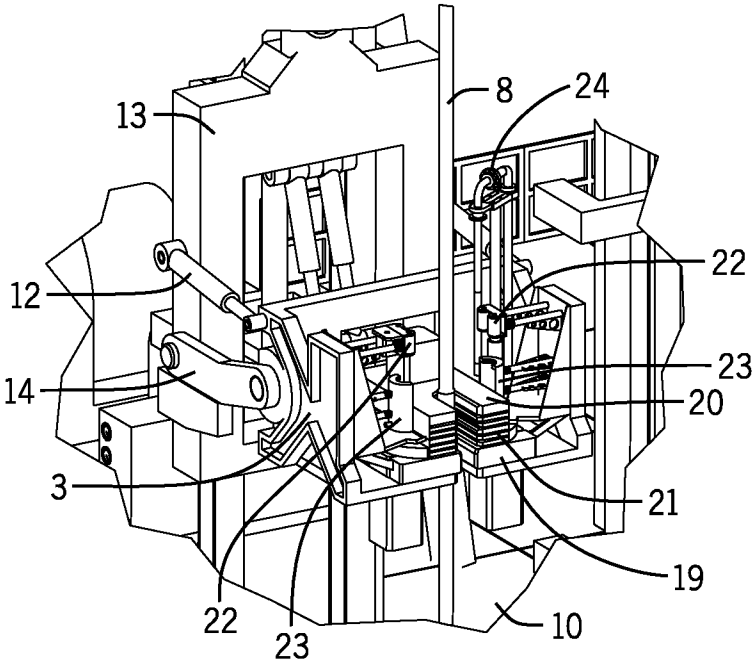

Referring now to FIG. 29A, which is a schematic of one embodiment of a drilling and tripping system 1 at t=34 seconds as the second TDR 5 engages with the tubular 8 at the top of the derrick 9. Shown in FIG. 29A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 29B, which shows a close-up view of the first TDR 3 at t=34 seconds. Shown in FIG. 29B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 30A:
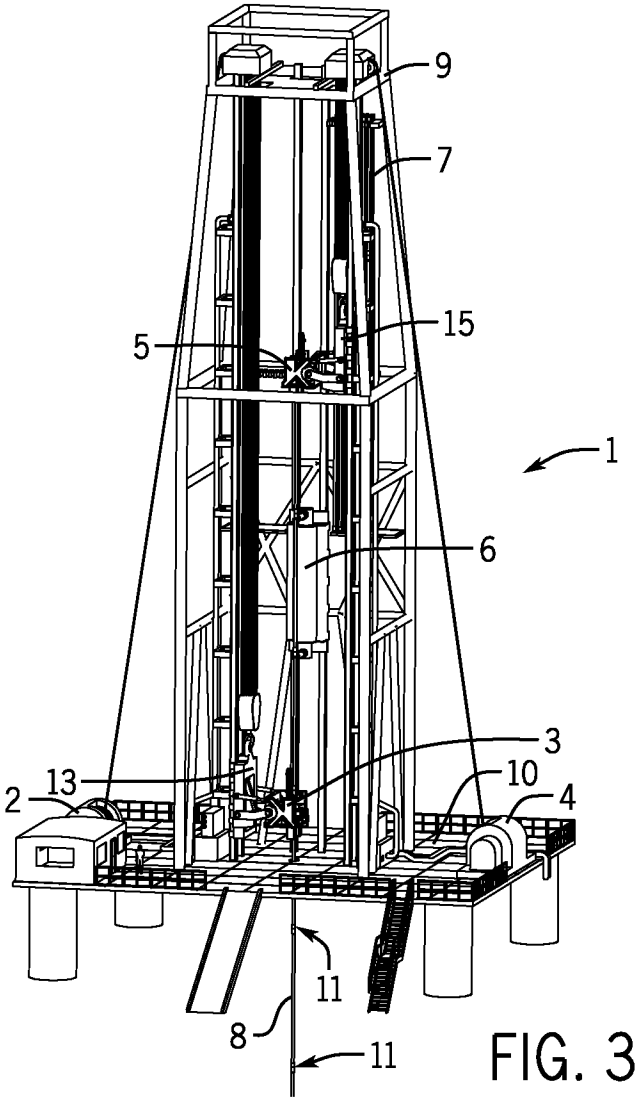
FIG. 30A and FIG. 30B. A schematic representation of the drilling and tripping system shown in FIG. 1 during drilling at 1 foot/second.
Figure 30B:
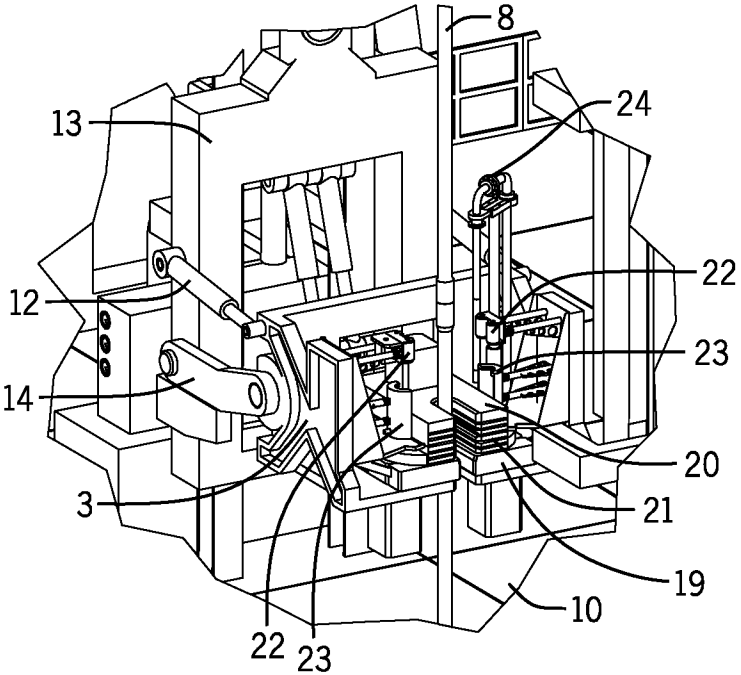

Referring now to FIG. 30A, which is a schematic of one embodiment of a drilling and tripping system 1 at t=36 seconds as the first TDR 3 retracts from the well center. Shown in FIG. 30A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 30B, which shows a close-up view of the first TDR 3 at t=36 seconds. Shown in FIG. 30B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 31A:
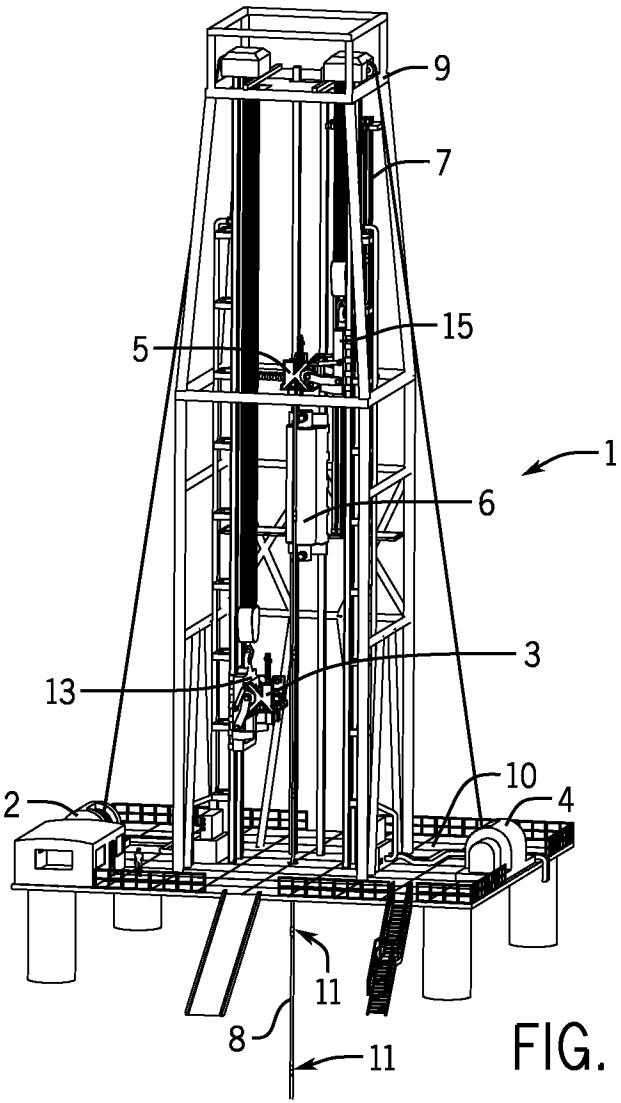
FIG. 31A and FIG. 31B. A schematic representation of the drilling and tripping system shown in FIG. 1 during drilling at 1 foot/second.
Figure 31B:
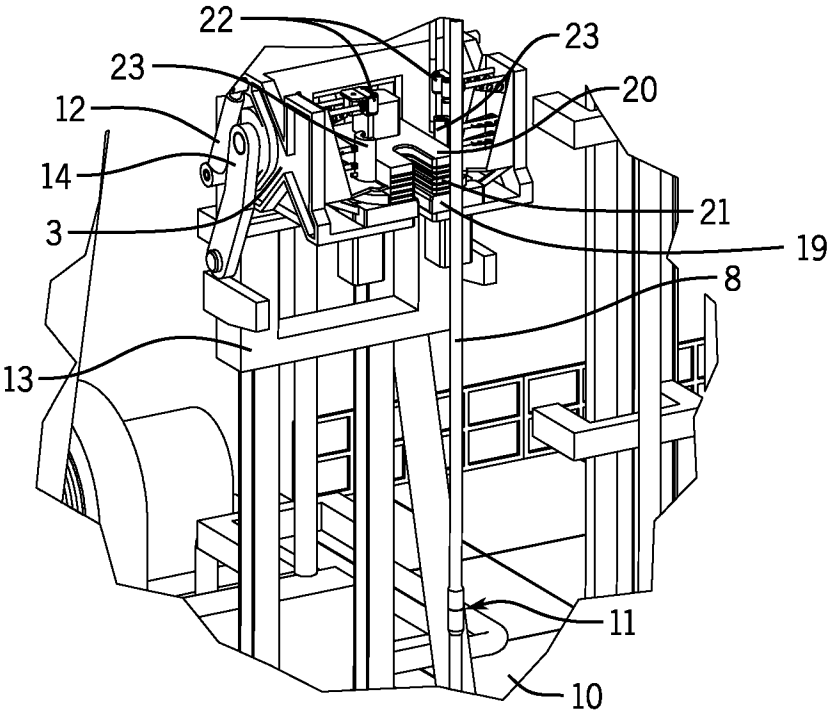

Referring now to FIG. 31A, which is a schematic of one embodiment of a drilling and tripping system 1 at t=43 seconds as the first TDR 3 is lifted to the top of the derrick. Shown in FIG. 31A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 31B, which shows a close-up view of the first TDR 3 at t=43 seconds. Shown in FIG. 31B is a portion of the drill floor 10, first TDR 3, first moving dolly 13, tubular 8, tool joint 11, and piston 12 and pivot arm 14, which are retracted and attached to the first TDR 3 and the first moving dolly 13. Features of the first TDR 3 that are visible include UTW 20, LTW 21, spinner 22, and mud bucket 23.

Figure 32A:
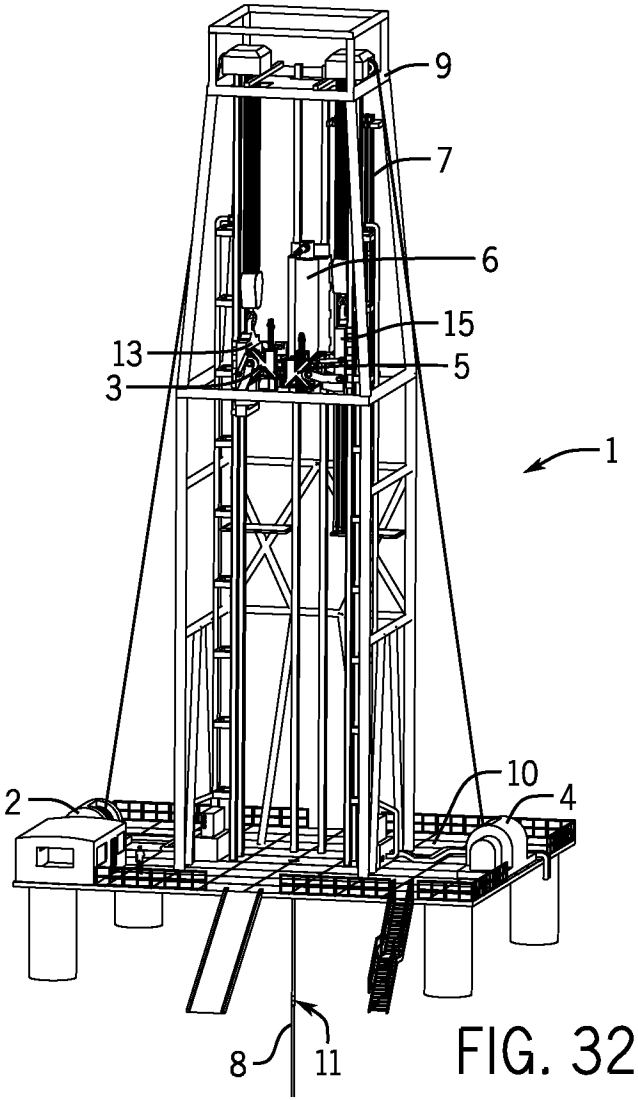
FIG. 32A and FIG. 32B. A schematic representation of the drilling and tripping system shown in FIG. 1 during drilling at 1 foot/second.
Figure 32B:
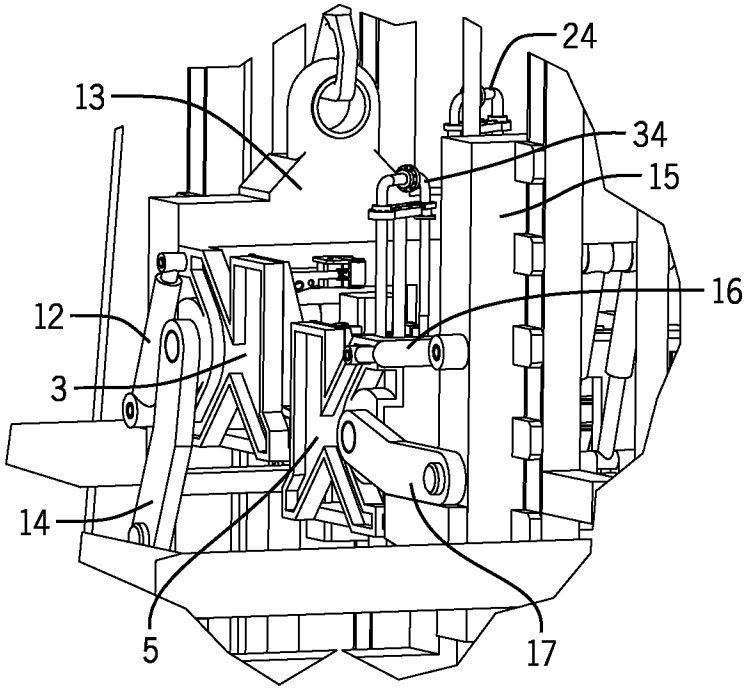

Referring now to FIG. 32A, which is a schematic of one embodiment of a drilling and tripping system 1 at t=50 seconds as the drilling continues via the second TDR 5. Shown in FIG. 32A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 and the second TDR 5 are more visible in FIG. 32B, which shows a close-up view of the first TDR 3 and the second TDR 5 at t=50 seconds. Shown in FIG. 32B is a first TDR 3, first moving dolly 13, piston 12 and pivot arm 14, which are retracted and attached to the first TDR 3 and the first moving dolly 13, second TDR 5, second moving dolly 15, and second piston 16 and second pivot arm 17, which are extended and attached to the second TDR 5 and the second moving dolly 15. Features of the first TDR 3 that are visible include FCS 24, and features of the second TDR 5 that are visible include second FCS 34.

Figure 33A:
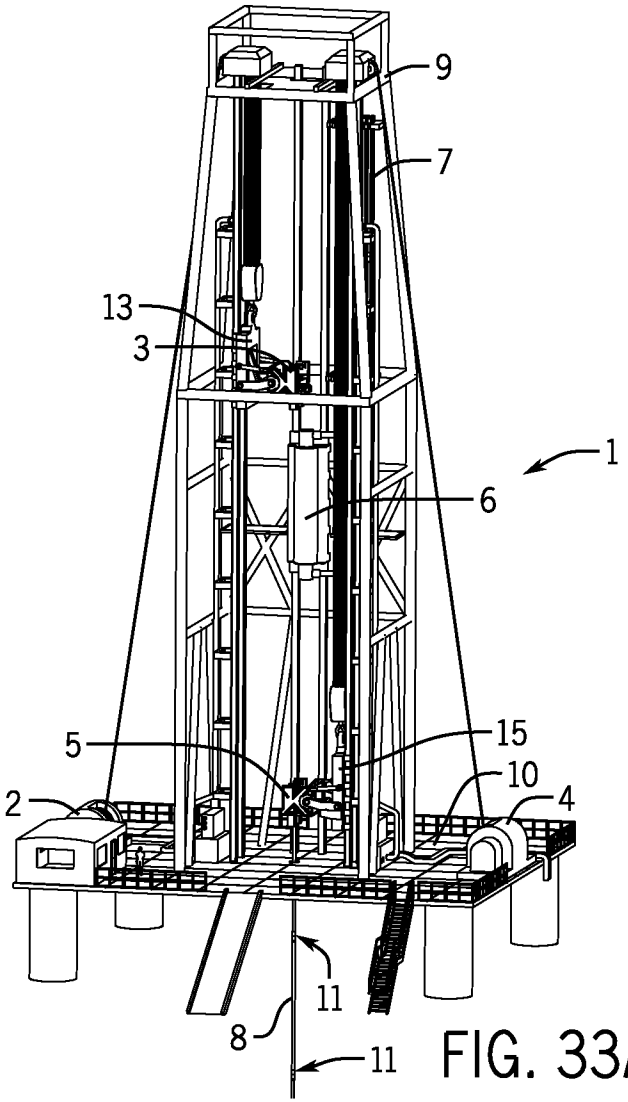
FIG. 33A and FIG. 33B. A schematic representation of the drilling and tripping system shown in FIG. 1 during drilling at 1 foot/second.
Figure 33B:
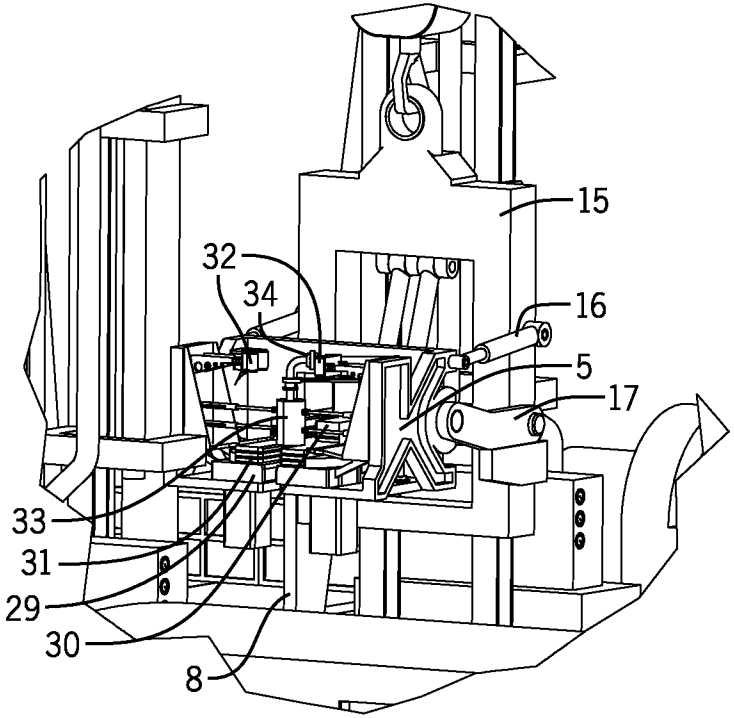

Referring now to FIG. 33A, which is a schematic of one embodiment of a drilling and tripping system 1 at t=129 seconds as the second TDR 5 reaches the drill floor 10 and penetration stops. Shown in FIG. 33A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the second TDR 5 are more visible in FIG. 33B, which shows a close-up view of the second TDR 5 at t=129 seconds. Shown in FIG. 33B is a second TDR 5, second moving dolly 15, and second piston 16 and second pivot arm 17, which are extended and attached to the second TDR 5 and the second moving dolly 15. Features of the second TDR 5 that are visible include second UTW 30, second LTW 31, second spinner 32, second mud bucket 33, and second FCS 34.

Figure 34A:
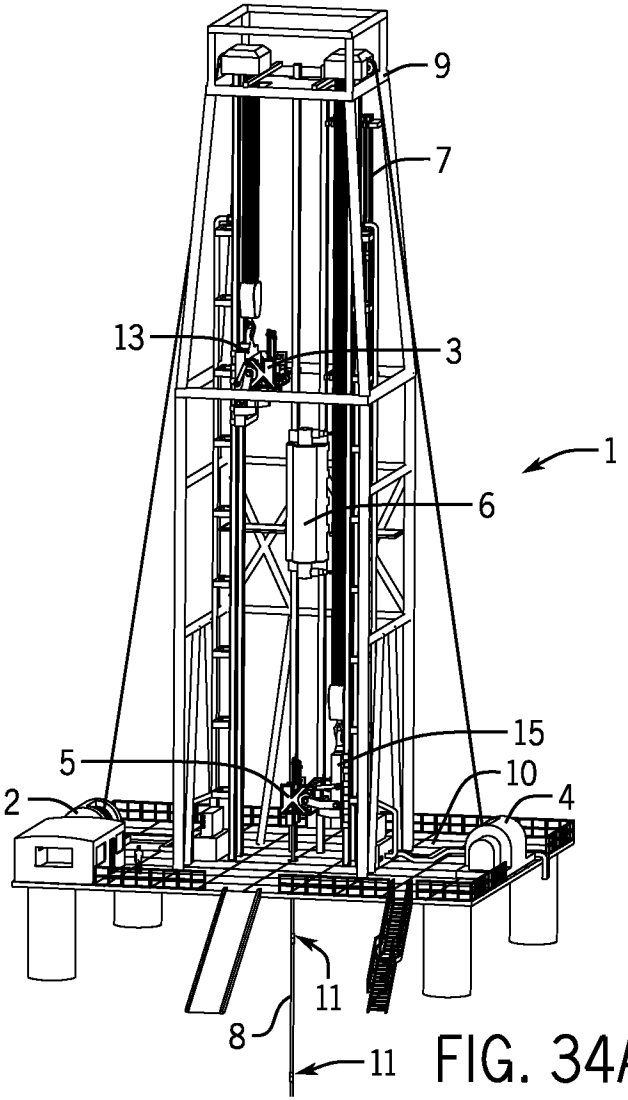
FIG. 34A and FIG. 34B. A schematic representation of the drilling and tripping system shown in FIG. 1 during drilling at 1 foot/second.
Figure 34B:
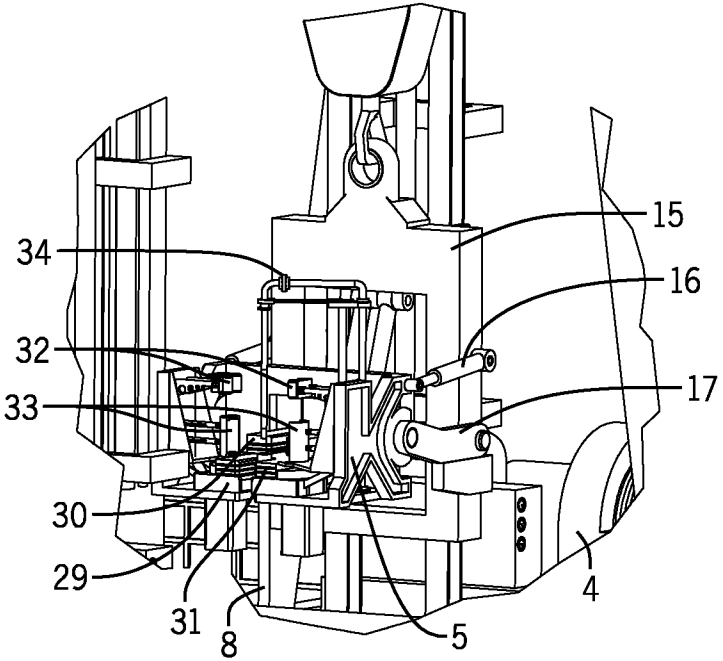

Referring now to FIG. 34A, which is a schematic of one embodiment of a drilling and tripping system 1 at t=146 seconds as the second TDR 5 disconnects while the racking arm 6 brings in the next stand. Shown in FIG. 34A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the second TDR 5 are more visible in FIG. 34B, which shows a close-up view of the second TDR 5 at t=146 seconds. Shown in FIG. 34B is a second TDR 5, second moving dolly 15, second drawworks 4, tubular 8, and second piston 16 and second pivot arm 17, which are extended and attached to the second TDR 5 and the second moving dolly 15. Features of the second TDR 5 that are visible include second UTW 30, second LTW 31, second spinner 32, second mud bucket 33, and second FCS 34.

Figure 35A:
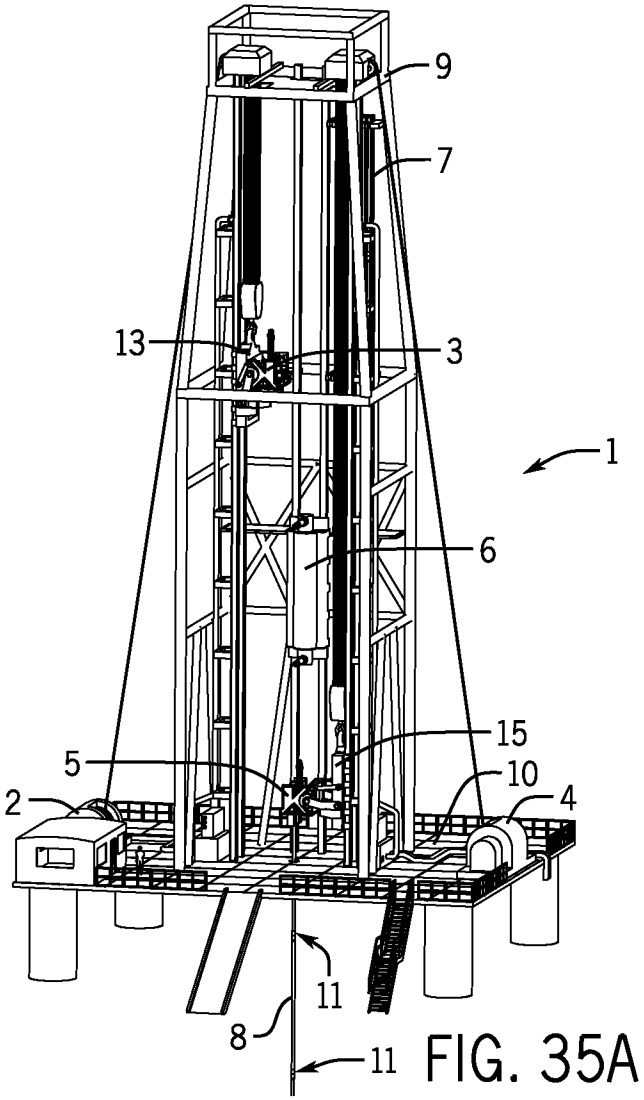
FIG. 35A and FIG. 35B. A schematic representation of the drilling and tripping system shown in FIG. 1 during drilling at 1 foot/second.
Figure 35B:
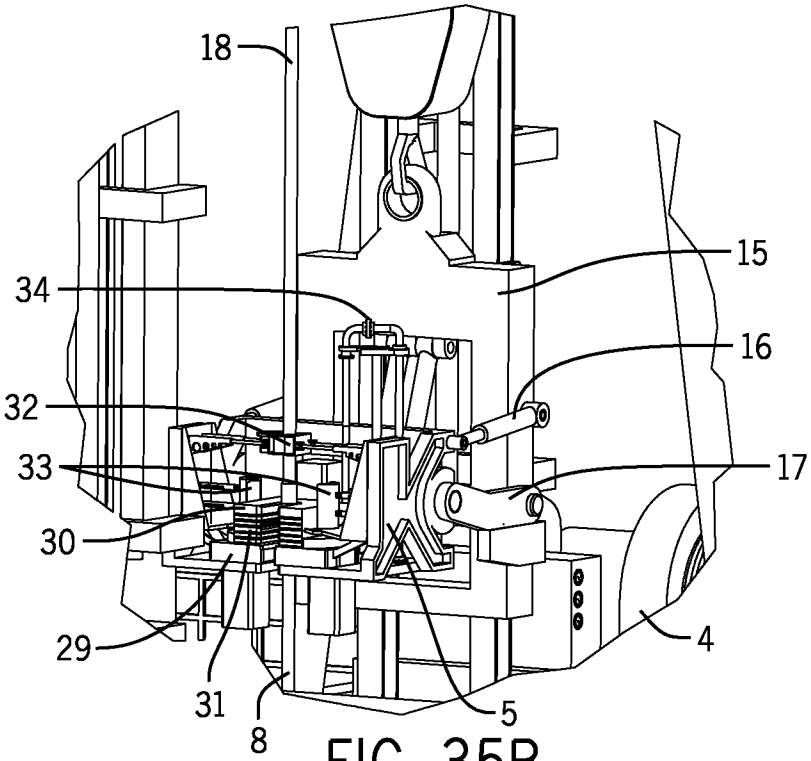

Referring now to FIG. 35A, which is a schematic of one embodiment of a drilling and tripping system 1 at t=152 seconds as the second TDR 5 connects the new stand 18 to the tubular 8. Shown in FIG. 35A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the second TDR 5 are more visible in FIG. 35B, which shows a close-up view of the second TDR 5 at t=152 seconds. Shown in FIG. 35B is a second TDR 5, second moving dolly 15, second drawworks 4, stand 18, tubular 8, and second piston 16 and second pivot arm 17, which are extended and attached to the second TDR 5 and the second moving dolly 15. Features of the second TDR 5 that are visible include second UTW 30, second LTW 31, second spinner 32, second mud bucket 33, and second FCS 34.

Figure 36A:
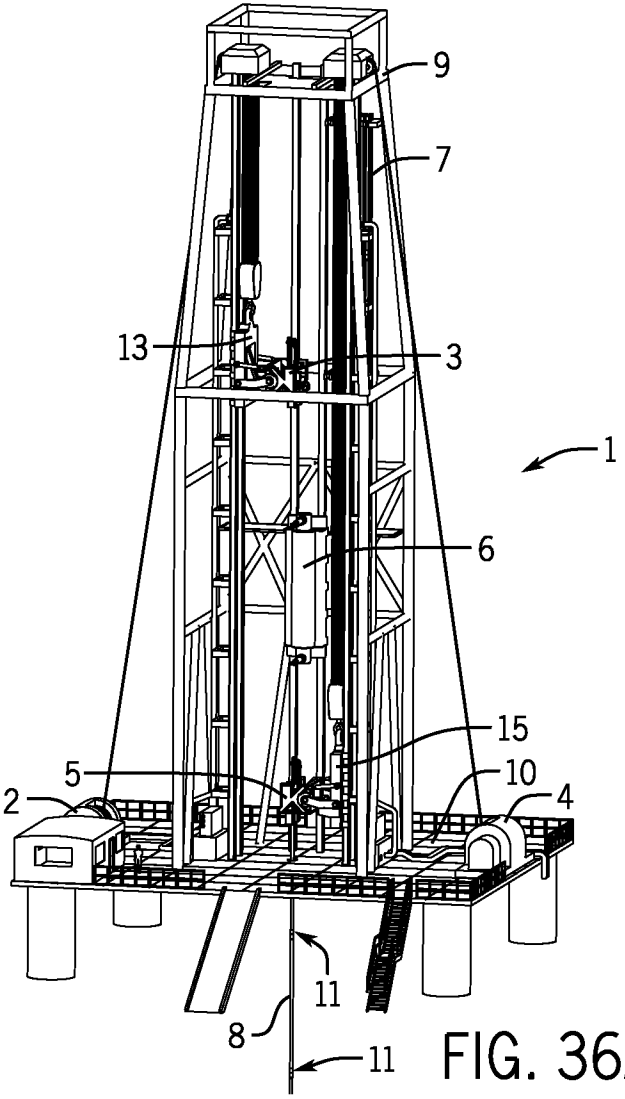
FIG. 36A and FIG. 36B. A schematic representation of the drilling and tripping system shown in FIG. 1 during drilling at 1 foot/second.
Figure 36B:
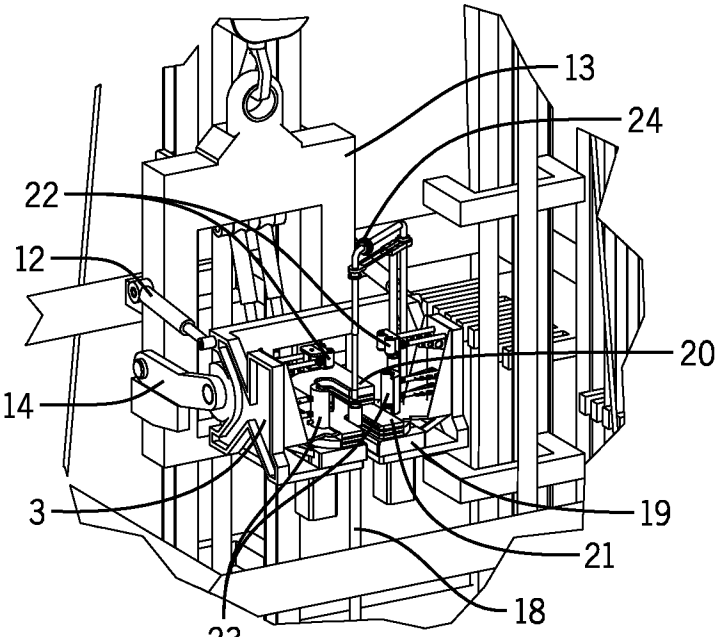

Referring now to FIG. 36A, which is a schematic of one embodiment of a drilling and tripping system 1 at t=162 seconds as the first TDR 3 engages the top of the new stand 18. Shown in FIG. 36A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 36B, which shows a close-up view of the first TDR 3 at t=162 seconds. Shown in FIG. 36B is a first TDR 3, first moving dolly 13, stand 18, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Figure 37A:
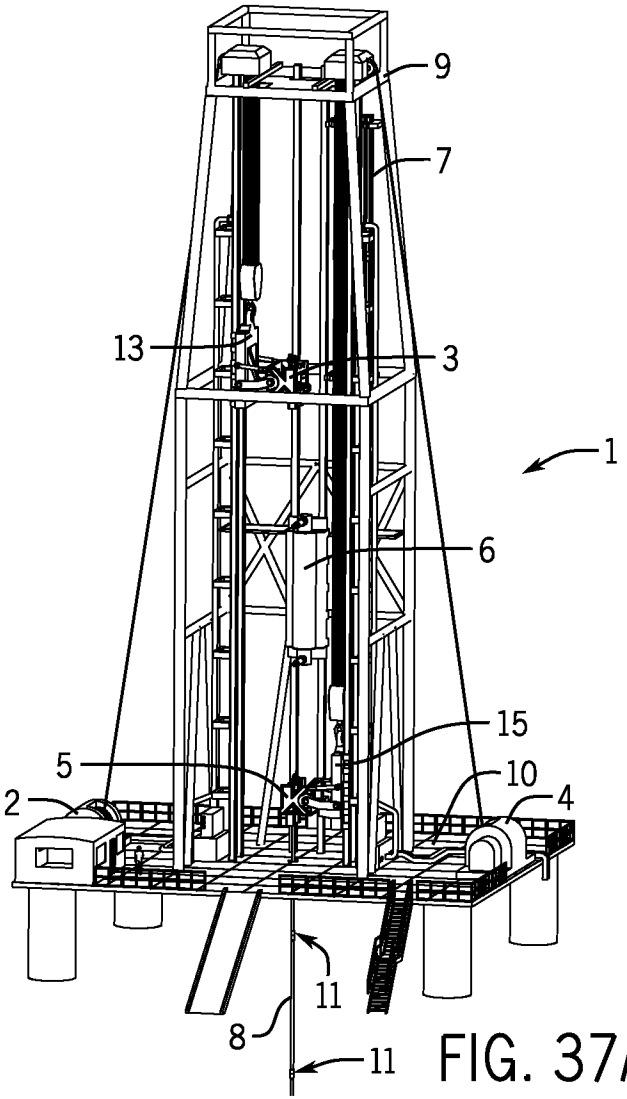
FIG. 37A and FIG. 37B. A schematic representation of the drilling and tripping system shown in FIG. 1 during drilling at 1 foot/second.
Figure 37B:
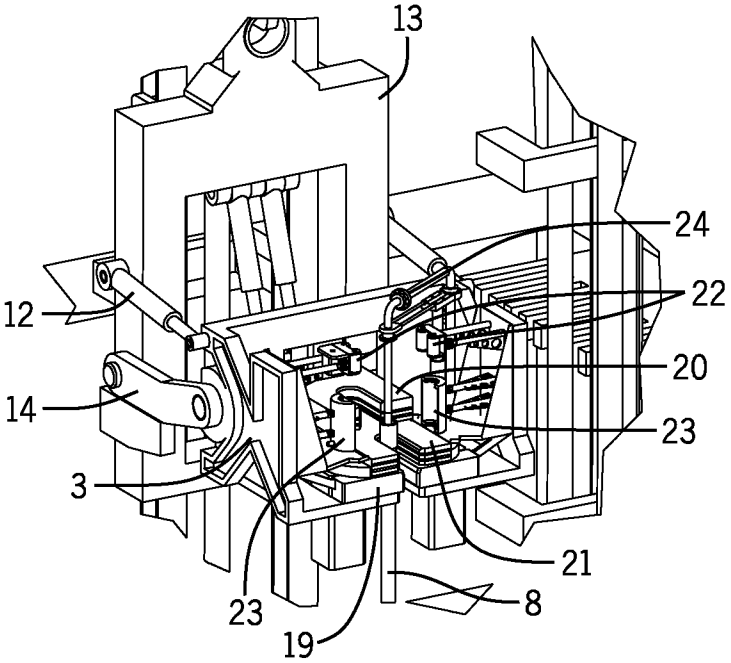

Referring now to FIG. 37A, which is a schematic of one embodiment of a drilling and tripping system 1 at t=165 seconds as the first TDR 3 picks up the weight and rotational load of the tubular 8 and engages the fluid connections system 24. Shown in FIG. 37A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 37B, which shows a close-up view of the first TDR 3 at t=165 seconds. Shown in FIG. 37B is a first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Figure 38A:
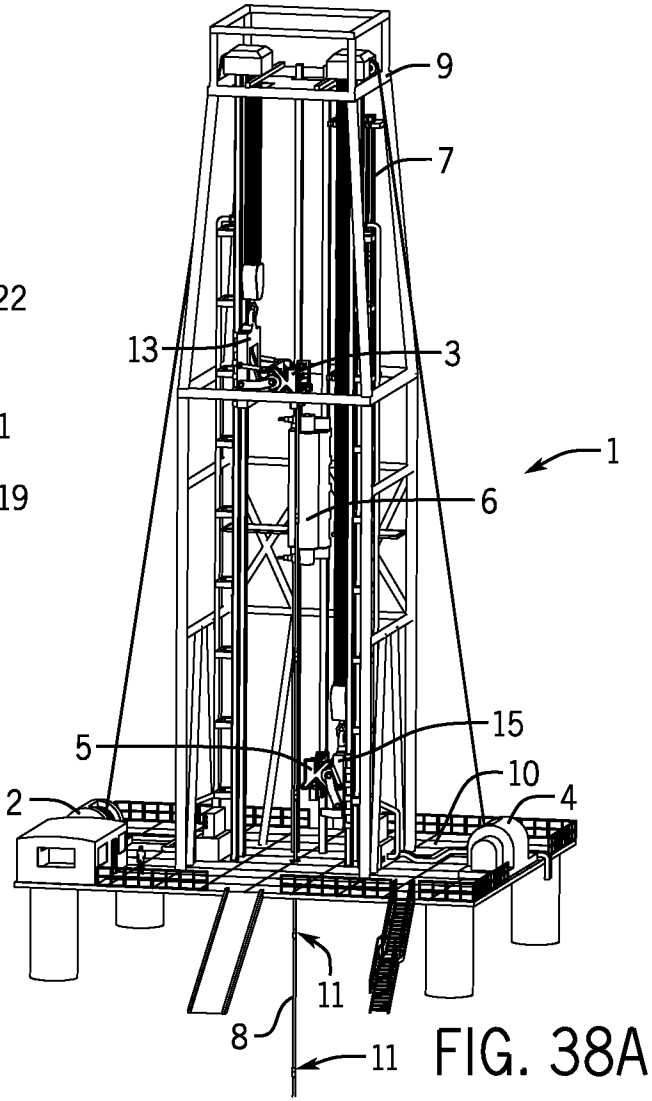
FIG. 38A and FIG. 38B. A schematic representation of the drilling and tripping system shown in FIG. 1 during drilling at 1 foot/second.
Figure 38B:
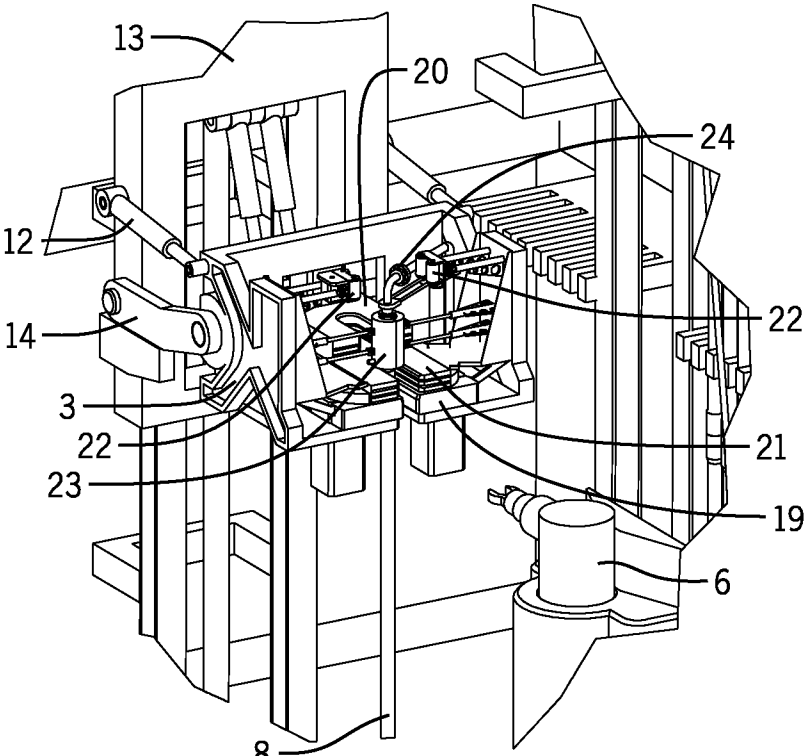

Referring now to FIG. 38A, which is a schematic of one embodiment of a drilling and tripping system 1 at t=170 seconds as the second TDR 5 has retracted and the first TDR 3 is drilling. Shown in FIG. 38A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 38B, which shows a close-up view of the first TDR 3 at t=170 seconds. Shown in FIG. 38B is a first TDR 3, first moving dolly 13, tubular 8, racking arm 6, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Figure 39A:
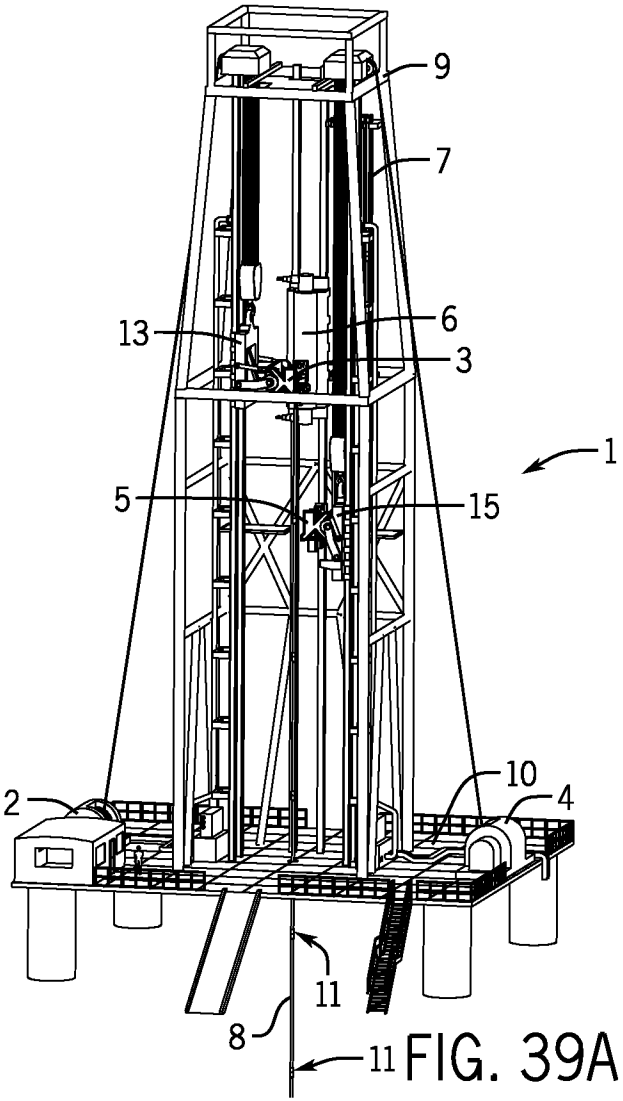
FIG. 39A and FIG. 39B. A schematic representation of the drilling and tripping system shown in FIG. 1 during drilling at 1 foot/second.
Figure 39B:
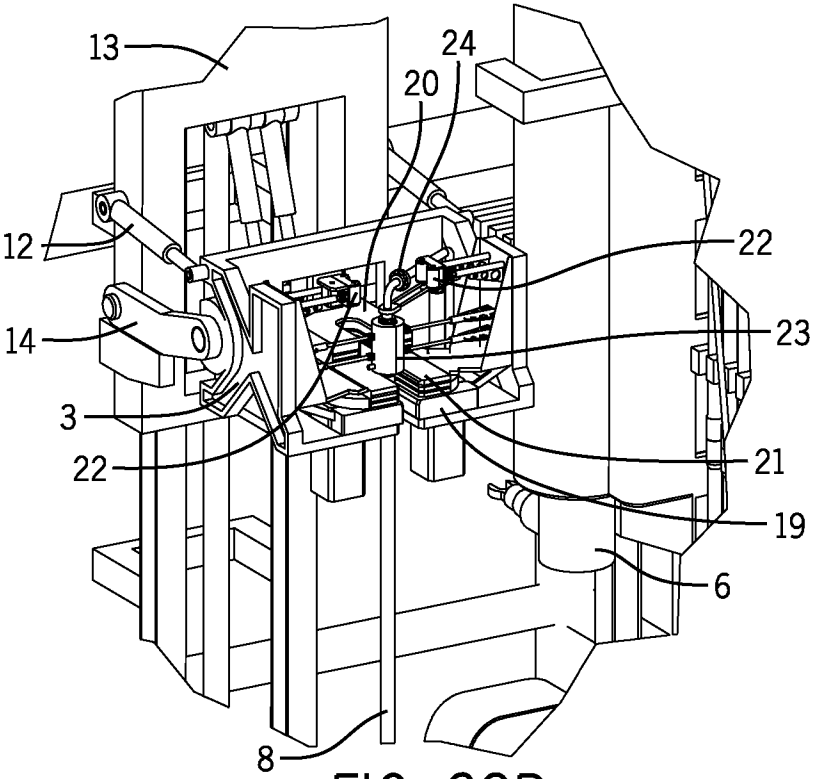

Referring now to FIG. 39A, which is a schematic of one embodiment of a drilling and tripping system 1 at t=175 seconds as the second TDR 5 is raised to the top of the derrick 9. Shown in FIG. 39A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 39B, which shows a close-up view of the first TDR 3 at t=175 seconds. Shown in FIG. 39B is a first TDR 3, first moving dolly 13, tubular 8, racking arm 6, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Figure 40A:
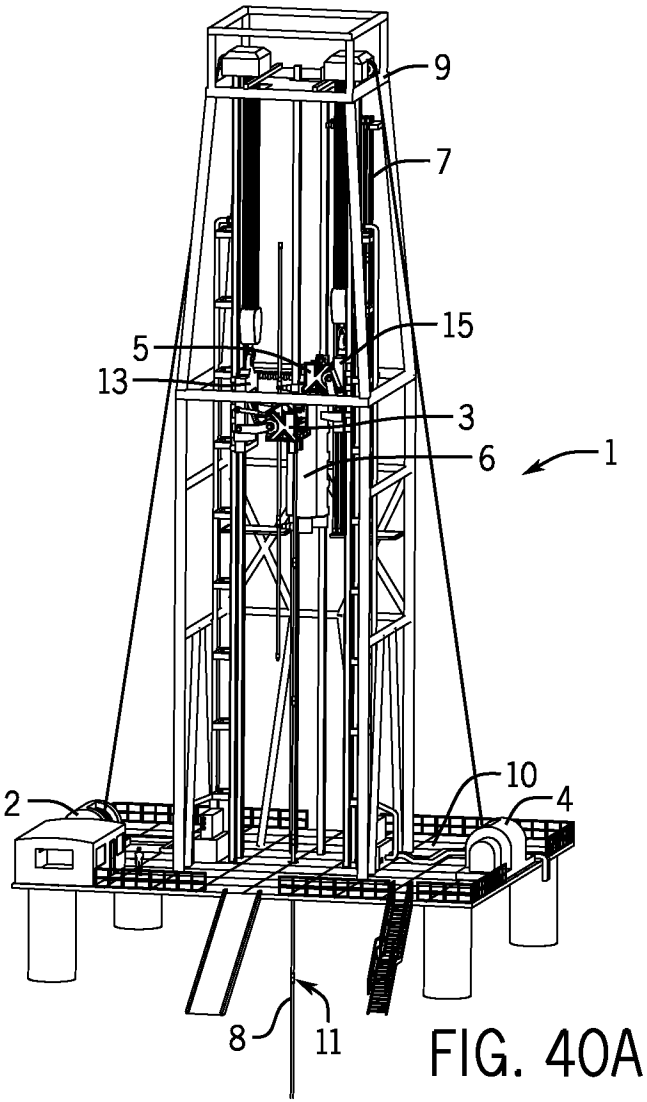
FIG. 40A and FIG. 40B. A schematic representation of the drilling and tripping system shown in FIG. 1 during drilling at 1 foot/second.
Figure 40B:
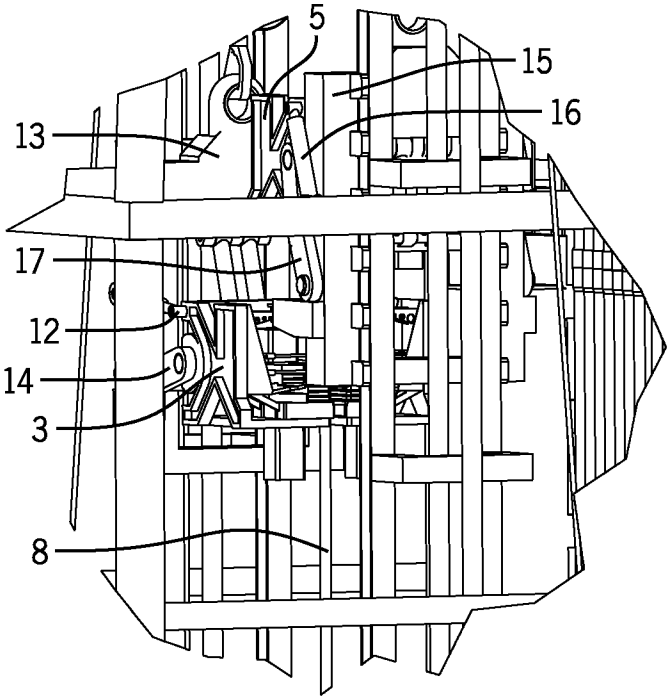

Referring now to FIG. 40A, which is a schematic of one embodiment of a drilling and tripping system 1 at t=185 seconds as the racking arm 6 positions the next stand 18. Shown in FIG. 40A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 and the second TDR 5 are more visible in FIG. 40B, which shows a close-up view of the first TDR 3 and the second TDR 5 at t=185 seconds. Shown in FIG. 40B is a first TDR 3, first moving dolly 13, tubular 8, piston 12 and pivot arm 14, which are extended and attached to the first TDR 3 and the first moving dolly 13, second TDR 5, second moving dolly 15, and second piston 16 and second pivot arm 17, which are retracted and attached to the second TDR 5 and the second moving dolly 15.

Figure 41A:
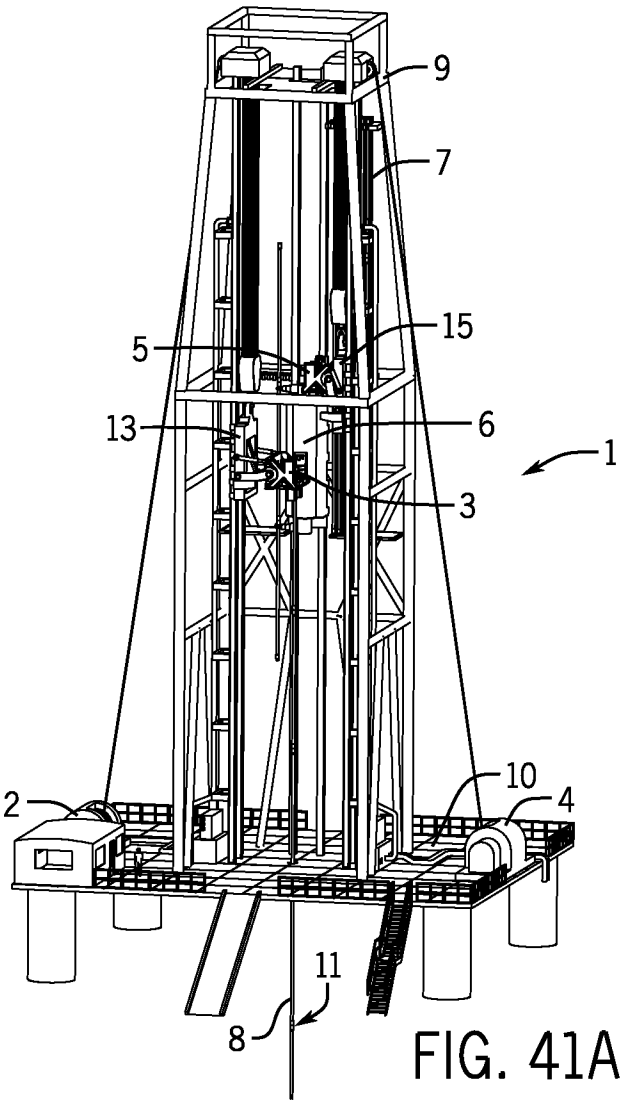
FIG. 41A and FIG. 41B. A schematic representation of the drilling and tripping system shown in FIG. 1 during drilling at 1 foot/second.
Figure 41B:
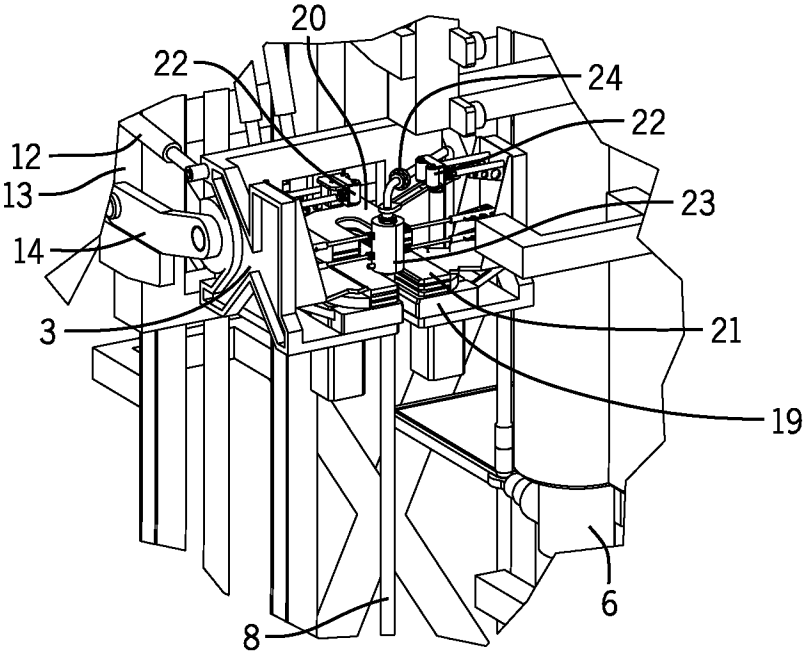

Referring now to FIG. 41A, which is a schematic of one embodiment of a drilling and tripping system 1 at t=210 seconds as the first TDR 3 continues to drill. Shown in FIG. 41A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 41B, which shows a close-up view of the first TDR 3 at t=210 seconds. Shown in FIG. 41B is a first TDR 3, first moving dolly 13, tubular 8, racking arm 6, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Figure 42A:
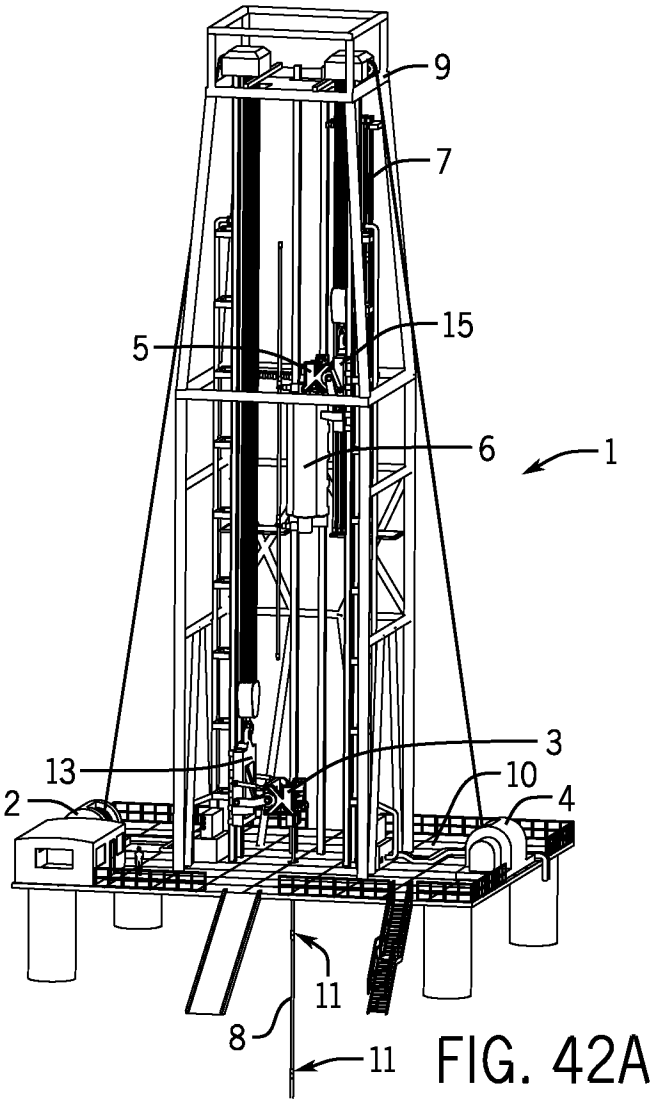
FIG. 42A and FIG. 42B. A schematic representation of the drilling and tripping system shown in FIG. 1 during drilling at 1 foot/second.
Figure 42B:
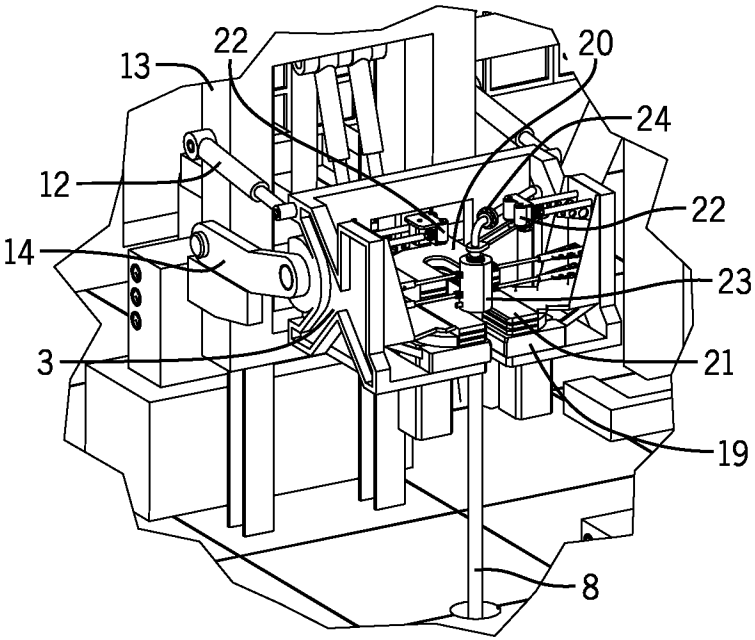

Referring now to FIG. 42A, which is a schematic of one embodiment of a drilling and tripping system 1 at t=250 seconds as the first TDR 3 reaches the drill floor 10 and the cycle repeats. Shown in FIG. 42A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 42B, which shows a close-up view of the first TDR 3 at t=250 seconds. Shown in FIG. 42B is a first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Removing Tubular without Fluid Circulation or Rotation of the Tubular

Figures 1, 43B:
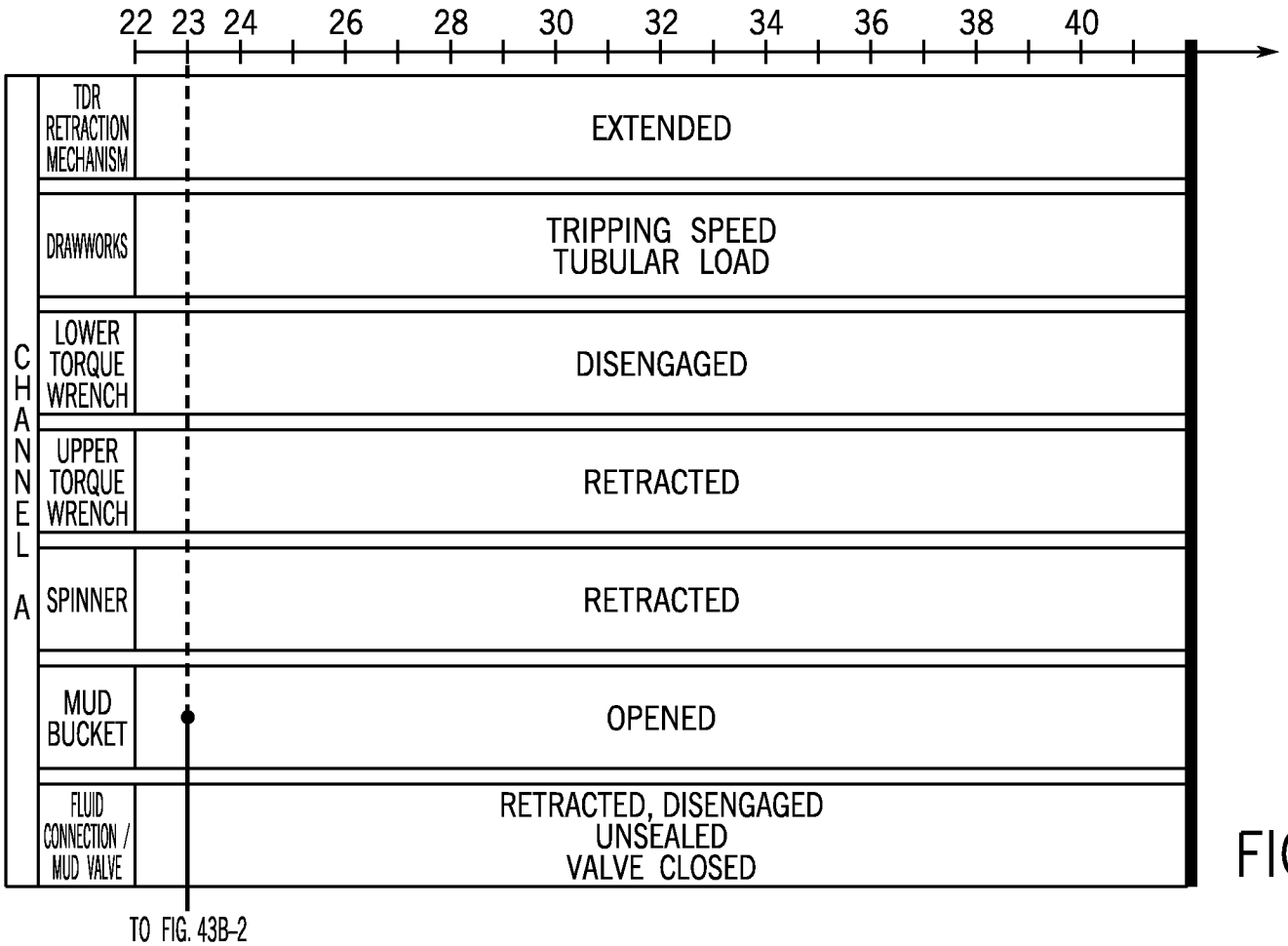
Figures 2, 43B:
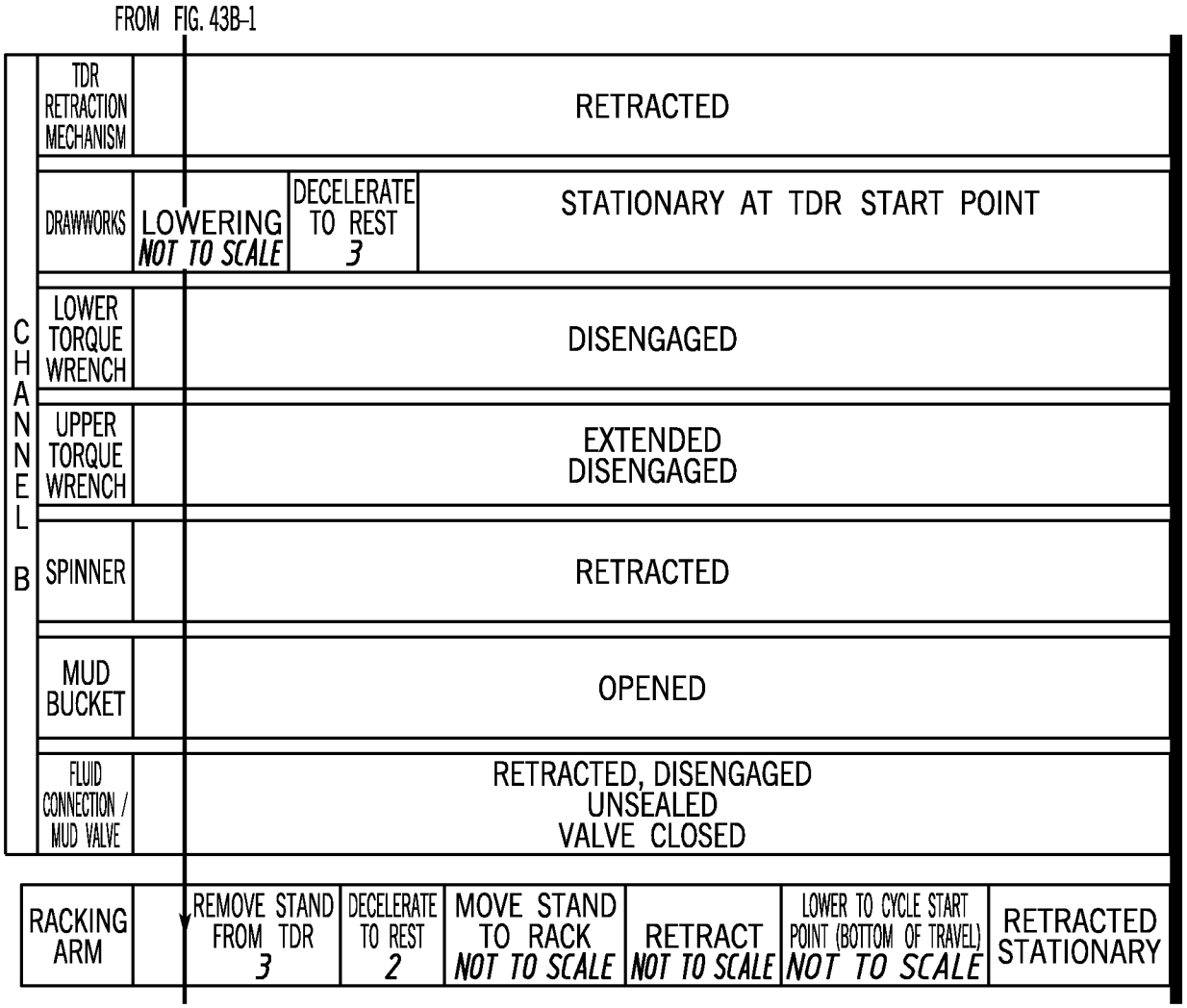
Figure 44:
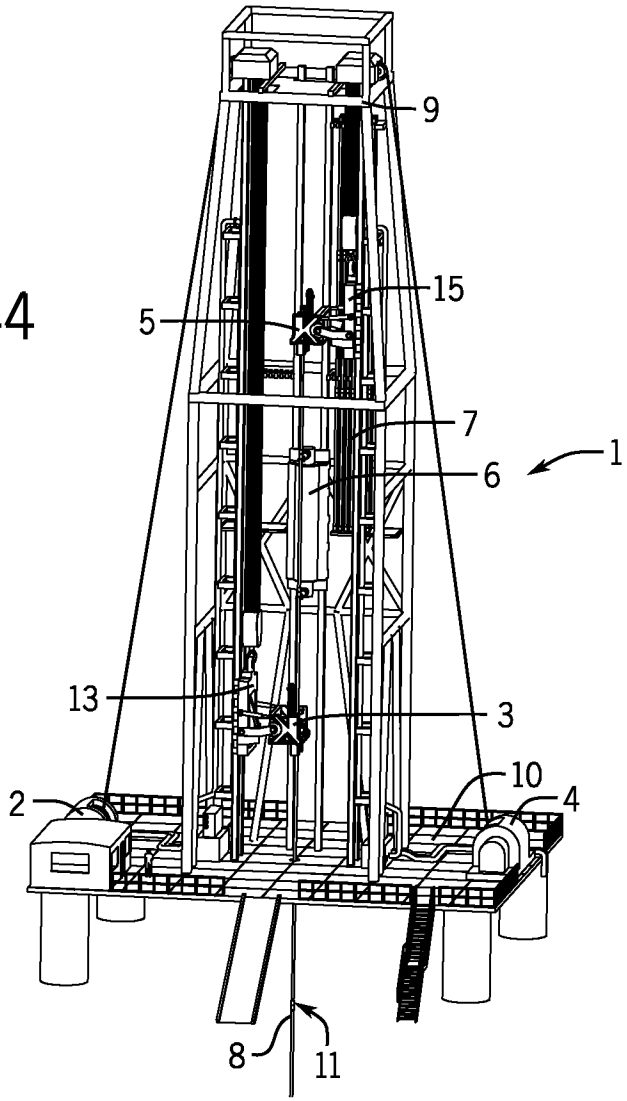
FIG. 44. A schematic representation of the drilling and tripping system shown in FIG. 1 during removal of the tubular from a hole at 3 feet/second without circulation or rotation. The drilling and tripping system is shown at t=0 seconds as the first TDR is pulling the tubular from the hole.

FIG. 43A and FIG. 43B shows the detailed operational sequence for one cycle of removing a tubular from a riser or a cased hole at 3 feet/second without the need for fluid circulation or rotation of the tubular. FIGS. 44 through 54 provide "snapshots" of one embodiment of a presently disclosed drilling and tripping system as it completes two cycles of the operational drilling sequence shown in FIG. 43A and FIG. 43B. Referring to FIG. 44, shown is a schematic representation of the drilling and tripping system 1 at t=0 seconds as the first TDR 3 is pulling the tubular 8 from the hole. Shown in FIG. 44 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Figure 45:
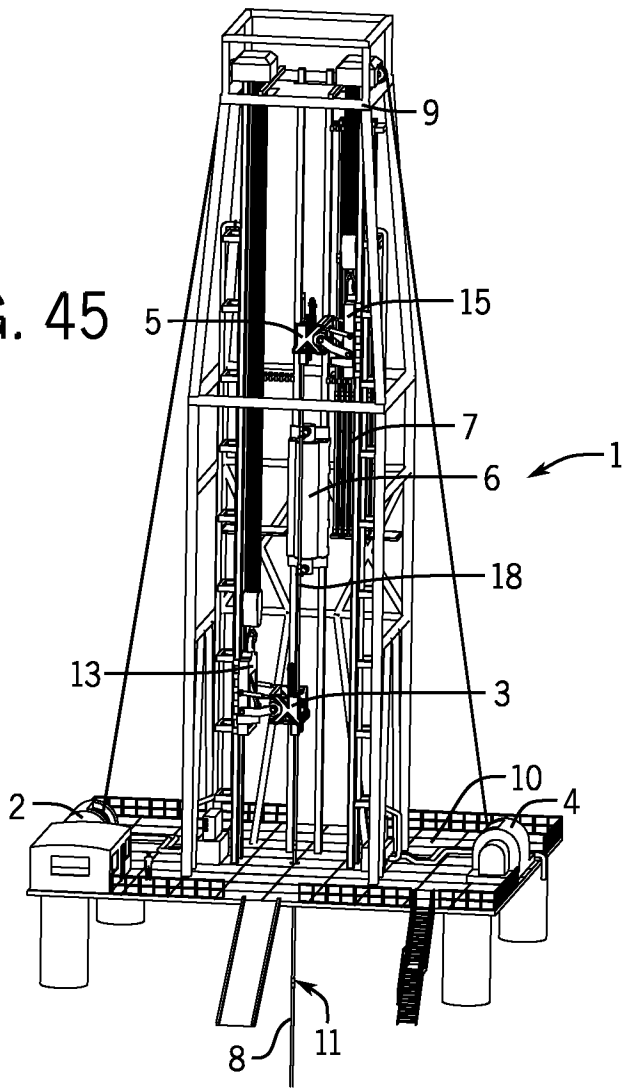
FIG. 45. A schematic representation of the drilling and tripping system shown in FIG. 1 during removal of the tubular from a hole at 3 feet/second without circulation or rotation. The drilling and tripping system is shown at t=2 seconds as the first TDR is disconnecting the top stand.

Referring to FIG. 45, shown is a schematic representation of the drilling and tripping system 1 at t=2 seconds as the first TDR 3 is disconnecting the top stand 18. Shown in FIG. 45 is first drawworks 2, first TDR 3, which is mounted on a first moving dolly 13, second drawworks 4, second TDR 5, which is mounted on a second moving dolly 15, a racking arm 6, pipe rack 7, tubular 8, stand 18, tool joint 11, derrick 9 and the drill floor 10 of the derrick 9.

Figure 46:
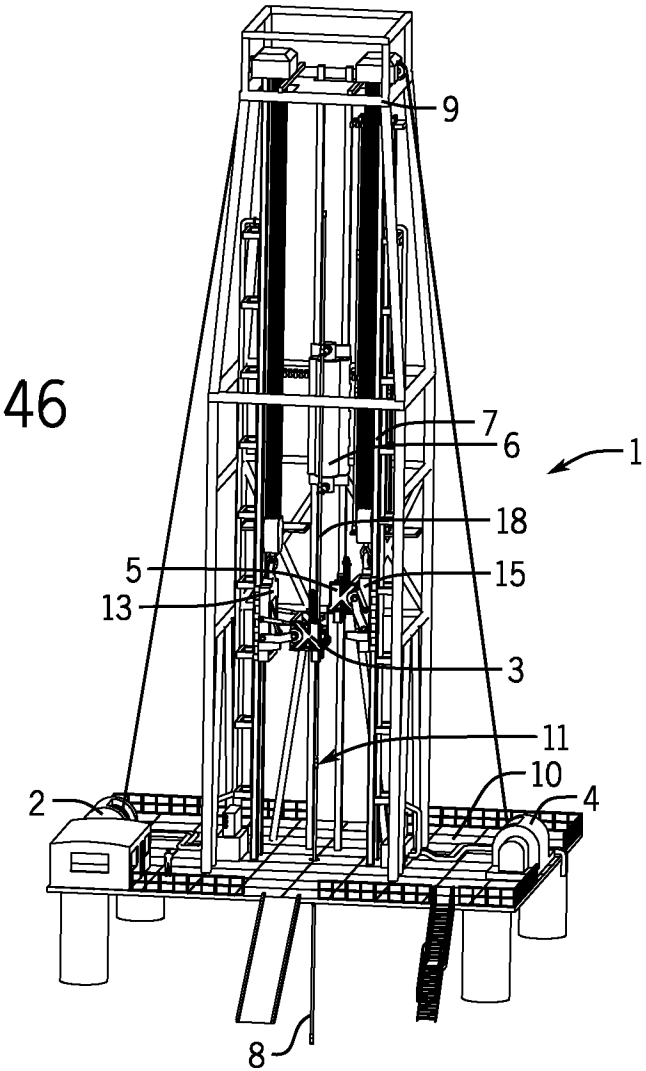
FIG. 46. A schematic representation of the drilling and tripping system shown in FIG. 1 during removal of the tubular from a hole at 3 feet/second without circulation or rotation. The drilling and tripping system is shown at t=6 seconds as the racking arm controls the top stand while the first TDR disconnects the top stand.

Referring to FIG. 46, shown is a schematic representation of the drilling and tripping system 1 at t=6 seconds as the racking arm 6 controls the top stand 18 while the first TDR 3 disconnects the top stand 18. Shown in FIG. 46 is first drawworks 2, first TDR 3, which is mounted on a first moving dolly 13, second drawworks 4, second TDR 5, which is mounted on a second moving dolly 15, a racking arm 6, pipe rack 7, tubular 8, stand 18, tool joint 11, derrick 9 and the drill floor 10 of the derrick 9.

Figure 47:
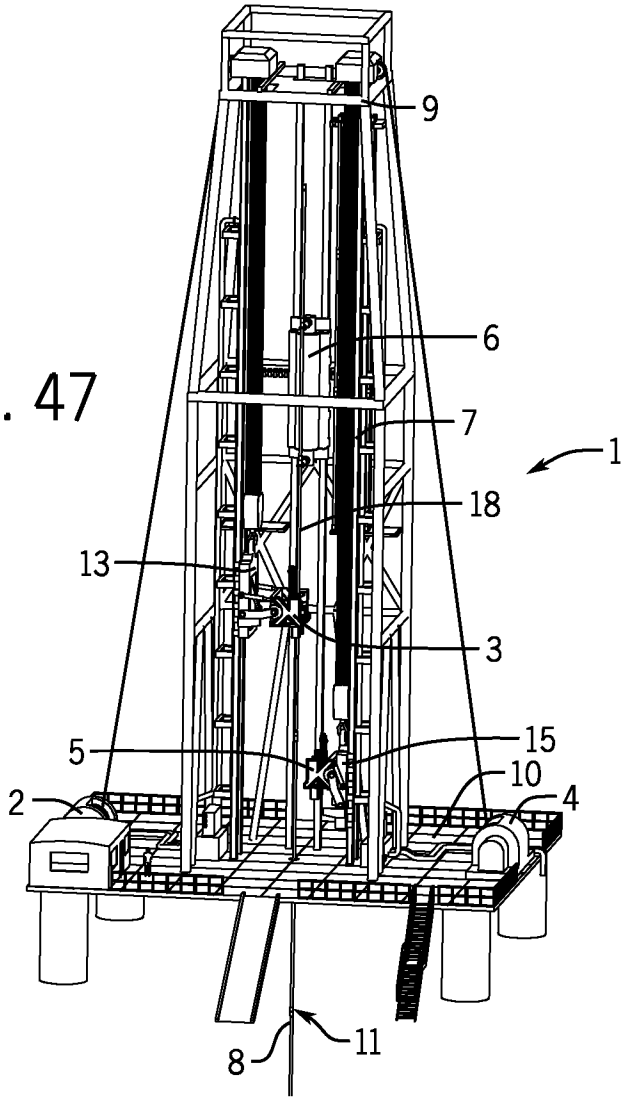
FIG. 47. A schematic representation of the drilling and tripping system shown in FIG. 1 during removal of the tubular from a hole at 3 feet/second without circulation or rotation. The drilling and tripping system is shown at t=9 seconds as the second TDR descends the derrick.

Referring to FIG. 47, shown is a schematic representation of the drilling and tripping system 1 at t=9 seconds as the second TDR 5 descends the derrick. Shown in FIG. 47 is first drawworks 2, first TDR 3, which is mounted on a first moving dolly 13, second drawworks 4, second TDR 5, which is mounted on a second moving dolly 15, a racking arm 6, pipe rack 7, tubular 8, stand 18, tool joint 11, derrick 9 and the drill floor 10 of the derrick 9.

Figure 48:
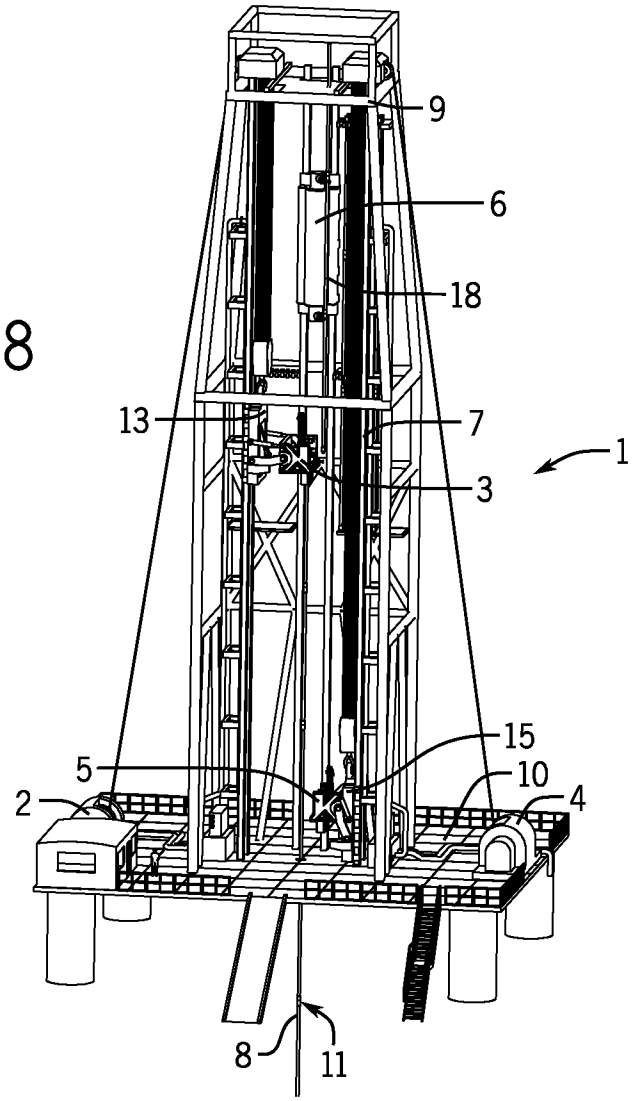
FIG. 48. A schematic representation of the drilling and tripping system shown in FIG. 1 during removal of the tubular from a hole at 3 feet/second without circulation or rotation. The drilling and tripping system is shown at t=19 seconds as the first TDR has completed disconnecting the top stand and the racking arm moves the top stand to the pipe rack.

Referring to FIG. 48, shown is a schematic representation of the drilling and tripping system 1 at t=19 seconds as the first TDR 3 has completed disconnecting the top stand 18 and the racking arm 6 moves the top stand 18 to the pipe rack 7. Shown in FIG. 48 is first drawworks 2, first TDR 3, which is mounted on a first moving dolly 13, second drawworks 4, second TDR 5, which is mounted on a second moving dolly 15, a racking arm 6, pipe rack 7, tubular 8, stand 18, tool joint 11, derrick 9 and the drill floor 10 of the derrick 9.

Figure 49:
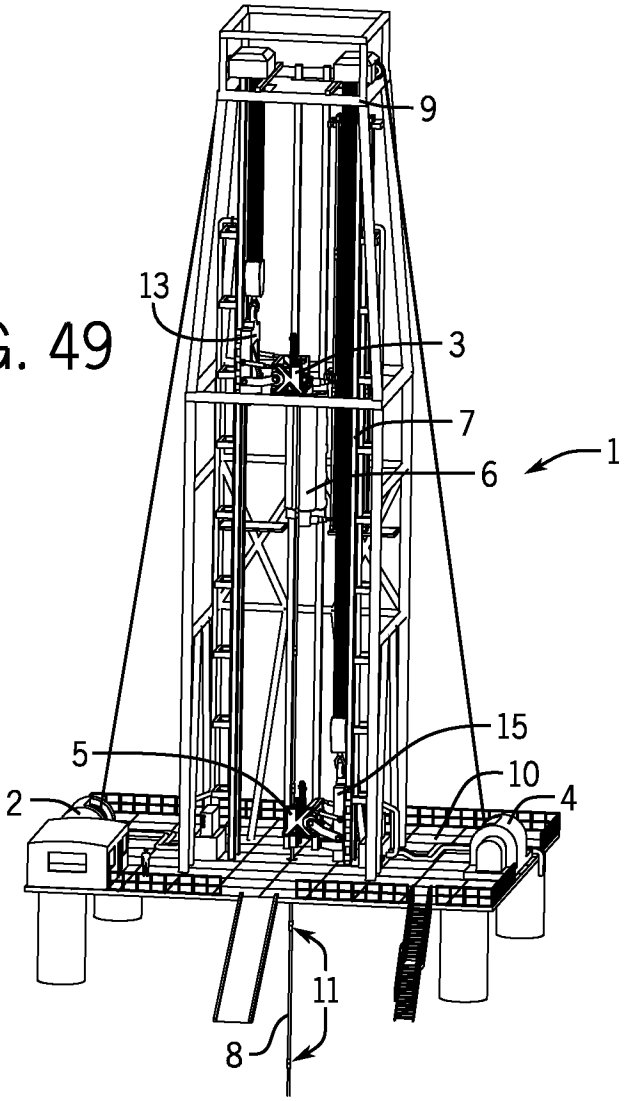
FIG. 49. A schematic representation of the drilling and tripping system shown in FIG. 1 during removal of the tubular from a hole at 3 feet/second without circulation or rotation. The drilling and tripping system is shown at t=26 seconds as the racking arm returns to the start position.

Referring to FIG. 49, shown is a schematic representation of the drilling and tripping system 1 at t=26 seconds as the racking arm 6 returns to the start position. Shown in FIG. 49 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Figure 50:
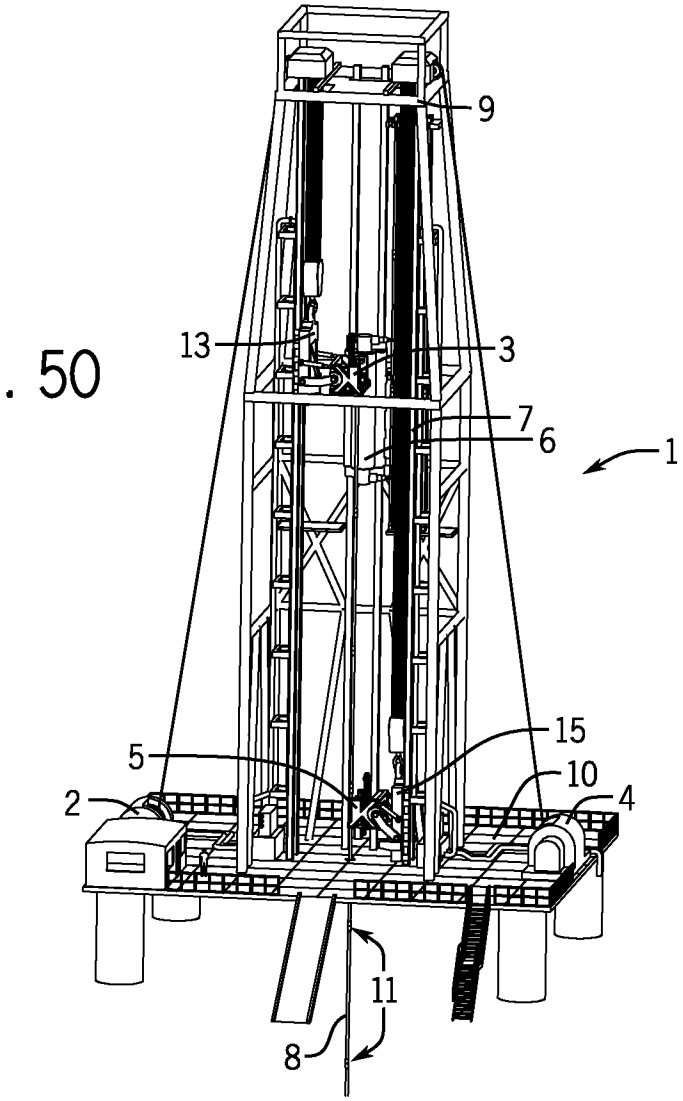
FIG. 50. A schematic representation of the drilling and tripping system shown in FIG. 1 during removal of the tubular from a hole at 3 feet/second without circulation or rotation. The drilling and tripping system is shown at t=27 seconds as the second TDR engages the next tool joint.

Referring to FIG. 50, shown is a schematic representation of the drilling and tripping system 1 at t=27 seconds as the second TDR 5 engages the next tool joint 11. Shown in FIG. 50 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Figure 51:
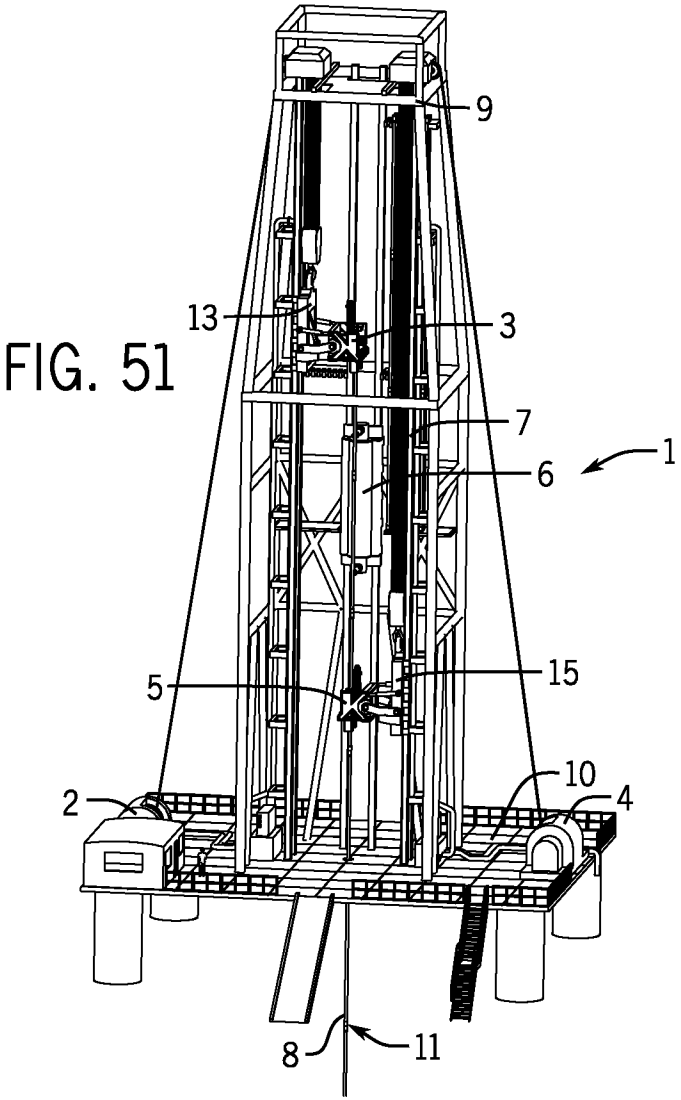
FIG. 51. A schematic representation of the drilling and tripping system shown in FIG. 1 during removal of the tubular from a hole at 3 feet/second without circulation or rotation.

Referring to FIG. 51, shown is a schematic representation of the drilling and tripping system 1 at t=32 seconds as the second TDR 5 picks up the weight of the tubular 8 and the first TDR 3 retracts. Shown in FIG. 51 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Referring to FIG. 52, shown is a schematic representation of the drilling and tripping system 1 at t=36 seconds as the second TDR 5 disconnects the tool joint 11 while the first TDR 3 descends the derrick. Shown in FIG. 52 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Referring to FIG. 53, shown is a schematic representation of the drilling and tripping system 1 at t=49 seconds as the second TDR 5 has disconnected the stand 18 and the racking arm 6 moves the stand 18 to the pipe rack 7. Shown in FIG. 53 is first drawworks 2, first TDR 3, which is mounted on a first moving dolly 13, second drawworks 4, second TDR 5, which is mounted on a second moving dolly 15, a racking arm 6, pipe rack 7, tubular 8, stand 18, tool joint 11, derrick 9 and the drill floor 10 of the derrick 9.

Referring to FIG. 54, shown is a schematic representation of the drilling and tripping system 1 at t=60 seconds as the cycle repeats. Shown in FIG. 54 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

All of the devices, compositions and/or methods disclosed and claimed herein can be made and executed without undue experimentation in light of the present disclosure. While the systems and methods of this invention have been described in terms of preferred embodiments, it will be apparent to those of skill in the art that variations may be applied to the systems and/or methods and in the steps or in the sequence of steps of the method described herein without departing from the concept, spirit and scope of the invention. More specifically, it will be apparent that certain related components may be substituted for the components described herein while the same or similar results would be achieved. In addition, some operations may be modified, such as altering the timing of the operations described herein, or possibly modifying the sequence of operations described herein. Similarly, it will be appreciated that various data inputs and computer programming may be modified to provide greater or lesser automation of the operation of the apparatus and performance of the methods described herein. All such similar substitutes and modifications apparent to those skilled in the art are deemed to be within the spirit, scope and concept of the invention as defined by the appended claims.

What is claimed is:

1. A drilling and tripping system, comprising:

a) a plurality of lifting systems;

b) a plurality of traveling differential roughnecks, each associated with at least one of said plurality of lifting systems;

c) a pipe handling and storage system associated with at least one of said plurality of traveling differential roughnecks;

d) a drilling fluid diverting system associated with at least one of said plurality of traveling differential roughnecks; and e) a control system;

wherein the plurality of traveling differential roughnecks comprises a first traveling differential roughneck and a second traveling differential roughneck, and wherein said first traveling differential roughneck or said second traveling differential roughneck comprises: a rotating elevator bowl; a lower rotating torque wrench; an upper rotating torque wrench; a spinner; a mud bucket; and a fluid connection system.

2. The drilling and tripping system of claim 1, comprising a first lifting system and a second lifting system.

3. The drilling and tripping system of claim 2, wherein said first lifting system or said second lifting system comprises a drawworks, a winch, a hydraulic ram, a rack and pinion system, or a high load linear motor.

4. The drilling and tripping system of claim 1, wherein said spinner is a two-part spinner.

5. The drilling and tripping system of claim 1, wherein said mud bucket is a two-part mud bucket.

6. The drilling and tripping system of claim 1, wherein said control system comprises a computer, said computer further comprising instructions for operating the drilling and tripping system.

7. The drilling and tripping system of claim 6, wherein said control system comprises instructions for simultaneously controlling the operations of said lifting systems, said travelling differential roughnecks, said pipe handling and storage system, and said drilling fluid diverting system.

8. The drilling and tripping system of claim 7, wherein said control system comprises instructions responsive to data associated with drilling or tripping operations.

9. The drilling and tripping system of claim 8, wherein said control system comprises instructions responsive to data stored in non-volatile memory, real-time data associated with drilling or tripping operations, and user inputs.

10. A method for removing a portion of a drillstring from a hole with continuous or nearly continuous rotation and near continuous mud circulation, comprising:

outfitting a drilling rig with a drilling and tripping system that includes a plurality of lifting systems, a plurality of traveling differential roughnecks each associated with at least one of said plurality of lifting systems, a pipe handling and storage system associated with at least one of said plurality of traveling differential roughnecks, a drilling fluid diverting system associated with at least one of said plurality of traveling differential roughnecks, and a control system; and operating said drilling and tripping system to remove at least a portion of a drillstring from a hole with continuous or nearly continuous rotation and nearly continuous mud circulation.

* * * * *